US010539895B2

(12) United States Patent
Kamisaki et al.

(10) Patent No.: US 10,539,895 B2
(45) **Date of Patent: *Jan. 21, 2020**

(54) IMAGE FORMING APPARATUS

(71) Applicant: FUJI XEROX CO., LTD., Tokyo (JP)

(72) Inventors: Makoto Kamisaki, Kanagawa (JP); Naoki Ota, Kanagawa (JP); Tatsuhiro Igarashi, Kanagawa (JP); Yasuhisa Morooka, Kanagawa (JP); Jun Sekiya, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/944,410

(22) Filed: Apr. 3, 2018

(65) Prior Publication Data

US 2019/0094730 A1 Mar. 28, 2019

(30) Foreign Application Priority Data

Sep. 27, 2017 (JP) ..... 2017-185983

(51) Int. Cl.
*G03G 9/087* (2006.01)
*G03G 15/095* (2006.01)
(Continued)

(52) U.S. Cl.
CPC ..... *G03G 9/08735* (2013.01); *G03G 9/0819* (2013.01); *G03G 15/04* (2013.01); *G03G 15/095* (2013.01)

(58) Field of Classification Search
CPC ..... G03G 9/0819; G03G 9/08735; G03G 15/095; G03G 15/04
See application file for complete search history.

(56) References Cited

U.S. PATENT DOCUMENTS 4,848,141 A 7/1989 Oliver et al.
2014/0322643 A1* 10/2014 Watanabe ..... G03G 9/0806 430/109.4
2016/0246190 A1* 8/2016 Kawabata ..... G03G 5/043

FOREIGN PATENT DOCUMENTS

JP H04-189873 A 7/1992
JP H05-098181 A 4/1993
(Continued)

OTHER PUBLICATIONS

English Translation JP-10268558-A, Ito et al., Published Oct. 9, 1998 (Year: 1998).*

*Primary Examiner* — Ryan D Walsh
(74) *Attorney, Agent, or Firm* — Oliff PLC

(57) ABSTRACT

An image forming apparatus includes an image carrier that includes a conductive substrate, and a photosensitive layer and a surface protection layer; a developing device that includes an electrostatic image developer containing a toner, and develops the electrostatic image to form a toner image. The toner contains an amorphous polyester resin and has a weight average molecular weight Mw in a range of from 25,000 to 60,000, and a ratio of the weight average molecular weight Mw to a number average molecular weight Mn (Mw/Mn) is in a range of from 5 to 10. In the toner, a ratio of an absorbance for a wavelength of 1500 $cm^{-1}$ to an absorbance for a wavelength of 720 $cm^{-1}$ is 0.6 or less, and a ratio of an absorbance for a wavelength of 820 $cm^{-1}$ to the absorbance for a wavelength of 720 $cm^{-1}$ is 0.4 or less.

16 Claims, 3 Drawing Sheets

(51) Int. Cl.
*G03G 15/04* (2006.01)
*G03G 9/08* (2006.01)

(56) References Cited

FOREIGN PATENT DOCUMENTS

| | | | | |
|---|---|---|---|---|
| JP | H05-140472 | A | | 6/1993 |
| JP | H05-140473 | A | | 6/1993 |
| JP | H05-216249 | A | | 8/1993 |
| JP | H05-263007 | A | | 10/1993 |
| JP | H05-279591 | A | | 10/1993 |
| JP | H05-323630 | A | | 12/1993 |
| JP | H07-72640 | A | | 3/1995 |
| JP | H08-176293 | A | | 7/1996 |
| JP | H08-208820 | A | | 8/1996 |
| JP | 10268558 | A | * | 10/1998 |
| JP | H11-052603 | A | | 2/1999 |
| JP | 2000-056504 | A | | 2/2000 |
| JP | 2000-206715 | A | | 7/2000 |
| JP | 2000-206717 | A | | 7/2000 |
| JP | 2000-264961 | A | | 9/2000 |
| JP | 2001-166510 | A | | 6/2001 |
| JP | 2001-175016 | A | | 6/2001 |
| JP | 2004-012986 | A | | 1/2004 |
| JP | 2004-078147 | A | | 3/2004 |
| JP | 2004-302450 | A | | 10/2004 |
| JP | 2005-115353 | A | | 4/2005 |
| JP | 2005-181992 | A | | 7/2005 |
| JP | 2007-033947 | A | | 2/2007 |
| JP | 2007-272204 | A | | 10/2007 |
| JP | 2012-155282 | A | | 8/2012 |

* cited by examiner

IMAGE FORMING APPARATUS

CROSS-REFERENCE TO RELATED APPLICATIONS

This application is based on and claims priority under 35 USC 119 from Japanese Patent Application No. 2017-185983 filed Sep. 27, 2017.

BACKGROUND

(i) Technical Field

The present invention relates to an image forming apparatus.

(ii) Related Art

Electrophotographic image forming method involves, for example, charging a surface of an electrophotographic photoreceptor, forming an electrostatic image on the surface of the electrophotographic photoreceptor according to image information, developing the electrostatic image with a developer containing a toner so as to form a toner image, and transferring and fixing the toner image onto a surface of a recording medium.

SUMMARY

According to an aspect of the invention, there is provided an image forming apparatus that includes an image carrier that includes a conductive substrate, and a photosensitive layer and a surface protection layer disposed on the conductive substrate in that order; a charging device that charges a surface of the image carrier; an electrostatic image-forming device that forms an electrostatic image on the charged surface of the image carrier; a developing device that includes an electrostatic image developer containing a toner, and develops the electrostatic image to form a toner image on the surface of the image carrier; a transfer device that transfers the toner image onto a recording medium; and a cleaning unit that cleans the surface of the image carrier by a cleaning blade contacting the surface. The toner contains a binder resin that is an amorphous polyester resin; a tetrahydrofuran-soluble component of the toner has a weight average molecular weight Mw and number average molecular weight Mn determined from gel permeation chromatography, and the Mw is in the range of 25,000 to 60,000, and Mw/Mn is in the range of 5 to 10; and the toner has absorbance measured by infrared absorption spectrometry, the ratio of absorbance for a wavelength of 1500 $cm^{-1}$ to absorbance for a wavelength of 720 $cm^{-1}$ is 0.6 or less, and the ratio of absorbance for a wavelength of 820 $cm^{-1}$ to absorbance for a wavelength of 720 $cm^{-1}$ is 0.4 or less.

BRIEF DESCRIPTION OF THE DRAWINGS

Exemplary embodiments of the present invention will be described in detail based on the following figures, wherein.

DETAILED DESCRIPTION

Figure 1:
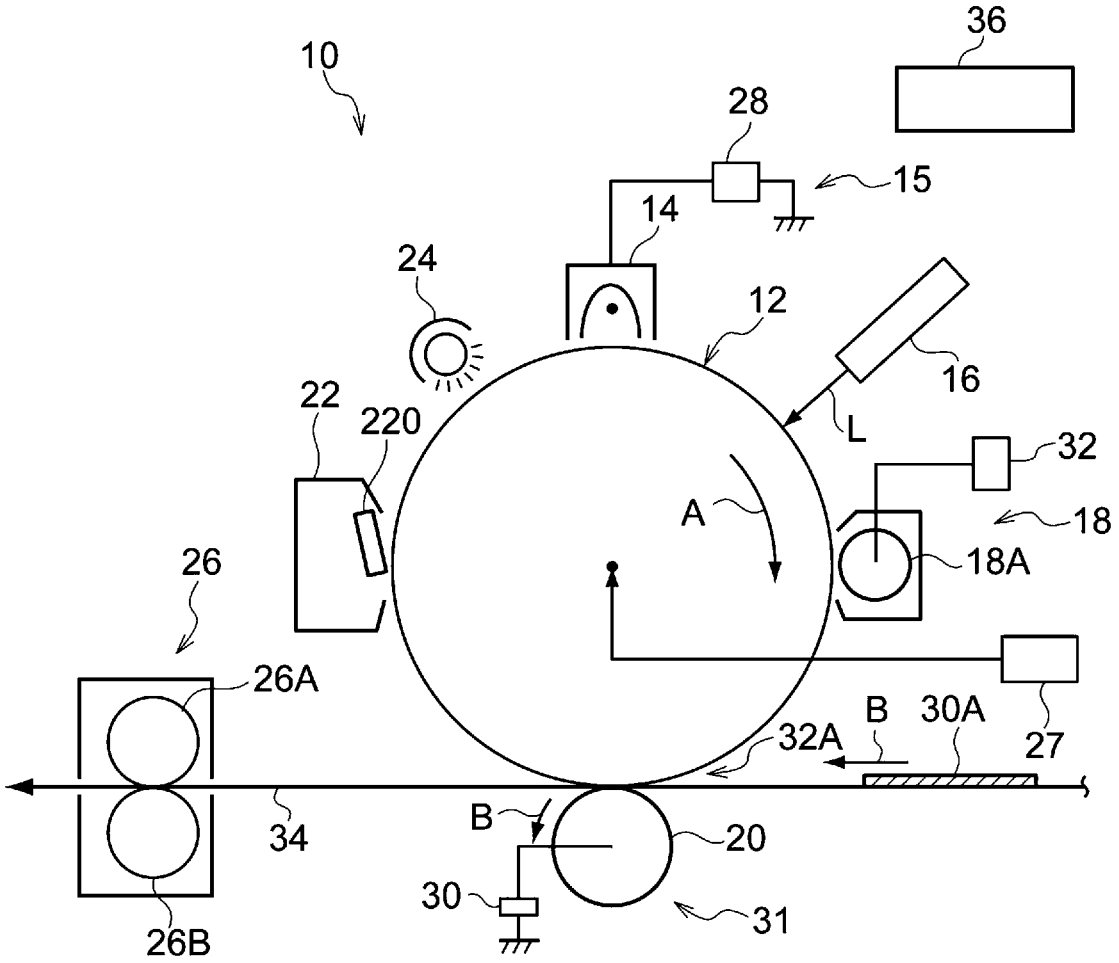
FIG. 1 is a schematic diagram illustrating one example of an image forming apparatus according to an exemplary embodiment.

An exemplary embodiment, which is one example of the present invention, will now be described in detail.

Image Forming Apparatus

An image forming apparatus according to an exemplary embodiment includes an electrophotographic photoreceptor (hereinafter, may be simply referred to as a "photoreceptor"), a charging unit that charges a surface of the photoreceptor, an electrostatic image-forming unit that forms an electrostatic image on the charged surface of the photoreceptor, a developing unit that includes an electrostatic image developer having a toner and develops the electrostatic image on the surface of the photoreceptor by using the electrostatic image developer so as to form a toner image, a transfer unit that transfers the toner image on the surface of the photoreceptor onto a surface of a recording medium; and a cleaning unit that cleans the surface of the photoreceptor.

The photoreceptor includes a conductive substrate, and a photosensitive layer and a surface protection layer disposed on the conductive substrate in that order. The cleaning unit cleans the surface of the photoreceptor by a cleaning blade contacting the surface.

The toner (specific toner) contains toner particles that contain an amorphous polyester resin as a binder resin. When the weight-average molecular weight and the number-average molecular weight of the tetrahydrofuran-soluble component (hereinafter, may be referred to as the "THF-soluble component") in the toner particles measured by gel permeation chromatography (GPC) are respectively assumed to be Mw and Mn, Mw is 25,000 or more and 60,000 or less, and Mw/Mn is 5 or more and 10 or less. The ratio of the absorbance for a wavelength of 1500 $cm^{-1}$ to the absorbance for a wavelength of 720 $cm^{-1}$ in an infrared absorption spectrum analysis of the toner particles is 0.6 or less, and the ratio of the absorbance for a wavelength of 820 $cm^{-1}$ to the absorbance for a wavelength of 720 $cm^{-1}$ is 0.4 or less.

According to an electrophotographic image forming apparatus, an electrostatic image formed on a surface of a photoreceptor is developed with a developer containing toner so as to form a toner image, the toner image is transferred from the photoreceptor to a surface of a recording medium, and then the toner image is fixed to form an image on the recording medium. After the toner image is transferred, the surface of the photoreceptor is cleaned with a cleaning unit to remove the toner and other substances that remained un-transferred. The cleaning unit cleans the surface of the photoreceptor by a cleaning blade contacting the surface.

According to the specific toner, the ratio of the absorbance for a wavelength of 1500 $cm^{-1}$ to the absorbance for a wavelength of 720 $cm^{-1}$ in an infrared absorption spectrum analysis of the toner particles is 0.6 or less, and the ratio of the absorbance for a wavelength of 820 $cm^{-1}$ to the absorbance for a wavelength of 720 $cm^{-1}$ is 0.4 or less. What is meant by the toner particles having such infrared absorption spectral characteristics is that the amorphous polyester resin serving as a binder resin is a resin that use, as a polyhydric alcohol, no or very little, if any, alkylene oxide adduct of bisphenol A (for example, an ethylene oxide adduct of bisphenol A, a propylene oxide adduct of bisphenol A, or an ethylene oxide propylene oxide adduct of bisphenol A).

In order to improve the fixability of the fixed image by using this specific toner, when the weight average molecular weight and the number average molecular weight of the tetrahydrofuran-soluble component in the toner particles measured by gel permeation chromatography are respectively assumed to be Mw and Mn, Mw may be 25,000 or more and 60,000 or less, and Mw/Mn may be 5 or more and 10 or less. In other words, the molecular weight properties of the mainly-non-crosslinking binder resin component may be as described above.

Specifically, when Mw is less than 25,000, hot off-set (excessive of fusion of the toner attaching to the fixing member) easily occurs during fixing; and when Mw exceeds 60,000, the lowest fixing temperature tends to be high. When Mw/Mn exceeds 10, the fusibility of the resin varies, and nonuniformity tends to occur in the fixed image. From the viewpoint of manufacturing, it is difficult to set Mw/Mn to less than 5.

As described above, when the molecular weight properties of the specific toner (toner particles thereof) are as described above, the fixability of the image is improved.

However, when a cleaning unit that allows a cleaning blade to contact the surface of the photoreceptor is employed as the cleaning unit and when the specific toner is used, a phenomenon (filming) occurs in which the toner particles to be cleaned become squashed, spread, and attached to the photoreceptor surface. The reason behind this is presumably as follows.

The specific toner is derived from the aforementioned amorphous polyester resin and has a high hygroscopic property. Thus, moisture absorbed toner particles become plastic and easily deformable, and, in a high-temperature, high-humidity environment in particular (for example, in a 28° C., 85% RH environment), the deformability is particularly prominent. As a result, the toner particles become squashed at the position where the cleaning blade contacts the photoreceptor, spread, and attached to the photoreceptor surface in some cases.

Thus, the image forming apparatus of the exemplary embodiment includes a photoreceptor that includes a conductive substrate, and a photosensitive layer and a surface protection layer disposed on the conductive substrate in that order.

The cleaning blade contacts the surface of the rotating photoreceptor, and while friction is generated between the cleaning blade and the photoreceptor, the residual toner and the like on the surface of the photoreceptor are scraped off to clean the surface. Since friction is generated between the cleaning blade and the photoreceptor, the cleaning blade contacts the photoreceptor while slightly vibrating in the rotation direction of the photoreceptor. Thus, as the frictional force increases between the two, larger vibrations are generated, the contact posture of the cleaning blade with respect to the photoreceptor becomes instable, and the cleaning performance may be degraded.

However, when a photoreceptor that includes a surface protection layer is provided, the contact posture of the cleaning blade with respect to the photoreceptor surface is stabilized, and excessive increase in vibrations of the cleaning blade is suppressed. As a result, the cleaning performance is enhanced, the specific toner, which is easily deformable by moisture absorption, can be satisfactorily cleaned, and thus occurrence of filming is suppressed.

As described above, in this exemplary embodiment, filming, that is, attachment of un-transferred residual toner particles squashed and spread onto the photoreceptor surface, is suppressed.

The structure of the image forming apparatus according to the exemplary embodiment will now be described in detail.

The image forming apparatus according to an exemplary embodiment includes a photoreceptor that includes a conductive substrate, and a photosensitive layer and a surface protection layer disposed on the conductive substrate in that order; a charging unit that charges a surface of the photoreceptor; an electrostatic image-forming unit that forms an electrostatic image on the charged surface of the photoreceptor; a developing unit that houses an electrostatic image developer having a specific toner and develops the electrostatic image on the surface of the photoreceptor by using the electrostatic image developer so as to form a toner image; a transfer unit that transfers the toner image on the surface of the photoreceptor onto a surface of a recording medium; and a cleaning unit that cleans the surface of the photoreceptor by a cleaning blade contacting the surface.

The image forming apparatus of the exemplary embodiment is applied to a known image forming apparatus such as a direct-transfer-type apparatus in which a toner image formed on a surface of a photoreceptor is directly transferred onto a recording medium; an intermediate-transfer-type apparatus in which a toner image on a surface of a photoreceptor is first transferred onto a surface of an intermediate transfer body and then the toner image on the surface of the intermediate transfer body is transferred onto a surface of a recording medium; or an image forming apparatus equipped with a charge erasing device that erases charges by applying charge-erasing light onto a surface of a photoreceptor after transfer of a toner image and before charging.

In the intermediate-transfer-type apparatus, the transfer device includes, for example, an intermediate transfer body having a surface onto which a toner image is to be transferred, a first transfer device that conducts first transfer of the toner image on the surface of the photoreceptor onto the surface of the intermediate transfer body, and a second transfer device that conducts second transfer of the toner image on the surface of the intermediate transfer body onto a surface of a recording medium.

In the image forming apparatus of the exemplary embodiment, for example, a section that includes at least the photoreceptor may be configured as a cartridge structure (process cartridge) detachably attachable to the image forming apparatus.

Although some examples of the image forming apparatus of the exemplary embodiment are described below, these examples are not limiting. Only relevant sections illustrated in the drawings are described, and descriptions of other sections are omitted.

FIG. 1 is a schematic diagram illustrating one example of an image forming apparatus according to the exemplary embodiment.

An image forming apparatus 10 of the exemplary embodiment is equipped with a photoreceptor 12, for example, as illustrated in FIG. 1. The photoreceptor 12 has a columnar shape, is connected to a drive unit 27, such as a motor, via a drive force propagating member (not illustrated), such as a gear, and is driven by the drive unit 27 and rotated the axis of rotation indicated by a dot. In the example illustrated in FIG. 1, the photoreceptor 12 is driven and rotated in the arrow A direction.

In the vicinity of the photoreceptor 12, for example, a charging device 15 (an example of the charging unit), an electrostatic image-forming device 16 (an example of the electrostatic image-forming unit), a developing device 18 (an example of the developing unit), a transfer device 31 (an example of the transfer unit), a cleaning device 22 (an example of the cleaning unit), and a charge erasing device 24 are arranged in this order along the direction in which the photoreceptor 12 rotates. The image forming apparatus 10 is also equipped with a fixing device 26 that includes a fixing member 26A and a pressurizing member 26B disposed to contact the fixing member 26A. The image forming apparatus 10 is also equipped with a control device 36 that controls operations of the devices (units). The unit that includes the photoreceptor 12, the charging device 15, the electrostatic image-forming device 16, the developing device 18, the transfer device 31, and the cleaning device 22 corresponds to the image forming unit.

In the image forming apparatus 10, at least the photoreceptor 12 may be provided as a process cartridge combined with another device or other devices.

The individual devices (units) of the image forming apparatus 10 will now be described in detail.

Electrophotographic Photoreceptor

The photoreceptor of the image forming apparatus of the exemplary embodiment includes a photosensitive layer and a surface protection layer disposed on a conductive substrate in that order. The photosensitive layer may be a single-layer-type photosensitive layer in which a charge generating material and a charge transporting material are contained in the same photosensitive layer so as to unify the functions or may be a function-separated, multilayer-type photosensitive layer that includes a charge generating layer and a charge transporting layer. When the photosensitive layer is a multilayer-type photosensitive layer, the order in which the charge generating layer and the charge transporting layer are arranged is not particularly limited; however, the photoreceptor may have a structure in which a charge generating layer, a charge transporting layer, and a surface protection layer are disposed on a conductive substrate in that order. Moreover, the photoreceptor may include layers other than these layers.

Figure 2:
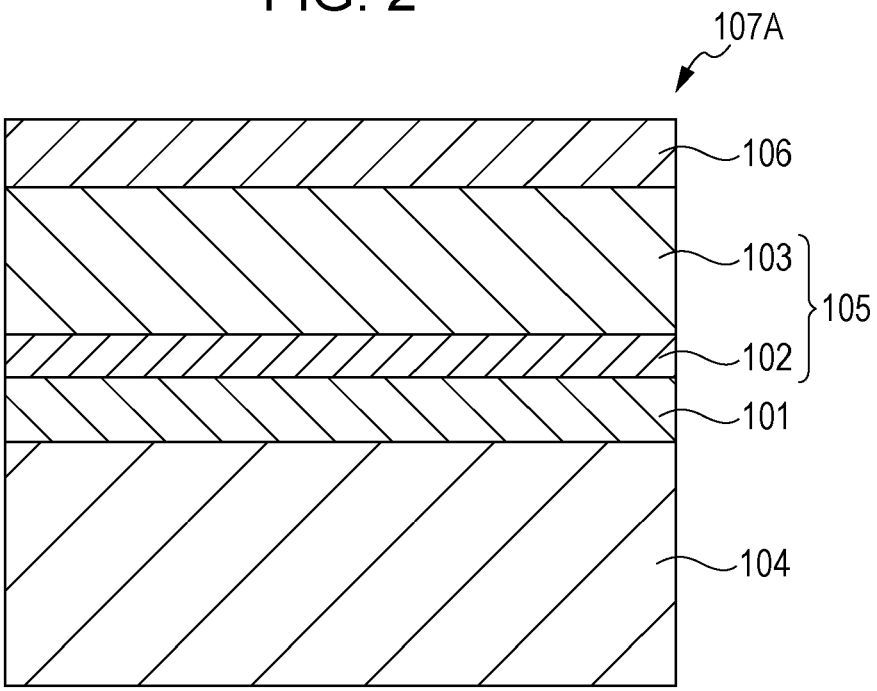
FIG. 2 is a schematic cross-sectional view illustrating an example of a layer structure of an electrophotographic photoreceptor of the image forming apparatus of the exemplary embodiment.

FIG. 2 is a schematic cross-sectional view illustrating an example of a layer structure of the photoreceptor of the image forming apparatus of the exemplary embodiment. A photoreceptor 107A has a structure in which an undercoat layer 101 is formed on a conductive substrate 104, and in which a charge generating layer 102, a charge transporting layer 103, and a surface protection layer 106 are sequentially formed on the undercoat layer 101. In the photoreceptor 107A, a photosensitive layer 105 in which the functions are distributed among the charge generating layer 102 and the charge transporting layer 103 is configured.

Figure 3:
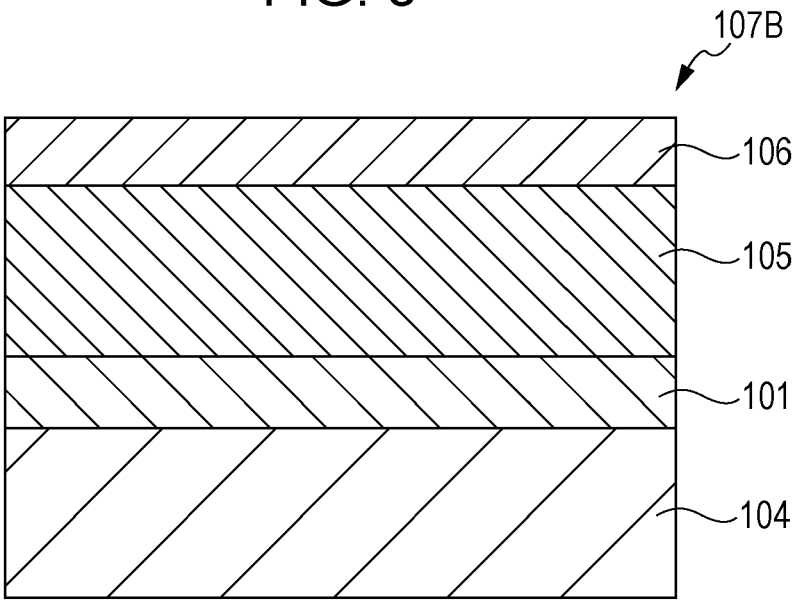
FIG. 3 is a schematic cross-sectional view illustrating another example of the layer structure of the electrophotographic photoreceptor of the image forming apparatus of the exemplary embodiment.

FIG. 3 is a schematic cross-sectional view illustrating another example of a layer structure of the photoreceptor of the image forming apparatus of the exemplary embodiment. A photoreceptor 107B illustrated in FIG. 3 has a structure in which an undercoat layer 101 is formed on a conductive substrate 104, and in which a photosensitive layer 105 and a surface protection layer 106 are sequentially stacked on the undercoat layer 101. In the photoreceptor 107B, a single-layer-type photosensitive layer in which a charge generating material and a charge transporting material are contained in the same photosensitive layer 105 so as to unify the functions is configured.

In the photoreceptor of this exemplary embodiment, the undercoat layer 101 is optional.

The photoreceptor of the exemplary embodiment will now be described in detail with reference numerals omitted from the description.

Conductive Substrate

Examples of the conductive substrate include metal plates, metal drums, and metal belts that contain metals (aluminum, copper, zinc, chromium, nickel, molybdenum, vanadium, indium, gold, platinum, etc.) or alloys (stainless steel etc.). Other examples of the conductive substrate include paper sheets, resin films, and belts coated, vapor-deposited, or laminated with conductive compounds (for example, conductive polymers and indium oxide), metals (for example, aluminum, palladium, and gold), or alloys. Here, "conductive" means having a volume resistivity of less than $10^{13}$ Ωcm.

The surface of the conductive substrate may be roughened to a center-line average roughness Ra of 0.04 μm or more and 0.5 μm or less in order to suppress interference fringes that occur when the electrophotographic photoreceptor used in a laser printer is irradiated with a laser beam. When incoherent light is used as a light source, there is no need to roughen the surface to prevent interference fringes, but roughening the surface suppresses generation of defects due to irregularities on the surface of the conductive substrate and thus is desirable for extending the service life.

Examples of the surface roughening method include a wet honing method with which an abrasive suspended in water is sprayed onto a support, a centerless grinding with which the conductive substrate is pressed against a rotating grinding stone to perform continuous grinding, and an anodization treatment.

Another example of the surface roughening method does not involve roughening the surface of the conductive substrate but involves dispersing a conductive or semi-conductive powder in a resin and forming a layer of the resin on a surface of the conductive substrate so as to create a rough surface by the particles dispersed in the layer.

The surface roughening treatment by anodization involves forming an oxide film on the surface of the conductive substrate by anodization by using a metal (for example, aluminum) conductive substrate as the anode in an electrolyte solution. Examples of the electrolyte solution include a sulfuric acid solution and an oxalic acid solution. However, a porous anodization film formed by anodization is chemically active as is, is prone to contamination, and has resistivity that significantly varies depending on the environment. Thus, a pore-sealing treatment may be performed on the porous anodization film so as to seal fine pores in the oxide film by volume expansion caused by hydrating reaction in pressurized steam or boiling water (a metal salt such as a nickel salt may be added) so that the oxide is converted into a more stable hydrous oxide.

The thickness of the anodization film may be, for example, 0.3 μm or more and 15 μm or less. When the thickness is within this range, a barrier property against injection tends to be exhibited, and the increase in residual potential caused by repeated use tends to be suppressed.

The conductive substrate may be subjected to a treatment with an acidic treatment solution or a Boehmite treatment.

The treatment with an acidic treatment solution is, for example, conducted as follows. First, an acidic treatment solution containing phosphoric acid, chromic acid, and hydrofluoric acid is prepared. The blend ratios of phosphoric acid, chromic acid, and hydrofluoric acid in the acidic treatment solution may be, for example, in the range of 10 mass % or more and 11 mass % or less for phosphoric acid, in the range of 3 mass % or more and 5 mass % or less for chromic acid, and in the range of 0.5 mass % or more and 2 mass % or less for hydrofluoric acid; and the total concentration of these acids may be in the range of 13.5 mass % or more and 18 mass % or less. The treatment temperature may be, for example, 42° C. or higher and 48° C. or lower. The thickness of the film may be, for example, 0.3 μm or more and 15 μm or less.

The Boehmite treatment is conducted by immersing the conductive substrate in pure water at 90° C. or higher and 100° C. or lower for 5 to 60 minutes or by bringing the conductive substrate into contact with pressurized steam at 90° C. or higher and 120° C. or lower for 5 to 60 minutes. The thickness of the film may be 0.1 μm or more and 5 μm or less. The Boehmite-treated body may be further anodized by using an electrolyte solution, such as adipic acid, boric acid, a borate salt, a phosphate salt, a phthalate salt, a maleate salt, a benzoate salt, a tartrate salt, or a citrate salt, that has low film-dissolving power.

Undercoat Layer

The undercoat layer is, for example, a layer that contains inorganic particles and a binder resin.

Examples of the inorganic particles include inorganic particles having a powder resistivity (volume resistivity) of $10^2$ Ωcm or more and $10^{11}$ Ωcm or less.

Among these, metal oxide particles, such as tin oxide particles, titanium oxide particles, zinc oxide particles, or zirconium oxide particles, may be used as the inorganic particles that have the above-described resistivity. In particular, zinc oxide particles may be used.

The specific surface area of the inorganic particles measured by the BET method may be, for example, 10 $m^2/g$ or more.

The volume-average particle diameter of the inorganic particles may be, for example, 50 nm or more and 2000 nm or less (or may be 60 nm or more and 1000 nm or less).

The amount of the inorganic particles contained relative to the binder resin is, for example, 10 mass % or more and 80 mass % or less, or may be 40 mass % or more and 80 mass % or less.

The inorganic particles may be surface-treated. A mixture of two or more inorganic particles subjected to different surface treatments or having different particle diameters may be used.

Examples of the surface treatment agent include a silane coupling agent, a titanate-based coupling agent, an aluminum-based coupling agent, and a surfactant. In particular, a silane coupling agent may be used, and an amino-group-containing silane coupling agent may be used.

Examples of the amino-group-containing silane coupling agent include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

Two or more silane coupling agents may be mixed and used. For example, an amino-group-containing silane coupling agent and another silane coupling agent may be used in combination. Examples of the another silane coupling agent include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

The surface treatment method that uses a surface treatment agent may be any known method, for example, may be a dry method or a wet method.

The treatment amount of the surface treatment agent may be, for example, 0.5 mass % or more and 10 mass % or less relative to the inorganic particles.

Here, the undercoat layer may contain inorganic particles and an electron-accepting compound (acceptor compound) from the viewpoints of long-term stability of electrical properties and carrier blocking properties.

Examples of the electron-accepting compound include electron transporting substances, such as quinone compounds such as chloranil and bromanil; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis (4-naphthyl)-1,3,4-oxadiazole, and 2,5-bis(4-diethylaminophenyl)-1,3,4-oxadiazole; xanthone compounds; thiophene compounds; and diphenoquinone compounds such as 3,3',5,5'-tetra-t-butyldiphenoquinone.

In particular, a compound having an anthraquinone structure may be used as the electron-accepting compound. Examples of the compound having an anthraquinone structure include hydroxyanthraquinone compounds, aminoanthraquinone compounds, and aminohydroxyanthraquinone compounds, and more specific examples thereof include anthraquinone, alizarin, quinizarin, anthrarufin, and purpurin.

The electron-accepting compound may be dispersed in the undercoat layer along with the inorganic particles, or may be attached to the surfaces of the inorganic particles.

Examples of the method for attaching the electron-accepting compound onto the surfaces of the inorganic particles include a dry method and a wet method.

The dry method is, for example, a method with which, while inorganic particles are stirred with a mixer or the like having a large shear force, an electron-accepting compound as is or dissolved in an organic solvent is added dropwise or sprayed along with dry air or nitrogen gas so as to cause the electron-accepting compound to attach to the surfaces of the inorganic particles. When the electron-accepting compound is added dropwise or sprayed, the temperature may be equal to or lower than the boiling point of the solvent. After the electron-accepting compound is added dropwise or sprayed, baking may be further conducted at 100° C. or higher. The temperature and time for baking are not particularly limited as long as the electrophotographic properties are obtained.

The wet method is, for example, a method with which, while inorganic particles are dispersed in a solvent by stirring, ultrasonically, or by using a sand mill, an attritor, or a ball mill, the electron-accepting compound is added, followed by stirring or dispersing, and then the solvent is removed to cause the electron-accepting compound to attach to the surfaces of the inorganic particles. The solvent is removed by, for example, filtration or distillation. After removing the solvent, baking may be further conducted at 100° C. or higher. The temperature and time for baking are not particularly limited as long as the electrophotographic properties are obtained. In the wet method, the moisture contained in the inorganic particles may be removed before adding the electron-accepting compound. For example, the moisture may be removed by stirring and heating the inorganic particles in a solvent or by boiling together with the solvent.

Attaching the electron-accepting compound may be conducted before, after, or simultaneously with the surface treatment of the inorganic particles by a surface treatment agent.

The amount of the electron-accepting compound contained relative to the inorganic particles may be, for example, 0.01 mass % or more and 20 mass % or less, or may be 0.01 mass % or more and 10 mass % or less.

Examples of the binder resin used in the undercoat layer include known materials such as known polymer compounds such as acetal resins (for example, polyvinyl butyral), polyvinyl alcohol resins, polyvinyl acetal resins, casein resins, polyamide resins, cellulose resins, gelatin, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, urethane resins, alkyd resins, and epoxy resins; zirconium chelate compounds; titanium chelate compounds; aluminum chelate compounds; titanium alkoxide compounds; organic titanium compounds; and silane coupling agents.

Other examples of the binder resin used in the undercoat layer include charge transporting resins that have charge transporting groups, and conductive resins (for example, polyaniline).

Among these, a resin that is insoluble in the coating solvent in the overlying layer is suitable as the binder resin used in the undercoat layer. Examples of the particularly suitable resin include thermosetting resins such as a urea resin, a phenolic resin, a phenol-formaldehyde resin, a melamine resin, a urethane resin, an unsaturated polyester resin, an alkyd resin, and an epoxy resin; and a resin obtained by a reaction between a curing agent and at least one resin selected from the group consisting of a polyamide resin, a polyester resin, a polyether resin, a methacrylic resin, an acrylic resin, a polyvinyl alcohol resin, and a polyvinyl acetal resin.

When two or more of these binder resins are used in combination, the mixing ratios are set as necessary.

The undercoat layer may contain various additives to improve electrical properties, environmental stability, and image quality.

Examples of the additives include known materials such as electron transporting pigments based on polycyclic condensed materials and azo materials, zirconium chelate compounds, titanium chelate compounds, aluminum chelate compounds, titanium alkoxide compounds, organic titanium compounds, and silane coupling agents. The silane coupling agent is used to surface-treat the inorganic particles as mentioned above, but may be further added as an additive to the undercoat layer.

Examples of the silane coupling agent used as an additive include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

Examples of the zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetra-n-butyl titanate, butyl titanate dimer, tetra(2-ethylhexyl) titanate, titanium acetylacetonate, polytitanium acetylacetonate, titanium octylene glycolate, titanium lactate ammonium salt, titanium lactate, titanium lactate ethyl ester, titanium triethanol aminate, and polyhydroxy titanium stearate.

Examples of the aluminum chelate compounds include aluminum isopropylate, monobutoxyaluminum diisopropylate, aluminum butylate, diethylacetoacetate aluminum diisopropylate, and aluminum tris(ethylacetoacetate).

These additives may be used alone, or two or more compounds may be used as a mixture or a polycondensation product.

The undercoat layer may have a Vickers hardness of 35 or more.

The surface roughness (ten-point average roughness) of the undercoat layer may be adjusted to be in the range of 1/(4n) (n represents the refractive index of the overlying layer) to ½ of λ where λ represents the laser wavelength used for exposure, in order to suppress moire images.

In order to adjust the surface roughness, resin particles and the like may be added to the undercoat layer. Examples of the resin particles include silicone resin particles and crosslinking polymethyl methacrylate resin particles. In order to adjust the surface roughness, the surface of the undercoat layer may be polished. Examples of the polishing method included buff polishing, sand blasting, wet honing, and grinding.

The undercoat layer may be formed by any known method. For example, a coating film is formed by using an undercoat-layer-forming solution prepared by adding the above-mentioned components to a solvent, dried, and, if needed, heated.

Examples of the solvent used for preparing the undercoat-layer-forming solution include known organic solvents, such as alcohol solvents, aromatic hydrocarbon solvents, halogenated hydrocarbon solvents, ketone solvents, ketone alcohol solvents, ether solvents, and ester solvents.

Specific examples of the solvent include common organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of the method for dispersing inorganic particles in preparing the undercoat-layer-forming solution include known methods that use a roll mill, a ball mill, a vibrating ball mill, an attritor, a sand mill, a colloid mill, and a paint shaker.

Examples of the method for applying the undercoat-layer-forming solution to the conductive substrate include common methods such as a blade coating method, a wire bar coating method, a spray coating method, a dip coating method, a bead coating method, an air knife coating method, and a curtain coating method.

The thickness of the undercoat layer is set within the range of, for example, 15 μm or more, and may be set within the range of 20 μm or more and 50 μm or less. Intermediate layer Although not illustrated in the drawings, an intermediate layer may be further provided between the undercoat layer and the photosensitive layer.

The intermediate layer is, for example, a layer that contains a resin. Examples of the resin used in the intermediate layer include polymer compounds such as acetal resins (for example, polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer that contains an organic metal compound. Examples of the organic metal compound used in the intermediate layer include organic metal compounds that contain metal atoms, such as zirconium, titanium, aluminum, manganese, silicon, etc.

These compounds used in the intermediate layer may be used alone, or two or more of these compounds may be used as a mixture or as a polycondensation product.

In particular, the intermediate layer may be a layer that contains an organic metal compound that contains zirconium atoms or silicon atoms.

The intermediate layer may be formed by any known method. For example, a coating film is formed by using an intermediate-layer-forming solution prepared by adding the above-mentioned components to a solvent, dried, and, if needed, heated.

Examples of the application method used for forming the intermediate layer include common methods such as a dip coating method, a lift coating method, a wire bar coating method, a spray coating method, a blade coating method, a knife coating method, and a curtain coating method.

The thickness of the intermediate layer may be set within the range of, for example, 0.1 μm or more and 3 μm or less. The intermediate layer may be used as the undercoat layer.

Charge Generating Layer

The charge generating layer is, for example, a layer that contains a charge generating material and a binder resin. The charge generating layer may be a layer formed by vapor-depositing a charge generating material. The layer formed by vapor-depositing the charge generating material is suitable when an incoherent light source, such as a light-emitting diode (LED) or an organic electro-luminescence (EL) image array, is used.

Examples of the charge generating material include azo pigments such as bisazo and trisazo pigments; fused-ring aromatic pigments such as dibromoanthanthrone; perylene pigments; pyrrolopyrrole pigments; phthalocyanine pigments; zinc oxide; and trigonal selenium.

Among these, in order to be compatible to the infrared laser exposure, a metal phthalocyanine pigment or a metal-free phthalocyanine pigment may be used as the charge generating material. Specific examples thereof include hydroxygallium phthalocyanine disclosed in Japanese Laid Open Patent Application Publication Nos. 5-263007 and 5-279591 etc.; chlorogallium phthalocyanine disclosed in Japanese Laid Open Patent Application Publication No. 5-98181 etc.; dichlorotin phthalocyanine disclosed in Japanese Laid Open Patent Application Publication Nos. 5-140472 and 5-140473 etc.; and titanyl phthalocyanine disclosed in Japanese Laid Open Patent Application Publication No. 4-189873 etc.

In order to be compatible to the near ultraviolet laser exposure, the charge generating material may be a fused-ring aromatic pigment such as dibromoanthanthrone, a thioindigo pigment, a porphyrazine compound, zinc oxide, trigonal selenium, a bisazo pigment disclosed in Japanese Laid Open Patent Application Publication Nos. 2004-78147 and 2005-181992, or the like.

When an incoherent light source, such as an LED or an organic EL image array having an emission center wavelength in the range of 450 nm or more and 780 nm or less, is used, the charge generating material described above may be used; however, from the viewpoint of the resolution, when the photosensitive layer is as thin as 20 μm or less, the electric field intensity in the photosensitive layer is increased, charges injected from the substrate are decreased, and image defects known as black spots tend to occur. This is particularly noticeable when a charge generating material, such as trigonal selenium or a phthalocyanine pigment, that is of a p-conductivity type and easily generates dark current is used.

In contrast, when an n-type semiconductor, such as a fused-ring aromatic pigment, a perylene pigment, or an azo pigment, is used as the charge generating material, dark current rarely occurs and, even when the thickness is small, image defects known as black spots can be suppressed. Examples of the n-type charge generating material include, but are not limited to, compounds (CG-1) to (CG-27) described in paragraphs [0288] to [0291] in Japanese Laid Open Patent Application Publication No. 2012-155282.

Whether n-type or not is determined by a time-of-flight method commonly employed, on the basis of the polarity of the photocurrent flowing therein. A material in which electrons flow more smoothly as carriers than holes is determined to be of an n-type.

The binder resin used in the charge generating layer is selected from a wide range of insulating resins. Alternatively, the binder resin may be selected from organic photoconductive polymers, such as poly-N-vinylcarbazole, polyvinyl anthracene, polyvinyl pyrene, and polysilane.

Examples of the binder resin include, polyvinyl butyral resins, polyarylate resins (polycondensates of bisphenols and aromatic dicarboxylic acids etc.), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. Here, "insulating" means having a volume resistivity of $10^{13}$ Ωcm or more.

These binder resins are used alone or in combination as a mixture.

The blend ratio of the charge generating material to the binder resin may be in the range of 10:1 to 1:10 on a mass ratio basis.

The charge generating layer may contain other known additives.

The charge generating layer may be formed by any known method. For example, a coating film is formed by using a charge-generating-layer-forming solution prepared by adding the above-mentioned components to a solvent, dried, and, if needed, heated. The charge generating layer may be formed by vapor-depositing a charge generating material. The charge generating layer may be formed by vapor deposition especially when a fused-ring aromatic pigment or a perylene pigment is used as the charge generating material.

Specific examples of the solvent for preparing the charge-generating-layer-forming solution include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents are used alone or in combination as a mixture.

The method for dispersing particles (for example, the charge generating material) in the charge-generating-layer-forming solution can use a media disperser such as a ball mill, a vibrating ball mill, an attritor, a sand mill, or a horizontal sand mill, or a media-less disperser such as stirrer, an ultrasonic disperser, a roll mill, or a high-pressure homogenizer. Examples of the high-pressure homogenizer include a collision-type homogenizer in which the dispersion in a high-pressure state is dispersed through liquid-liquid collision or liquid-wall collision, and a penetration-type homogenizer in which the fluid in a high-pressure state is caused to penetrate through fine channels.

In dispersing, it is effective to set the average particle diameter of the charge generating material in the charge-generating-layer-forming solution to 0.5 μm or less, 0.3 μm or less, or 0.15 μm or less.

Examples of the method for applying the charge-generating-layer-forming solution to the undercoat layer (or the intermediate layer) include common methods such as a blade coating method, a wire bar coating method, a spray coating method, a dip coating method, a bead coating method, an air knife coating method, and a curtain coating method.

The thickness of the charge generating layer is set within the range of, for example, 0.1 μm or more and 5.0 μm or less, or with in the range of 0.2 μm or more and 2.0 μm or less.

Charge Transporting Layer

The charge transporting layer is, for example, a layer that contains a charge transporting material and a binder resin. The charge transporting layer may be a layer that contains a polymer charge transporting material.

Examples of the charge transporting material include electron transporting compounds such as quinone compounds such as p-benzoquinone, chloranil, bromanil, and anthraquinone; tetracyanoquinodimethane compounds; fluorenone compounds such as 2,4,7-trinitrofluorenone; xanthone compounds; benzophenone compounds; cyanovinyl compounds; and ethylene compounds. Other examples of the charge transporting material include hole transporting compounds such as triarylamine compounds, benzidine compounds, aryl alkane compounds, aryl-substituted ethylene compounds, stilbene compounds, anthracene compounds, and hydrazone compounds. These charge transporting materials may be used alone or in combination, but are not limiting.

From the viewpoint of charge mobility, the charge transporting material may be a triaryl amine derivative represented by structural formula (a-1) below or a benzidine derivative represented by structural formula (a-2) below.

(a-1)

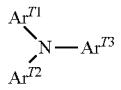

In structural formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$ or $—C_6H_4—CH=CH—CH=C(R^{T7})(R^{T8})$. $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Examples of the substituent for each of the groups described above include a halogen atom, an alkyl group having 1 to 5 carbon atoms, and an alkoxy group having 1 to 5 carbon atoms. Other examples of the substituent for each of the groups described above include substituted amino groups each substituted with an alkyl group having 1 to 3 carbon atoms.

(a-2)

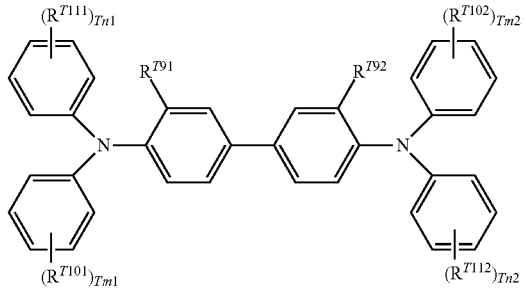

In structural formula (a-2), $R^{T91}$ and $R^{T92}$ each independently represent a hydrogen atom, a halogen atom, an alkyl group having 1 to 5 carbon atoms, or an alkoxy group having 1 to 5 carbon atoms. $R^{T11}$, $R^{T12}$, $R^{T111}$, and $R^{T112}$ each independently represent a halogen atom, an alkyl group having 1 to 5 carbon atoms, an alkoxy group having 1 to 5 carbon atoms, an amino group substituted with an alkyl group having 1 or 2 carbon atoms, a substituted or unsubstituted aryl group, $—C(R^{T12})=C(R^{T13})(R^{T14})$, or $—CH=CH—CH=C(R^{T15})(R^{T16})$; and $R^{T12}$, $R^{T13}$, $R^{T14}$, $R^{T15}$, and $R^{T16}$ each independently represent a hydrogen atom, a substituted or unsubstituted alkyl group, or a substituted or unsubstituted aryl group. Tm1, Tm2, Tn1, and Tn2 each independently represent an integer of 0 or more and 2 or less.

Examples of the substituent for each of the groups described above include a halogen atom, an alkyl group having 1 to 5 carbon atoms, and an alkoxy group having 1 to 5 carbon atoms. Other examples of the substituent for each of the groups described above include substituted amino groups each substituted with an alkyl group having 1 to 3 carbon atoms.

Here, among the triarylamine derivatives represented by structural formula (a-1) and the benzidine derivatives represented by structural formula (a-2), a triarylamine derivative having $—C_6H_4—CH=CH—CH=C(R^{T7})(R^{T8})$ or a benzidine derivative having $—CH=CH—CH=C(R^{T15})(R^{T16})$ may be used from the viewpoint of the charge mobility.

Examples of the polymer charge transporting material that can be used include known charge transporting materials such as poly-N-vinylcarbazole and polysilane. In particular, a polyester polymer charge transporting materials disclosed in Japanese Laid Open Patent Application Publication Nos. 8-176293 and 8-208820 may be used. The polymer charge transporting material may be used alone or in combination with a binder resin.

Examples of the binder resin used in the charge transporting layer include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinylcarbazole, and polysilane. Among these, a polycarbonate resin or a polyarylate resin may be used as the binder resin. These binder resins are used alone or in combination.

The blend ratio of the charge transporting material to the binder resin may be in the range of 10:1 to 1:5 on a mass ratio basis.

The charge transporting layer may contain, in addition to the charge transporting material and the binder resin, inorganic particles, if needed.

When the charge transporting layer (in other words, the outermost layer of the organic photosensitive layer) contains inorganic particles, cracking of the surface protection layer is suppressed. Specifically, when a layer constituting the surface of the organic photosensitive layer contains inorganic particles, the inorganic particles function as a reinforcing material for the organic photosensitive layer; presumably thus, the organic photosensitive layer rarely deforms and cracking of the surface protection layer is suppressed.

Examples of the inorganic particles used in the charge transporting layer include silica particles, alumina particles, titanium oxide particles, potassium titanate, tin oxide particles, zinc oxide particles, zirconium oxide particles, barium sulfate particles, calcium oxide particles, calcium carbonate particles, and magnesium oxide particles.

The inorganic particles may be one type or two or more types.

Among these, silica particles may be used since the dielectric loss factor is high, the electrical properties of the photoreceptor are rarely degraded, and occurrence of cracking in the surface protection layer is suppressed.

Silica particles suitable for the charge transporting layer will now be described in detail.

Examples of the silica particles include dry silica particles and wet silica particles.

Examples of the dry silica particles include pyrogenic silica (fumed silica) prepared by burning a silane compound, and deflagration silica particles prepared by deflagration of metal silicon powder.

Examples of the wet silica particles include wet silica particles obtained by neutralization reaction of sodium silicate and a mineral acid (precipitated silica synthesized and aggregated under alkaline conditions, gel silica particles synthesized and aggregated under acidic conditions, etc.), colloidal silica particles obtained by alkalifying and polymerizing acidic silicate (silica sol particles etc.), and sol-gel silica particles obtained by hydrolysis of an organic silane compound (for example, alkoxysilane).

Among these, pyrogenic silica particles having fewer silanol groups on the surface and a low gap structure may be used as the silica particles from the viewpoints of generation of residual potential, suppression of image defects caused by degradation of electrical properties (suppression of degradation of fine line reproducibility).

The silica particles may be surface-treated with a hydrophobizing agent. As a result, the number of silanol groups on the surfaces of the silica particles is decreased, and occurrence of residual potential is smoothly suppressed.

Examples of the hydrophobizing agent include known silane compounds such as chlorosilane, alkoxysilane, and silazane.

Among these, a silane compound having a trimethylsilyl group, a decylsilyl group, or a phenylsilyl group may be used as the hydrophobizing agent from a viewpoint of smoothly suppressing occurrence of residual potential. In other words, trimethylsilyl groups, decylsilyl groups or phenylsilyl groups may be present on the surfaces of the silica particles.

Examples of the silane compound having trimethylsilyl groups include trimethylchlorosilane, trimethylmethoxysilane, and 1,1,1,3,3,3-hexamethyldisilazane.

Examples of the silane compound having decylsilyl groups include decyltrichlorosilane, decyldimethylchlorosilane, and decyltrimethoxysilane.

Examples of the silane compound having phenylsilyl groups include triphenylmethoxysilane and triphenylchlorosilane.

The condensation ratio of hydrophobized silica particles (the ratio of Si—O—Si in the $SiO^{4-}$ bonds in the silica particles, hereinafter this ratio may be referred to as "condensation ratio of the hydrophobizing agent") is, for example, 90% or more, 91% or more, or 95% or more relative to the silanol groups on the surfaces of the silica particles.

When the condensation ratio of the hydrophobizing agent is within the above-described range, the number of silanol groups on the surfaces of the silica particles is decreased, and occurrence of residual potential is smoothly suppressed.

The condensation ratio of the hydrophobizing agent indicates the ratio of condensed silicon relative to all bondable sites of silicon in the condensed portions detected with nuclear magnetic resonance (NMR), and is measured as follows.

First, silica particles are separated from the layer. Separated silica particles are subjected to Si CP/MAS NMR analysis with AVANCE III 400 produced by Bruker, and the peak areas corresponding to the number of SiO substituents are determined. The values for the disubstituted ($Si(OH)_2(O—Si)_2—$), trisubstituted ($Si(OH)(O—Si)_3—$), and tetrasubstituted ($Si(O—Si)_4—$) are respectively assumed to be Q2, Q3, and Q4, and the condensation ratio of the hydrophobizing agent is calculated from the formula: $(Q2\times2+Q3\times3+Q4\times4)/4\times(Q2+Q3+Q4)$.

The volume resistivity of the silica particles is, for example, $10^{11}$ Ω·cm or more, and may be $10^{12}$ Ω·cm or more or $10^{13}$ Ω·cm or more.

When the volume resistivity of the silica particles is within the above-described range, degradation of the electrical properties is suppressed.

The volume resistivity of the silica particles is measured as follows. The measurement environment involves a temperature of 20° C. and a humidity of 50% RH.

First, silica particles are separated from the layer. Then, the measurement object, i.e., separated silica particles, is placed on a surface of a circular jig equipped with a 20 $cm^2$ electrode plate so that the silica particles form a silica particle layer having a thickness of 1 mm or more and 3 mm or less. Another identical 20 $cm^2$ electrode plate is placed on the silica particle layer so as to sandwich the silica particle layer. In order to eliminate gaps between the silica particles, a load of 4 kg is applied onto the electrode plate on the silica particle layer, and then the thickness (cm) of the silica particle layer is measured. The electrodes above and under the silica particle layer are connected to an electrometer and a high-voltage power generator. A high voltage is applied to the two electrodes so that the electric field reaches a preset value, and the current value (A) that flows at this time is read so as to calculate the volume resistivity (Ω·cm) of the silica particles. The calculation formula of the volume resistivity (Ω·cm) of the silica particles is as follows.

Note that in the formula, ρ represents the volume resistivity (Ω·cm) of the silica particles, E represents the applied voltage (V), I represents the current value (A), I0 represents a current value (A) at an applied voltage of 0 V, and L represents the thickness (cm) of the silica particle layer. For evaluation, the volume resistivity at an applied voltage of 1000 V is used.

$$\rho = E \times 20/(I - I0)/L \quad \text{Formula:}$$

The volume-average particle diameter of the inorganic particles including the silica particles is, for example, 20 nm or more and 200 nm or less, may be 40 nm or more and 150 nm or less, may be 50 nm or more and 120 nm or less, or may be 50 nm or more and 110 nm or less.

When the volume-average particle diameter is within the above-describe range, cracking of the surface protection layer and occurrence of the residual potential are smoothly suppressed.

The volume-average particle diameter of the silica particles is measured as follows. In the description below, the method for measuring the silica particles is described but the same measurement method is employed for other particles also.

The volume-average particle diameter of the silica particles is measured by separating the silica particles from the layer, observing 100 primary particles of these silica particles with a scanning electron microscope (SEM) at a magnification of 40000, measuring the longest axis and the shortest axis of each particle by image analysis of the primary particles, and measuring the sphere-equivalent diameter from the intermediate values. The 50% diameter (D50v) in the cumulative frequency of the obtained sphere-equivalent diameters is determined, and assumed to be the volume-average particle diameter of the silica particles.

The amount of the inorganic particles contained may be determined as appropriate for the type of the inorganic particles. From the viewpoints of smoothly suppressing cracking of the surface protection layer and occurrence of the residual potential, the amount may be, for example, 30 mass % or more, 40 mass % or more, 45 mass % or more, or 50 mass % or more relative to the entire charge transporting layer.

The upper limit of the amount of the inorganic particles contained is not particularly limited. From the viewpoint of obtaining the properties of the charge transporting layer, etc., the amount may be 70 mass % or less, 65 mass % or less, or 60 mass % or less.

The amount of the inorganic particles contained may be larger than the amount of the charge transporting material contained.

The charge transporting layer may contain other known additives.

Properties of Charge Transporting Layer

The surface roughness Ra (arithmetic mean surface roughness Ra) of the charge transporting layer measured at a surface on the side close to the surface protection layer is, for example, 0.06 μm or less, may be 0.03 μm or less, or may be 0.02 μm or less.

When the surface roughness Ra is within the above-described range, the flatness and smoothness of the surface protection layer are enhanced, and the cleaning properties are improved.

In order to adjust the surface roughness Ra to be within the above-described range, for example, the thickness of the layer may be increased.

The surface roughness Ra is measured as follows.

First, after the surface protection layer is removed, the layer to be measured is exposed. Then a portion of that layer is cut with a cutter or the like to obtain a measurement sample.

A stylus-type surface roughness meter (SURFCOM 1400A produced by TOKYO SEIMITSU CO., LTD., for example) is used to measure the measurement sample. The measurement conditions are set according to JIS B 0601-1994 with evaluation length Ln=4 mm, reference length L=0.8 mm, and cut-off value=0.8 mm.

The elastic modulus of the charge transporting layer is, for example, 5 GPa or more, may be 6 GPa or more, or may be 6.5 GPa or more.

When the elastic modulus of the charge transporting layer is within the above-described range, cracking of the surface protection layer is smoothly suppressed.

In order to adjust the elastic modulus of the charge transporting layer to be within the above-described range, for example, the particle diameter and the amount of the silica particles may be adjusted, or the type and the amount of the charge transporting material may be adjusted.

The elastic modulus of the charge transporting layer is measured as follows.

First, after the surface protection layer is removed, the layer to be measured is exposed. Then a portion of that layer is cut with a cutter or the like to obtain a measurement sample.

A depth profile of this measurement sample is obtained by continuous stiffness measurement (CSM) (U.S. Pat. No. 4,848,141) by using Nano Indenter SA2 produced by MTS Systems Corporation, and the average of the values observed at an indentation depth of 30 nm to 100 nm is used for measurement.

The thickness of the charge transporting layer is, for example, 10 μm or more and 40 μm or less, may be 10 μm or more and 35 μm or less, or may be 15 μm or more and 30 μm or less.

When the thickness of the charge transporting layer is within the above-describe range, cracking of the surface protection layer and occurrence of the residual potential are smoothly suppressed.

Formation of Charge Transporting Layer

The charge transporting layer may be formed by any known method. For example, a coating film is formed by using a charge-transporting-layer-forming solution prepared by adding the above-mentioned components to a solvent, dried, and, if needed, heated.

Examples of the solvent used to prepare the charge-transporting-layer-forming solution include common organic solvents such as aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic or linear ethers such as tetrahydrofuran and ethyl ether. These solvents are used alone or in combination as a mixture.

Examples of the method for applying the charge-transporting-layer-forming solution to the charge generating layer include common methods such as a blade coating method, a wire bar coating method, a spray coating method, a dip coating method, a bead coating method, an air knife coating method, and a curtain coating method.

When particles (for example, silica particles or fluororesin particles) are to be dispersed in the charge-transporting-layer-forming solution, a dispersing method that uses, for example, a media disperser such as a ball mill, a vibrating ball mill, an attritor, a sand mill, or a horizontal sand mill, or a media-less disperser such as stirrer, an ultrasonic disperser, a roll mill, or a high-pressure homogenizer is employed. Examples of the high-pressure homogenizer include a collision-type homogenizer in which the dispersion in a high-pressure state is dispersed through liquid-liquid collision or liquid-wall collision, and a penetration-type homogenizer in which the fluid in a high-pressure state is caused to penetrate through fine channels.

After formation of the charge transporting layer and before formation of the surface protection layer, a step of substituting air, which is contained in the organic photosensitive layer formed on the conductive substrate, with a gas having a higher oxygen concentration than the air may be performed as needed.

Surface Protection Layer

The surface protection layer (hereinafter may be simply referred to as the "protection layer") is formed on the photosensitive layer. For example, the protection layer is provided to prevent chemical changes in the photosensitive layer during charging or to further improve the mechanical strength of the photosensitive layer.

Thus, the protection layer may be a layer formed of a cured film (crosslinked film). Examples of such a layer include layers indicated in 1) and 2) below.

1) A layer formed of a cured film of a composition that contains a reactive-group-containing charge transporting material having a reactive group and a charge transporting skeleton in the same molecule (in other words, a layer that contains a polymer or crosslinked body of the reactive-group-containing charge transporting material).

2) A layer formed of a cured film of a composition that contains a non-reactive charge transporting material, and a reactive-group-containing non-charge transporting material that does not have a charge transporting skeleton but has a reactive group (in other words, a layer that contains a polymer or crosslinked body of the non-reactive charge transporting material and the reactive-group-containing non-charge transporting material).

Examples of the reactive group contained in the reactive-group-containing charge transporting material include chain-polymerizable groups, an epoxy group, —OH, —OR (where R represents an alkyl group), $—NH_2$, —SH, —COOH, and $—SiR^{Q1}{}_{3-Qn}(OR^{Q2})_{Qn}$ (where $R^{Q1}$ represents a hydrogen atom, an alkyl group, or a substituted or unsubstituted aryl group, $R^{Q2}$ represents a hydrogen atom, an alkyl group, or a trialkylsilyl group, and Qn represents an integer of 1 to 3).

Examples of the reactive group contained in the reactive-group-containing non-charge transporting material are known reactive groups described above.

The chain-polymerizable group may be any radical-polymerizable functional group, and an example thereof is a functional group having a group that contains at least a carbon-carbon double bond. A specific example thereof is a group that contains at least one selected from a vinyl group, a vinyl ether group, a vinyl thioether group, a styryl group (vinylphenyl group), an acryloyl group, a methacryloyl group, and derivatives of the foregoing. Among these, the chain-polymerizable group may be a group that contains at least one selected from a vinyl group, a styryl group (vinylphenyl group), an acryloyl group, a methacryloyl group, and derivatives of the foregoing, or may be at least one selected from an acryloyl group, a methacryloyl group, and derivatives of the foregoing.

The charge transporting skeleton of the reactive-group-containing charge transporting material may be any known structure used in the electrophotographic photoreceptor, and examples thereof include skeletons that are derived from nitrogen-containing hole transporting compounds, such as triarylamine compounds, benzidine compounds, and hydrazone compounds, and that are conjugated with nitrogen atoms. Among these, a triarylamine skeleton may be used.

The reactive-group-containing charge transporting material that has such a reactive group and a charge transporting skeleton, the non-reactive charge transporting material, and the reactive-group-containing non-charge transporting material may be selected from among known materials.

The protection layer may contain other known additives.

The protection layer may be formed by any known method. For example, a coating film is formed by using a protection-layer-forming solution prepared by adding the above-mentioned components to a solvent, dried, and, if needed, cured such as by heating.

Examples of the solvent used to prepare the protection-layer-forming solution include aromatic solvents such as toluene and xylene, ketone solvents such as methyl ethyl ketone, methyl isobutyl ketone, and cyclohexanone, ester solvents such as ethyl acetate and butyl acetate, ether solvents such as tetrahydrofuran and dioxane, cellosolve solvents such as ethylene glycol monomethyl ether, and alcohol solvents such as isopropyl alcohol and butanol. These solvents are used alone or in combination as a mixture.

The protection-layer-forming solution may be a solvent-free solution.

Examples of the application method used to apply the protection-layer-forming solution onto the photosensitive layer (for example, the charge transporting layer) include common methods such as a dip coating method, a lift coating method, a wire bar coating method, a spray coating method, a blade coating method, a knife coating method, and a curtain coating method.

Cured Product of Composition Containing Compound Having at Least One of Acryloyl Group and Methacryloyl Group The surface protection layer in the photoreceptor of the exemplary embodiment may be formed of a cured product of a composition containing a compound having at least one of an acryloyl group and a methacryloyl group.

In particular, the surface protection layer may be formed of a cured product of a composition that contains a compound that has a charge transporting skeleton and a reactive group (chain polymerizable group) in the same molecule. Specifically, the surface protection layer may be formed of a cured product of a composition that contains a compound (hereinafter referred to as the "specific charge transporting material (a)") having a charge transporting skeleton and an acryloyl group or a methacryloyl group in the same molecule.

In the description below, the cured product (cured film) of a composition containing the specific charge transporting material (a) is described as an example.

Specific Charge Transporting Material (a)

The specific charge transporting material (a) used in the surface protection layer is a compound having a charge transporting skeleton and an acryloyl group or a methacryloyl group in the same molecule, and may be any compound as long as this structural condition is satisfied.

Examples of the charge transporting skeleton in the specific charge transporting material (a) include skeletons derived from nitrogen-containing hole transporting compounds such as triarylamine compounds, benzidine compounds, and hydrazone compounds. The charge transporting skeleton may be a skeleton derived from a triarylamine compound.

In particular, the specific charge transporting material (a) may be a compound having a methacryloyl group.

The reason behind this is not clear but is presumably as follows.

Typically, a compound having a highly reactive acryloyl group is frequently used in curing reactions. When a bulky charge transporting skeleton has a highly reactive acryloyl group as a substituent, nonuniformity tends to occur during curing reactions, and, thus, nonuniformity and wrinkles easily occur in the cured film serving as a surface protection layer. However, presumably, by using the specific charge transporting material (a) having a methacryloyl group having a lower reactivity than the acryloyl group, occurrence of nonuniformity and wrinkles in the cured film serving as a surface protection layer can be smoothly suppressed.

The specific charge transporting material (a) may have a structure in which one or more carbon atoms are interposed between the charge transporting skeleton and the acryloyl or methacryloyl group. In other words, the specific charge transporting material (a) may have a structure in which a carbon chain containing one or more carbon atoms is interposed between the charge transporting skeleton and the acryloyl or methacryloyl group to serve as a linking group. In particular, the linking group may be an alkylene group.

The reason why this structure offers a favorable effect is not clear but is presumably as follows.

Regarding the mechanical strength in the surface protection layer, it is considered that the probability of occurrence of the reaction drops in some cases when the bulky charge transporting skeleton and the polymerization site (acryloyl group or methacryloyl group) are close to each other. This is because the structure becomes rigid and the polymerization sites are not allowed to move freely.

Moreover, the specific charge transporting material (a) may be a compound (a') having a structure in which a triphenylamine skeleton and three or more, preferably, four or more, methacryloyl groups are contained in the same molecule. According to this structure, the stability of the compound can be easily obtained during synthesis. Moreover, according to this structure, a surface protection layer that has a high crosslinking density and a sufficient mechanical strength can be formed, and thus, the thickness of the surface protection layer can be easily increased.

In this exemplary embodiment, the specific charge transporting material (a) may be a compound represented by general formula (A) due to its excellent charge transporting property.

(A)

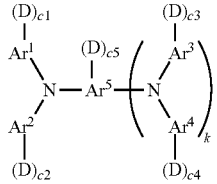

In general formula (A), $Ar^1$ to $Ar^4$ each independently represent a substituted or unsubstituted aryl group, $Ar^5$ represents a substituted or unsubstituted aryl group or a substituted or unsubstituted arylene group, D represents $—(CH_2)_d—(O—CH_2—CH_2)_e—O—CO—C(CH_3)=CH_2$, c1 to c5 each independently represent an integer of 0 or more and 2 or less, k represents 0 or 1, d represents an integer of 0 or more and 5 or less, e represents 0 or 1, and a total number of D is 4 or more.

In general formula (A), $Ar^1$ to $Ar^4$ each independently represent a substituted or unsubstituted aryl group. $Ar^1$ to $Ar^4$ may represent the same group or different groups.

Here, examples of the substituent in the substituted aryl group other than D: $—(CH_2)_d—(O—CH_2—CH_2)_e—O—CO—C(CH_3)=CH_2$ include an alkyl or alkoxy group having 1 to 4 carbon atoms, and a substituted or unsubstituted aryl group having 6 or more and 10 or less carbon atoms.

$Ar^1$ to $Ar^4$ may each represent any one of formulae (1) to (7) below. Note that in formula (1) to (7) below, "$-(D)_C$" is used to comprehensively represent "$-(D)_{C1}$" to "$-(D)_{C4}$" that may respectively be connected to $Ar^1$ to $Ar^4$.

(1)

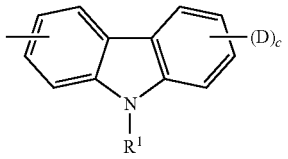

(2)

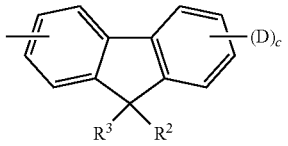

(3)

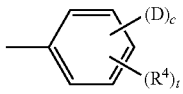

(4)

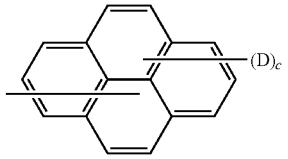

(5)

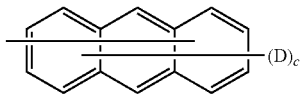

(6)

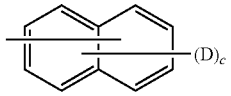

(7)

$—Ar—(Z')_s—Ar—(D)_c$

In formulae (1) to (7) above, $R^1$ represents at least one selected from the group consisting of a hydrogen atom, an alkyl group having 1 or more and 4 or less carbon atoms, a phenyl group substituted with an alkyl group having 1 or more and 4 or less carbon atoms or an alkoxy group having 1 or more and 4 or less carbon atoms, an unsubstituted phenyl group, and an aralkyl group having 7 or more and 10 or less carbon atoms; $R^2$ to $R^4$ each independently represent a hydrogen atom, an alkyl group having 1 or more and 4 or less carbon atoms, an alkoxy group having 1 or more and 4 or less carbon atoms, a phenyl group substituted with an alkoxy group having 1 or more and 4 or less carbon atoms, an unsubstituted phenyl group, an aralkyl group having 7 or more and 10 or less carbon atoms, and a halogen atom; Ar represents a substituted or unsubstituted arylene group; D represents $—(CH_2)_d—(O—CH_2—CH_2)_e—O—CO—C(CH_3)═CH_2$; c represents 1 or 2; s represents 0 or 1; and t represents an integer of 0 or more and 3 or less.

Here, Ar in formula (7) may be the one substituted with structural formula (8) or (9) below:

(8)

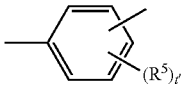

(9)

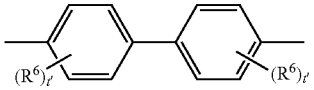

In formulae (8) and (9) above, $R^5$ and $R^6$ each independently represent one selected from the group consisting of a hydrogen atom, an alkyl group having 1 or more and 4 or less carbon atoms, an alkoxy group having 1 or more and 4 or less carbon atoms, a phenyl group substituted with an alkoxy group having 1 or more and 4 or less carbon atoms, an unsubstituted phenyl group, an aralkyl group having 7 or more and 10 or less carbon atoms, and a halogen atom, and t' represents an integer of 0 or more and 3 or less.

In the formula (7) described above, Z' represents a divalent organic linking group, which may be represented by one of formulae (10) to (17) below. In formula (7) above, each s represents 0 or 1.

(10)

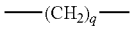

(11)

(12)

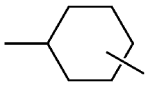

(13)

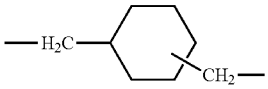

(14)

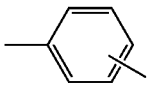

(15)

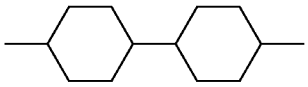

-continued (16)

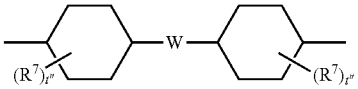

(17)

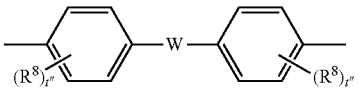

In formulae (10) and (17) above, $R^7$ and $R^8$ each independently represent one selected from the group consisting of a hydrogen atom, an alkyl group having 1 or more and 4 or less carbon atoms, an alkoxy group having 1 or more and 4 or less carbon atoms, a phenyl group substituted with an alkoxy group having 1 or more and 4 or less carbon atoms, an unsubstituted phenyl group, an aralkyl group having 7 or more and 10 or less carbon atoms, and a halogen atom, and W represents a divalent group, q and r each independently represent an integer of 1 or more and 10 or less, and each t" represents an integer of 0 or more and 3 or less.

W in formulae (16) and (17) may be one of divalent groups represented by (18) to (26) below. In formula (25), u represents an integer of 0 or more and 3 or less.

(18)

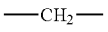

(19)

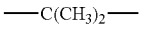

(20)

(21)

(22)

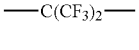

(23)

(24)

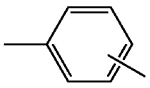

(25)

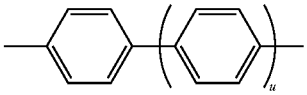

(26)

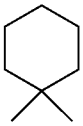

In general formula (A), $Ar^5$ represents a substituted or unsubstituted aryl group when k is 0, and examples of the aryl group include those aryl groups described as examples for $Ar^1$ to $Ar^4$. $Ar^5$ represents a substituted or unsubstituted arylene group when k is 1, and examples of the arylene group include arylene groups obtained from the aryl groups described as examples for $Ar^1$ to $Ar^4$ by removing one hydrogen atom at the position $—N(Ar^3\text{-}(D)_{C3})(Ar^4\text{-}(D)_{C4})$ substitutes.

Specific examples (compounds A-1 to A-21) of the compound represented by general formula (A) are described below. It should be noted that the compound represented by general formula (A) is not limited by these specific examples.

No.
A-1
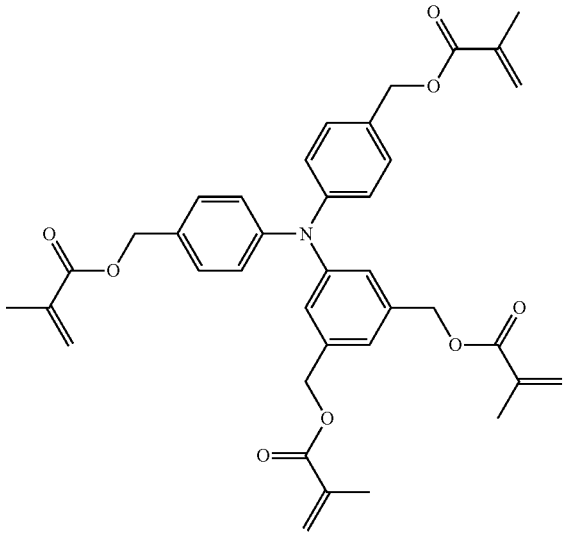
A-2
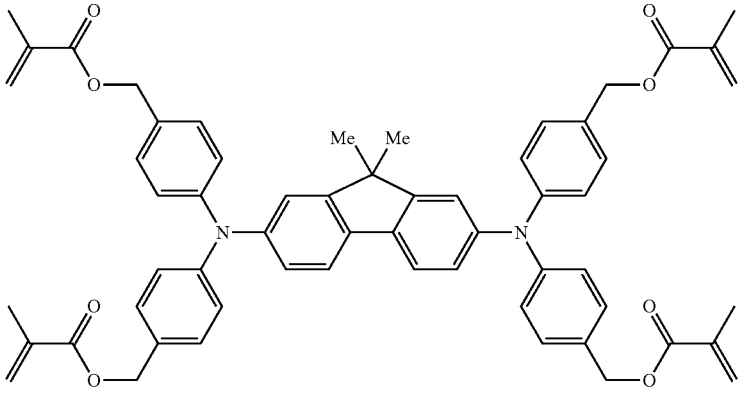
A-3
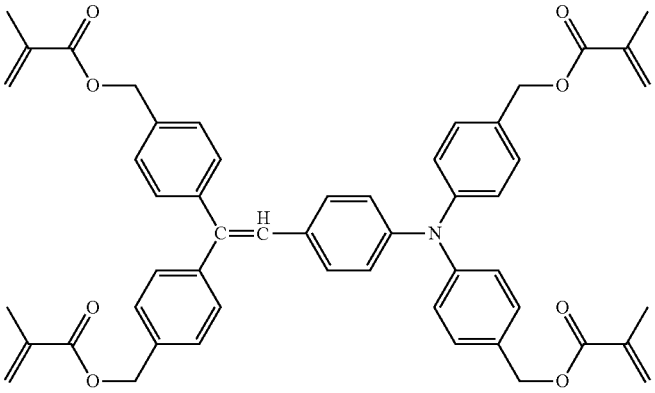

-continued
| No. | |
|---|---|
| A-4 | 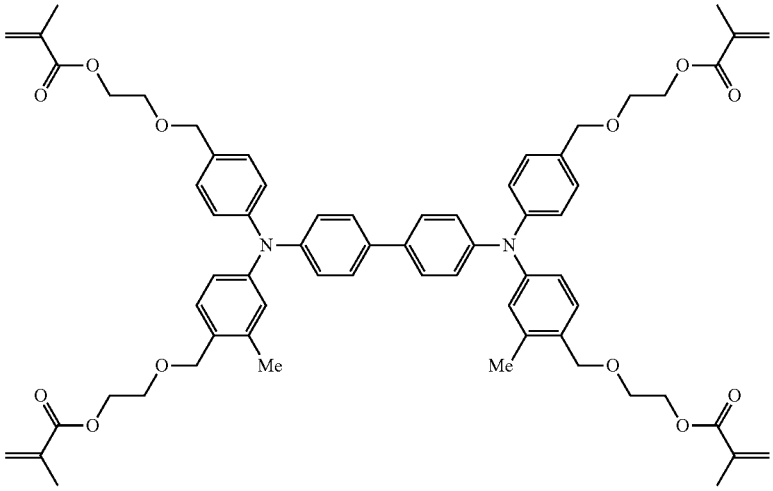 |
| A-5 | 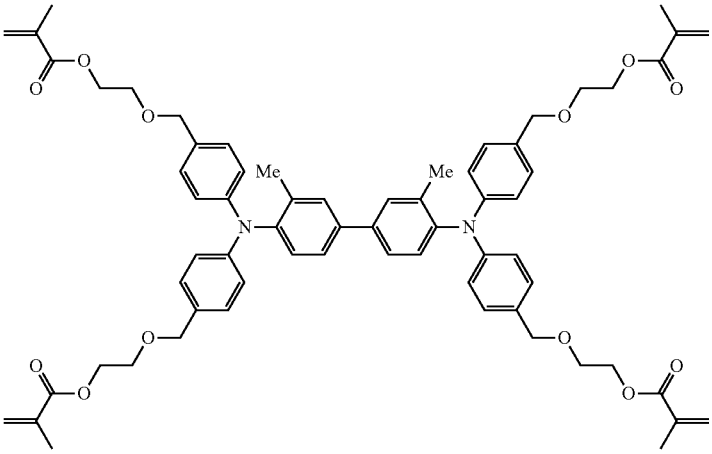 |
| A-6 | 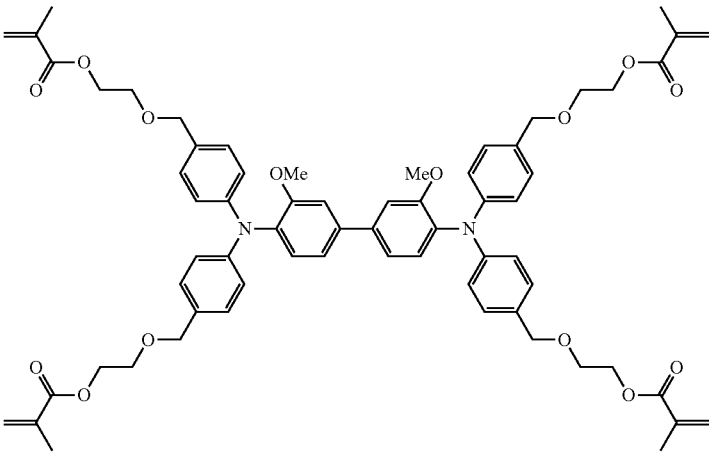 |

-continued
| No. |
|---|
| A-7 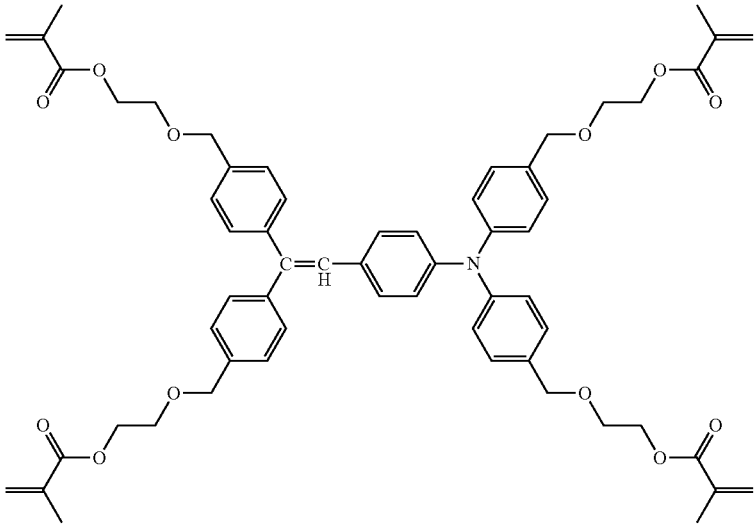 |
| A-8 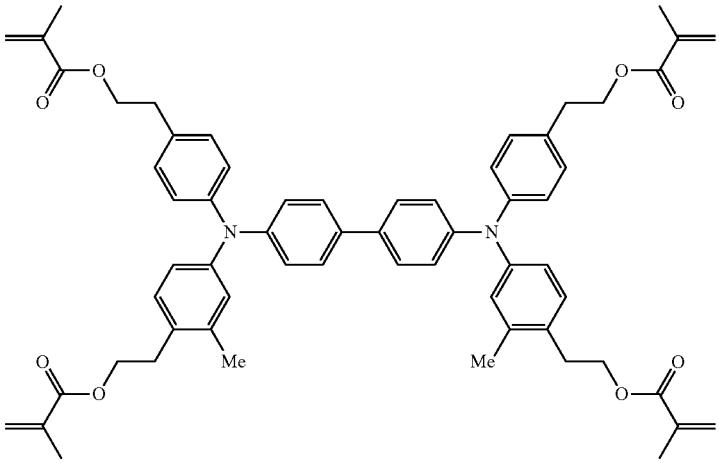 |
| A-9 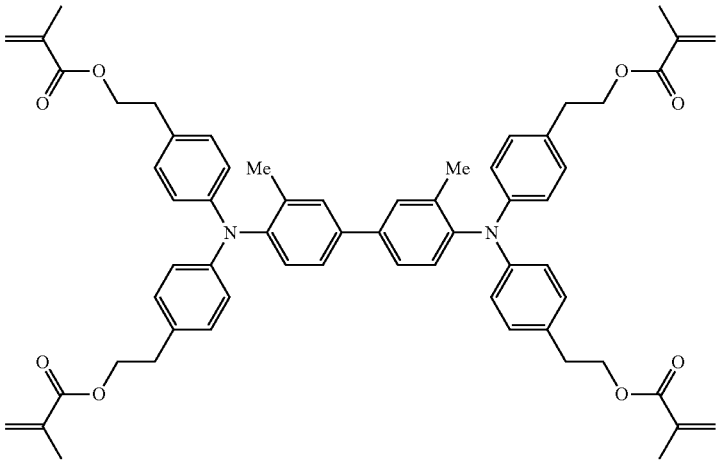 |

-continued
| No. |
|---|
| A-10 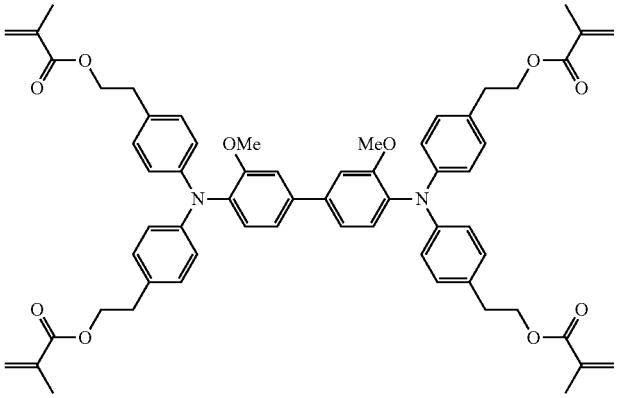 |
| A-11 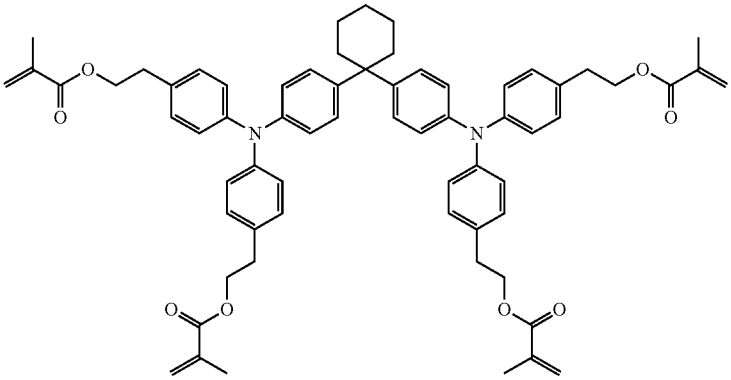 |
| A-12 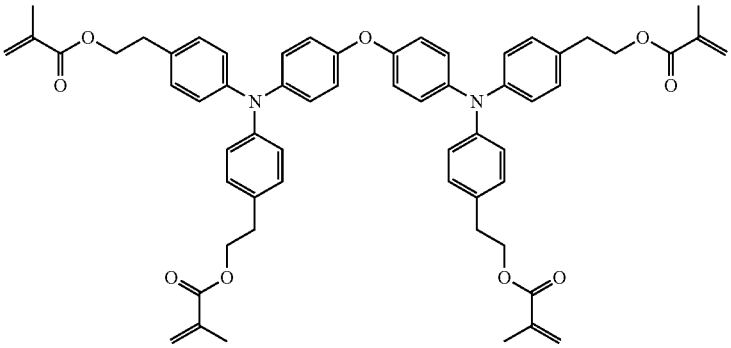 |
| A-13 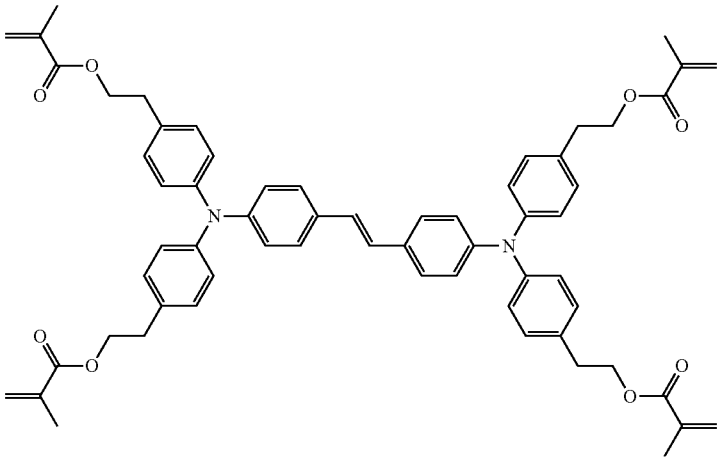 |

-continued
| No. | |
|---|---|
| A-14 | 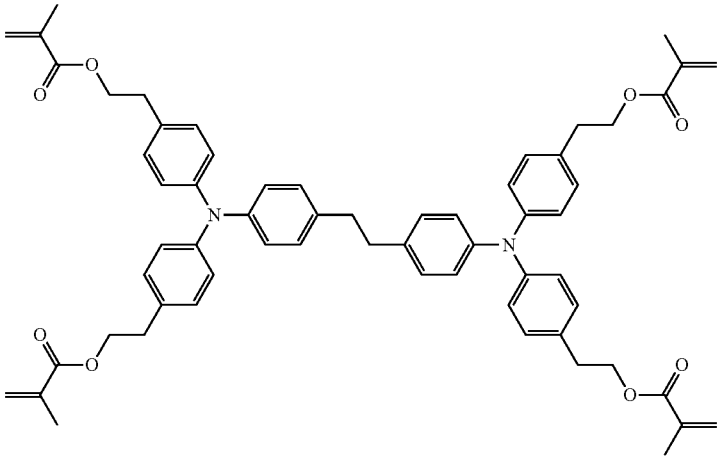 |
| A-15 | 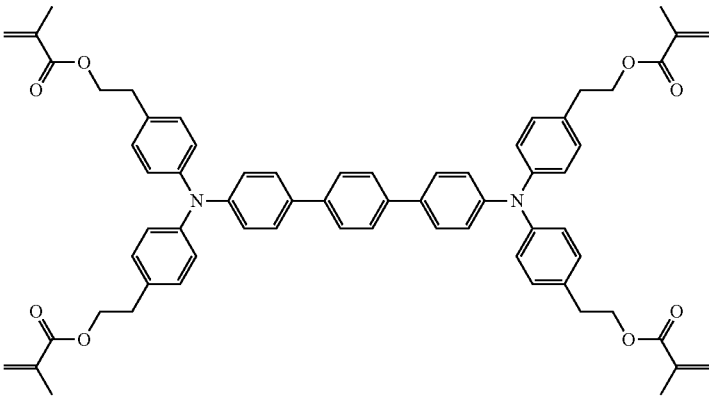 |
| A-16 | 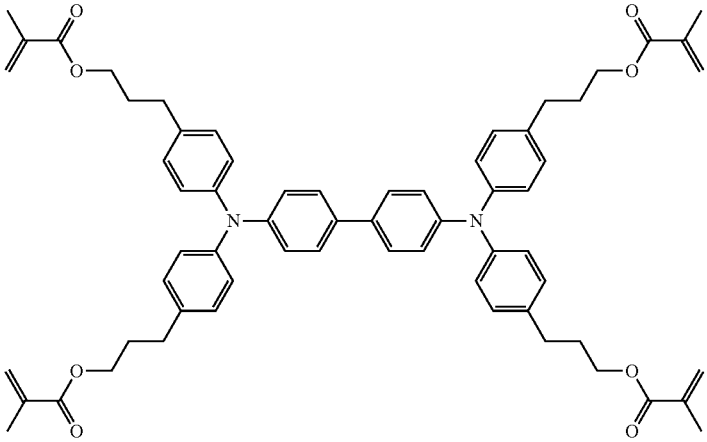 |

-continued
| No. | |
|---|---|
| A-17 | 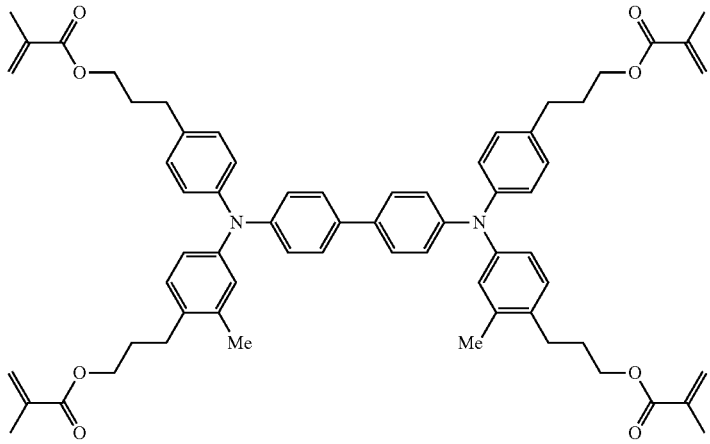 |
| A-18 | 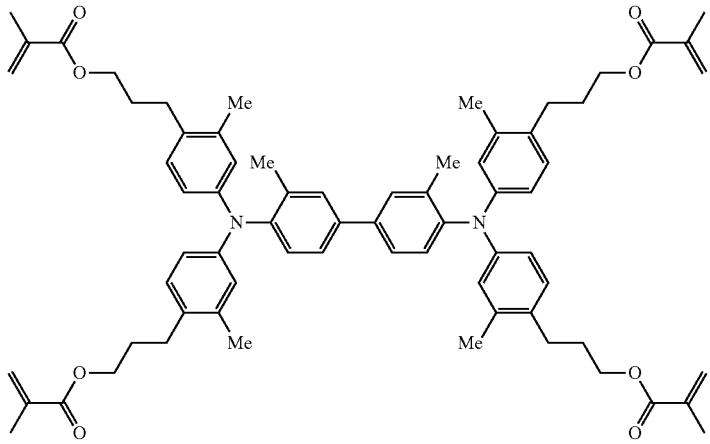 |
| A-19 | 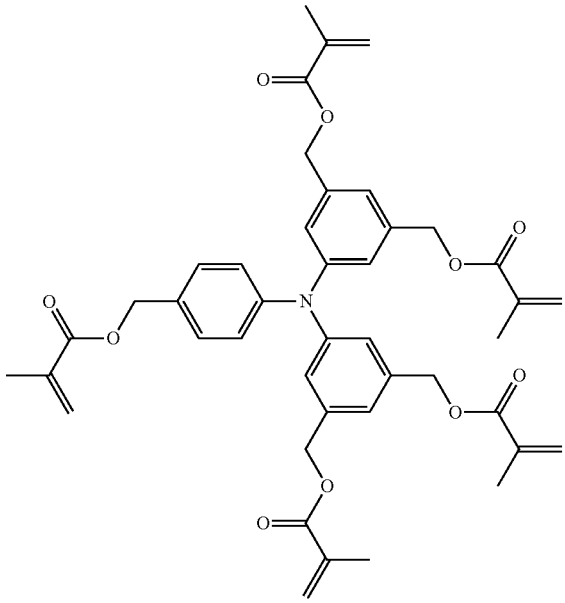 |

-continued

| No. | |
|---|---|
| A-20 | 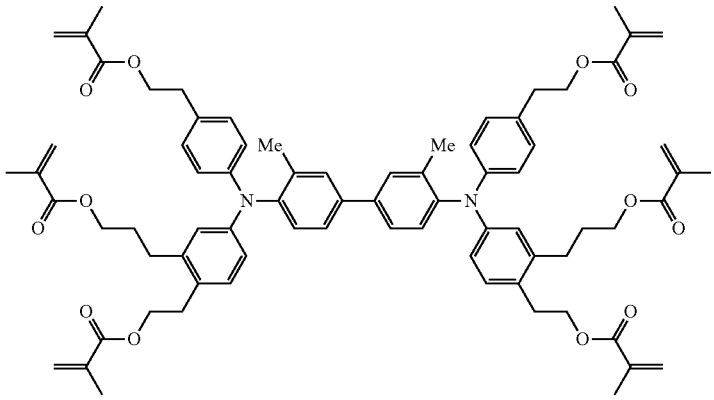 |
| A-21 | 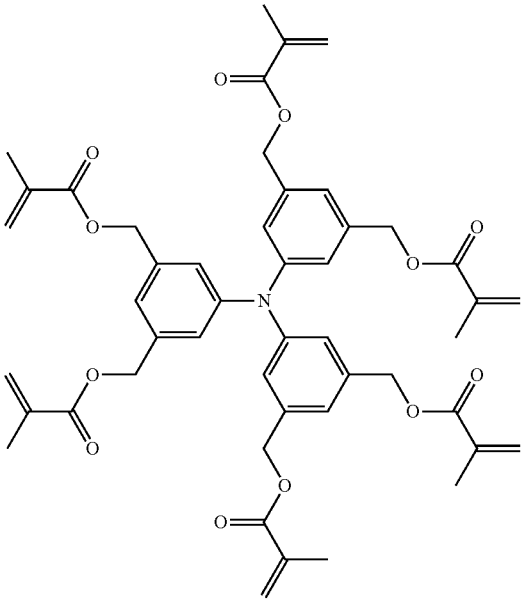 |

The compound represented by general formula (A) is synthesized as follows.

That is, the compound represented by general formula (A) can be synthesized by condensation of an alcohol, which is a precursor, with a corresponding methacrylic acid or a halogenated methacrylic acid. Alternatively, when the alcohol serving as a precursor has a benzyl alcohol structure, the compound represented by general formula (A) can be synthesized by dehydrative etherification with a hydroxyl-group-containing methacrylic acid derivative, such as hydroxyethyl methacrylate.

The synthetic routes of compounds A-4 and A-17, which are compounds represented by general formula (A), are described below as examples.

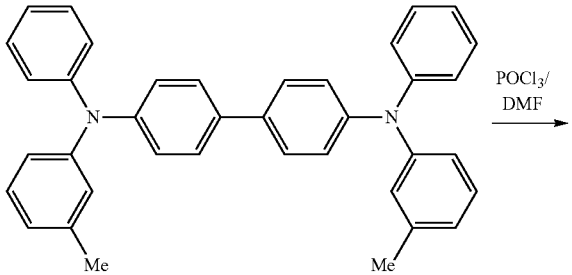

-continued
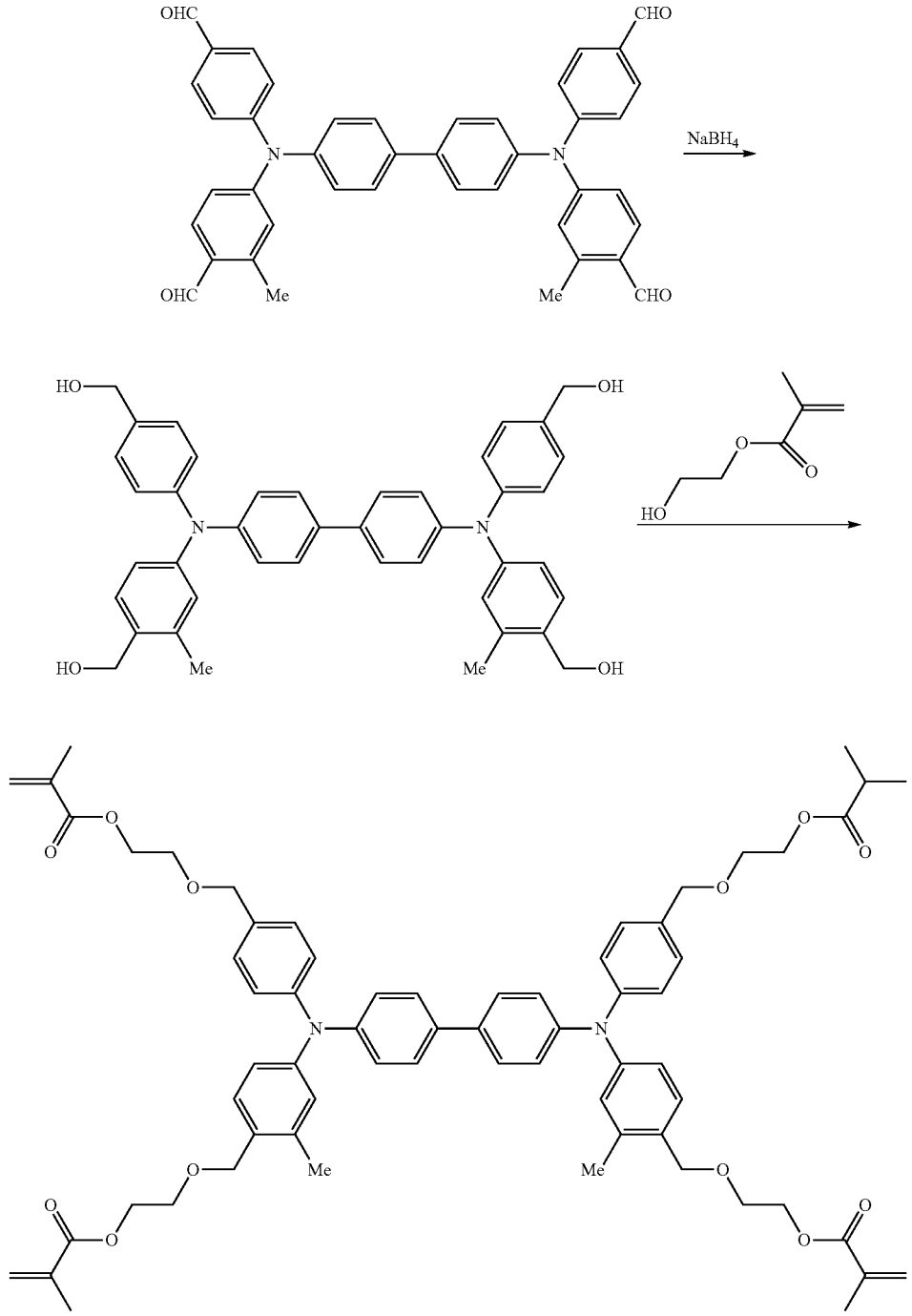
Compound A-4
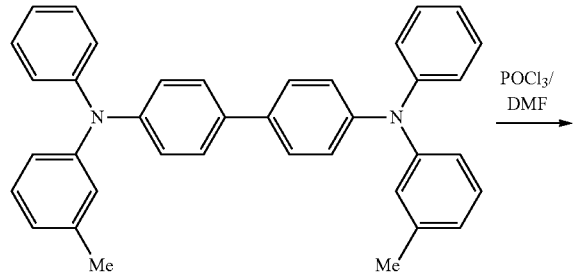

-continued
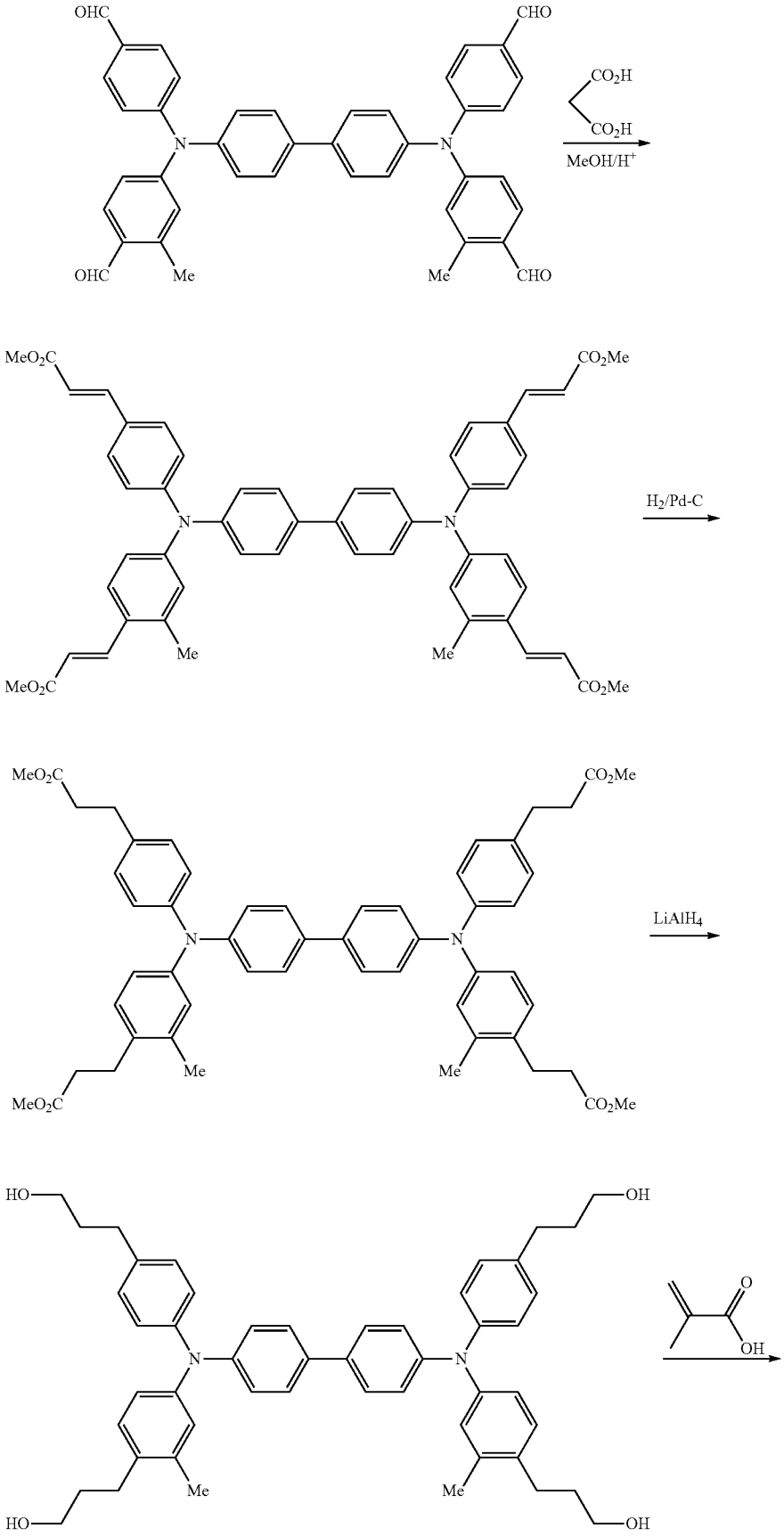

-continued

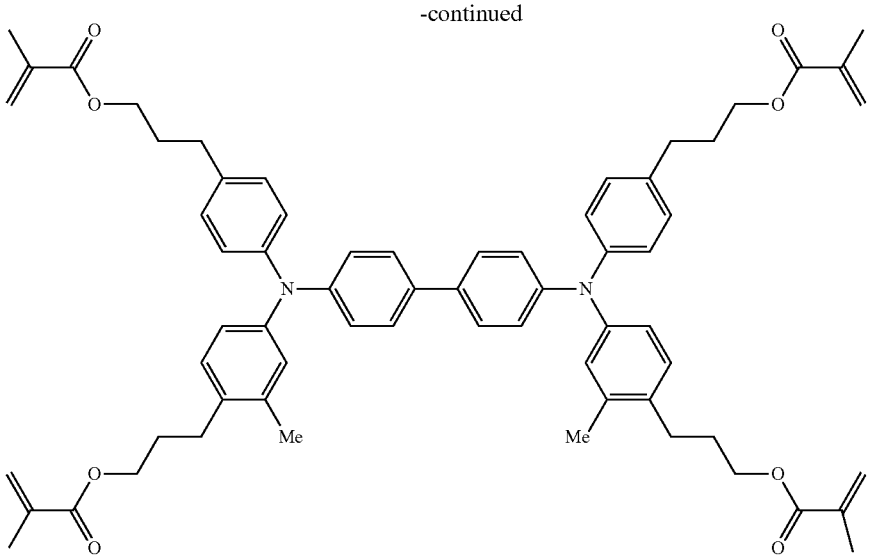

Compound A-17

In the description above, a compound (a') having a triphenylamine skeleton and four or more methacryloyl groups in the same molecule is described as an example of the specific charge transporting material (a). However, in addition to the compound (a'), the following compounds (hereinafter may be referred to as "other reactive charge transporting material (a")" can also be used as the specific charge transporting material (a).

That is, examples of the other reactive charge transporting materials (a") are compounds (a") each obtained by introducing an acryloyl group or a methacryloyl group into a known charge transporting material. Examples of the known charge transporting material include triarylamine compounds, benzidine compounds, aryl alkane compounds, aryl-substituted ethylene compounds, stilbene compounds, anthracene compounds, and hydrazone compounds that are listed as the hole transporting compounds among the charge transporting materials constituting the charge transporting layer. More specifically, examples of the other reactive charge transporting material (a") include compounds described in Japanese Laid Open Patent Application Publication No. 5-216249, compounds described in Japanese Laid Open Patent Application Publication No. 2000-206715, compounds described in Japanese Laid Open Patent Application Publication No. 2004-12986, compounds described in Japanese Laid Open Patent Application Publication No. 7-72640, compounds described in Japanese Laid Open Patent Application Publication No. 2004-302450, compounds described in Japanese Laid Open Patent Application Publication No. 2000-206717, compounds described in Japanese Laid Open Patent Application Publication No. 2001-175016, and compounds described in Japanese Laid Open Patent Application Publication No. 2005-115353.

Among these, a compound having a triphenylamine skeleton and one or more and three or less acryloyl or methacryloyl groups in the same molecule may be used as the other reactive charge transporting material (a"). In particular, a compound represented by general formula (A) with D representing $—(CH_2)_f—(O—CH_2—CH_2)_g—O—CO—C(R)=CH_2$, f representing an integer of 0 to 5, g representing 0 or 1, R representing a hydrogen atom or a methyl group, and a total number of D being 1 or more and 3 or less, may be used. In particular, this compound with D having f representing an integer of 1 to 5 and R representing a methyl group may be used.

Specific examples of the other reactive charge transporting materials (a") are as follows.

Specific examples of the compound having a triphenylamine skeleton and one acryloyl or methacryloyl group in the same molecule, which is one of the reactive charge transporting materials (a"), include, but are not limited to, compounds I-1 to I-12.

| No. | |
|---|---|
| I-1 | 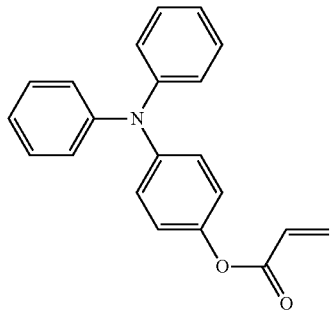 |
| I-2 | 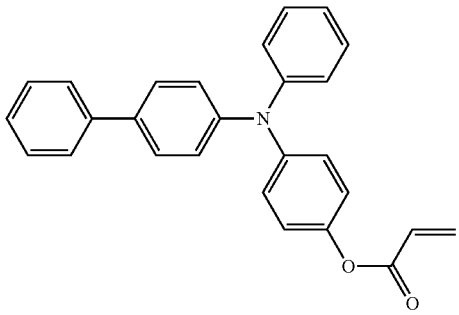 |

-continued
| No. | |
|---|---|
| I-3 | 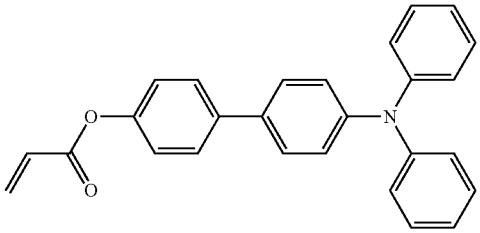 |
| I-4 | 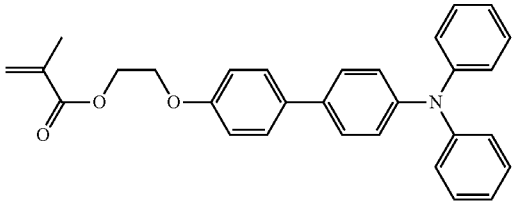 |
| I-5 | 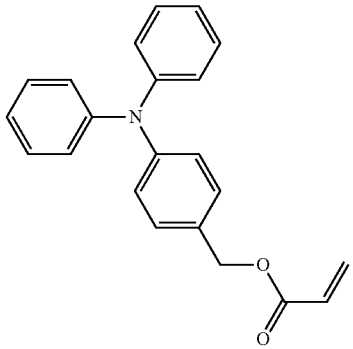 |
| I-6 | 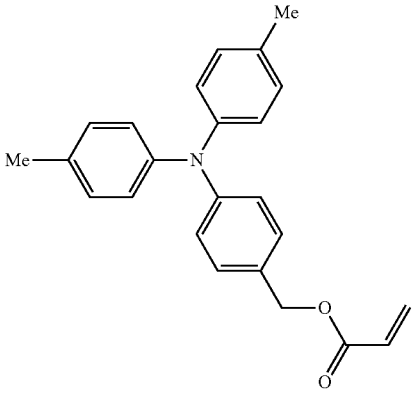 |
| I-7 | 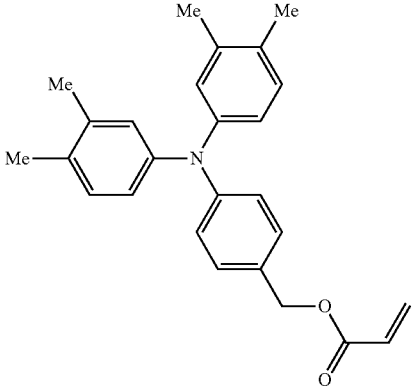 |
-continued
| No. | |
|---|---|
| I-8 | 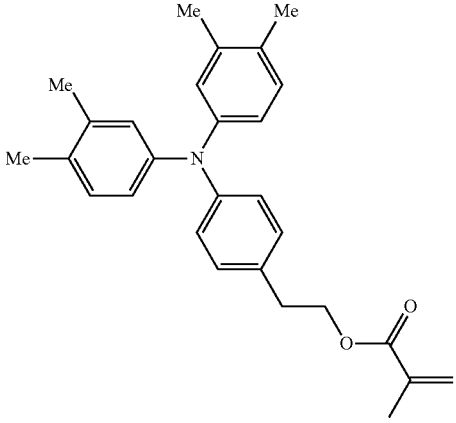 |
| I-9 | 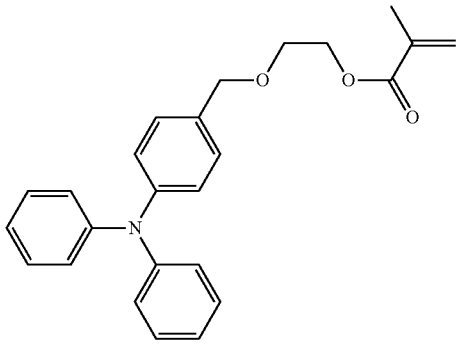 |
| I-10 | 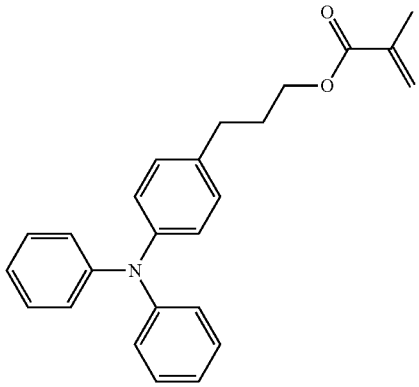 |
| I-11 | 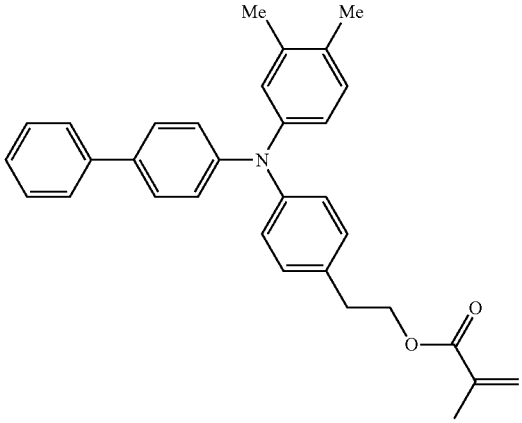 |

-continued
| No. | |
|---|---|
| I-12 | 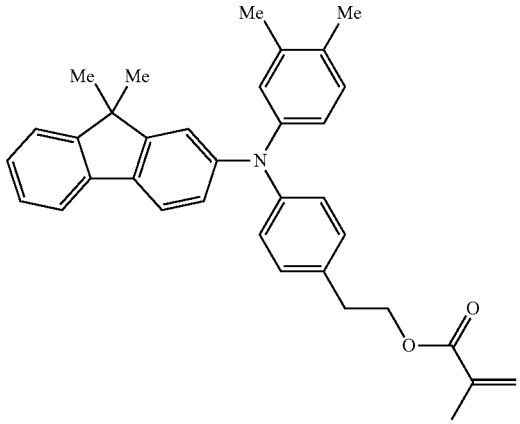 |
Specific examples of the compound having a triphenylamine skeleton and two acryloyl or methacryloyl groups in the same molecule, which is one of the reactive charge transporting materials (a"), include, but are not limited to, compounds II-1 to II-19.
| No. | |
|---|---|
| II-1 | 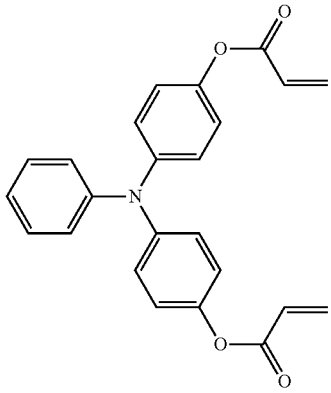 |
| II-2 | 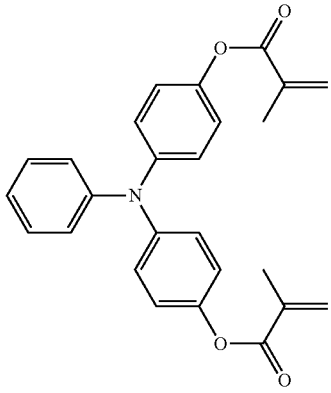 |

-continued
| No. | |
|---|---|
| II-3 | 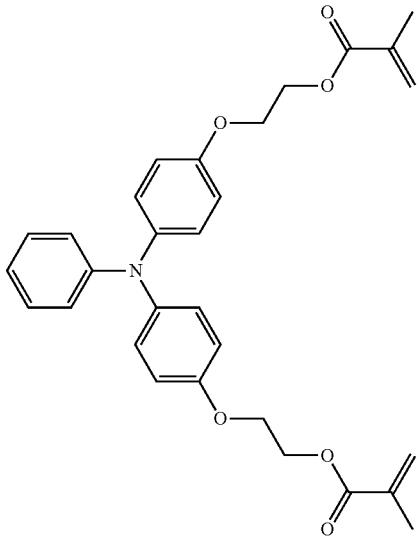 |
| II-4 | 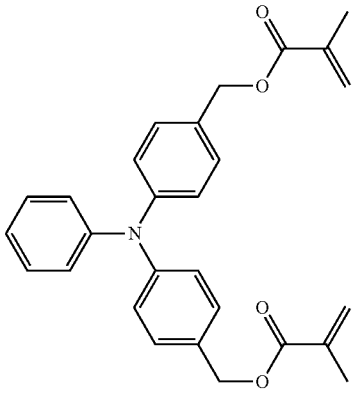 |
| II-5 | 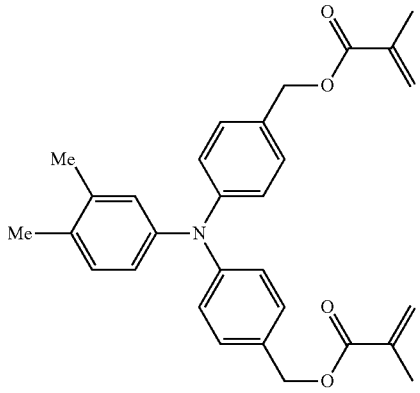 |

-continued
| No. | |
|---|---|
| II-6 | 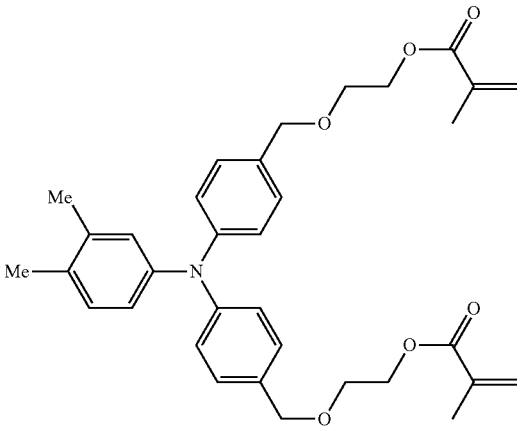 |
| II-7 | 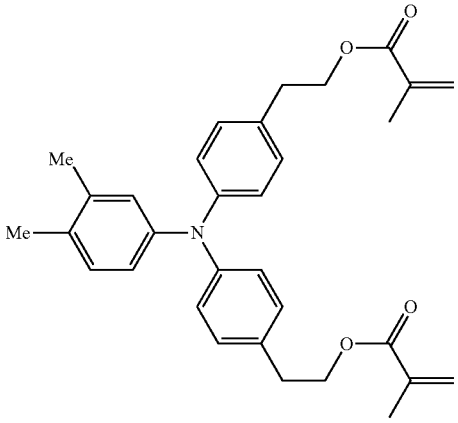 |
| II-8 | 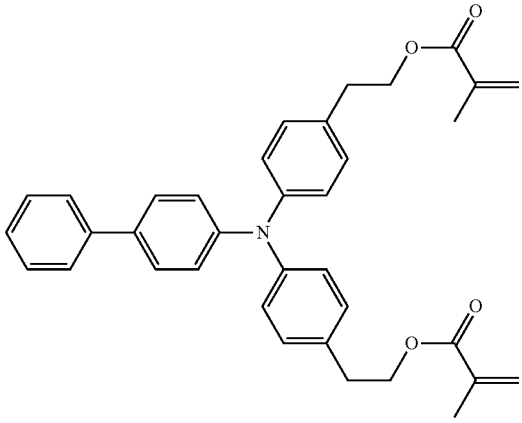 |

-continued
| No. | |
|---|---|
| II-9 | 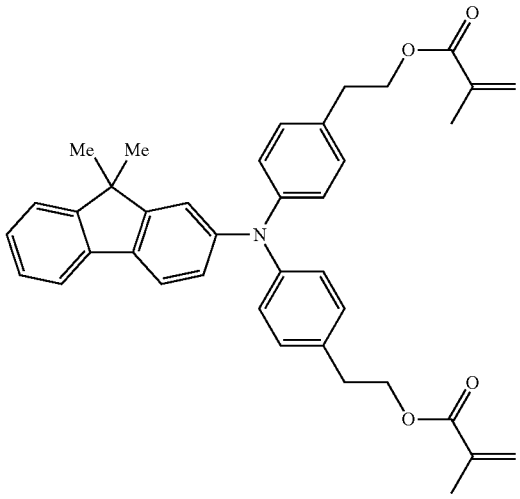 |
| II-10 | 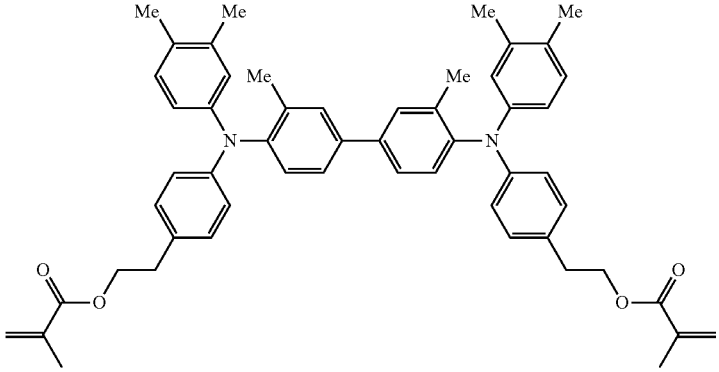 |
| II-11 | 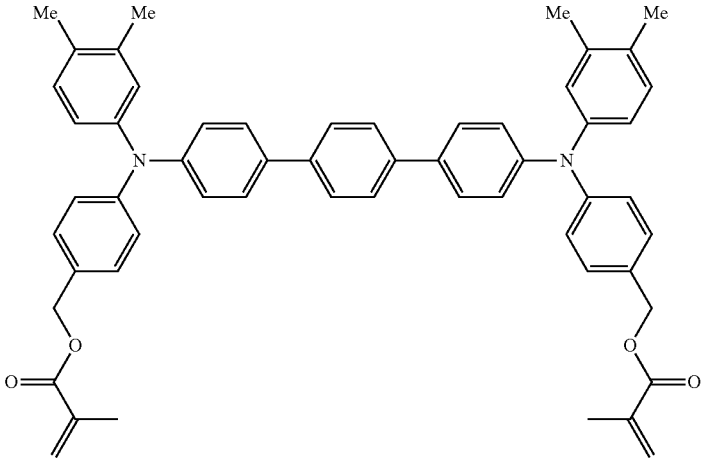 |

-continued
| No. | |
|---|---|
| II-12 | 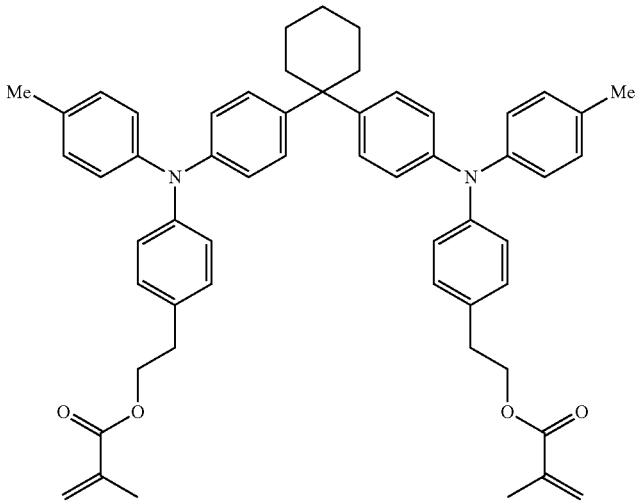 |
| II-13 | 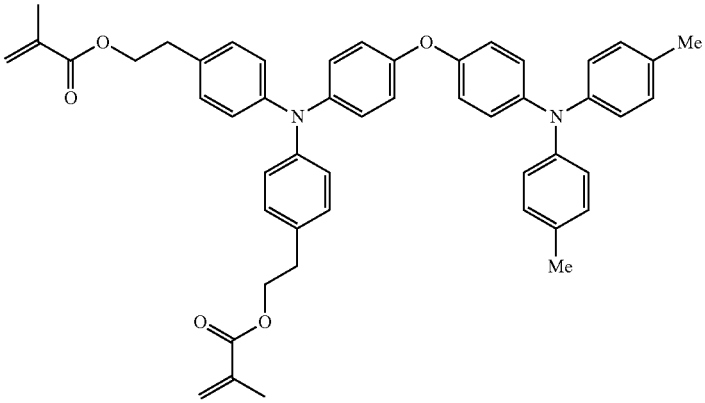 |
| II-14 | 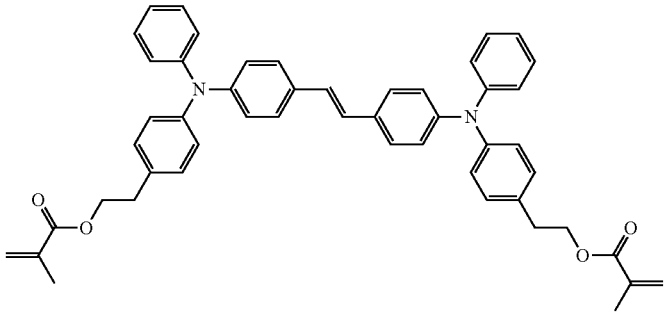 |
| II-15 | 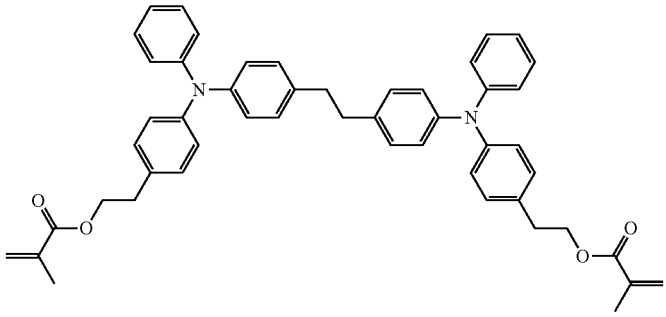 |

-continued
| No. | |
|---|---|
| II-16 | 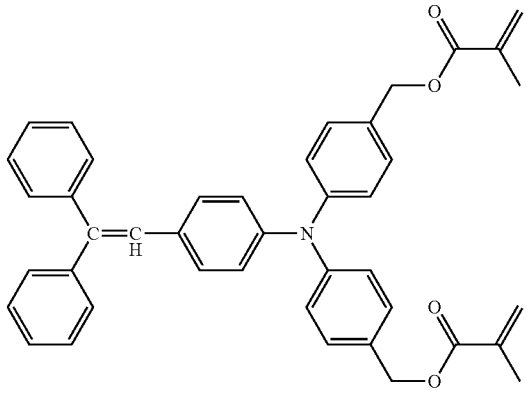 |
| II-17 | 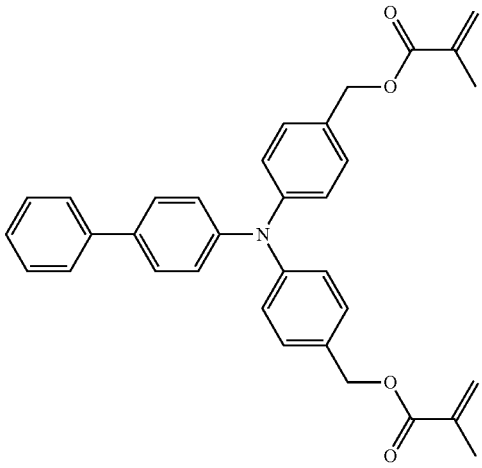 |
| II-18 | 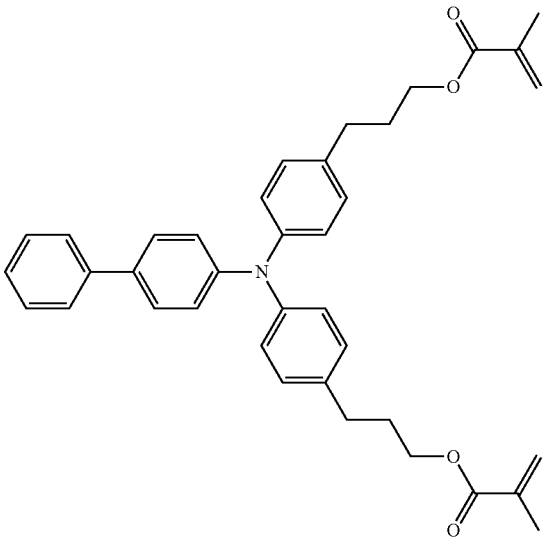 |

-continued
| No. | |
|---|---|
| II-19 | 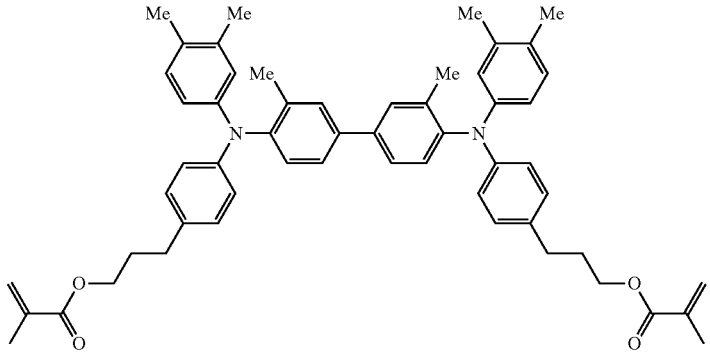 |
Specific examples of the compound having a triphenylamine skeleton and three acryloyl or methacryloyl groups in the same molecule, which is one of the reactive charge transporting materials (a"), include, but are not limited to, compounds III-1 to III-11.
| No. | |
|---|---|
| III-1 | 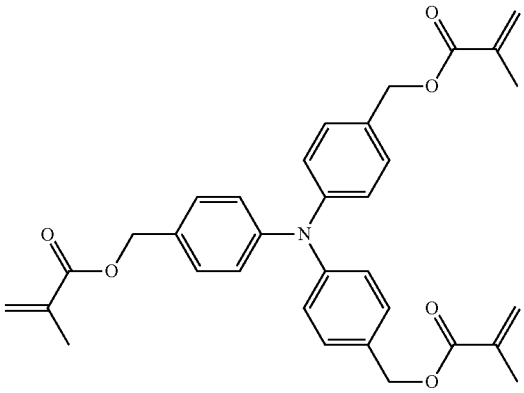 |
| III-2 | 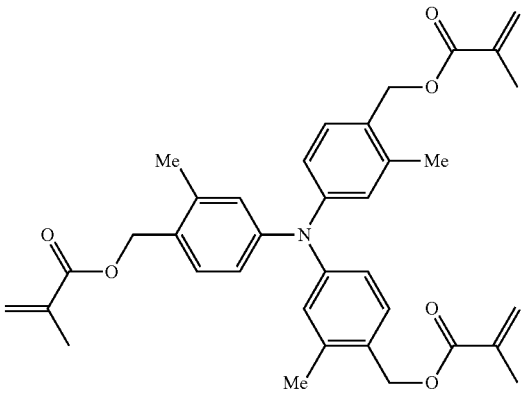 |

-continued
| No. |
| --- |
| III-3 |
| 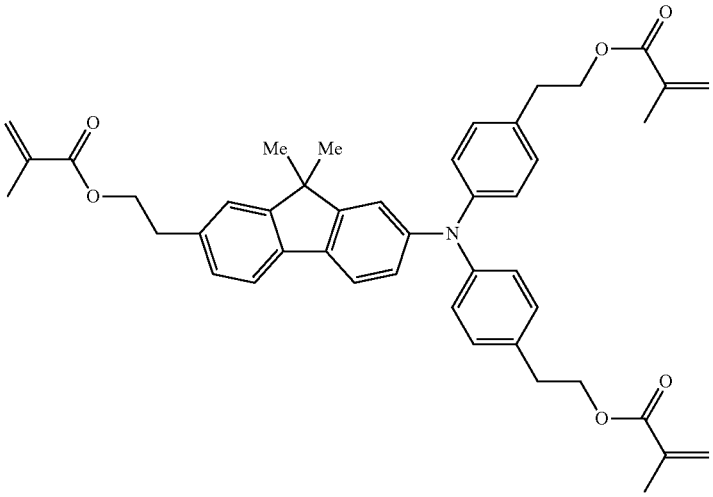 |
| III-4 |
| 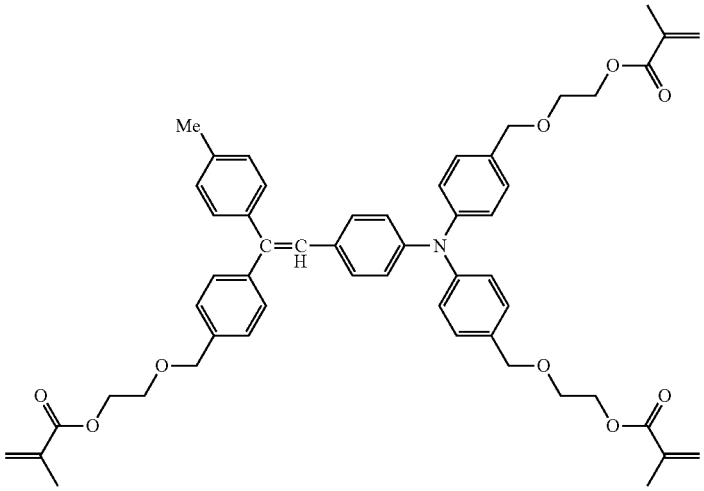 |
| III-5 |
| 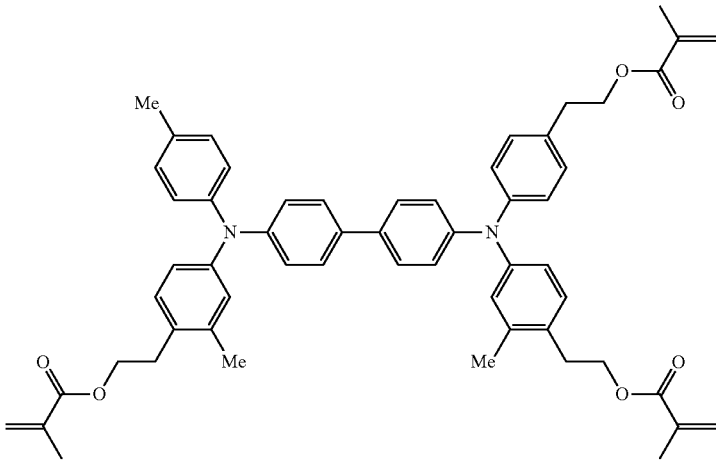 |

-continued
| No. | |
|---|---|
| III-6 | 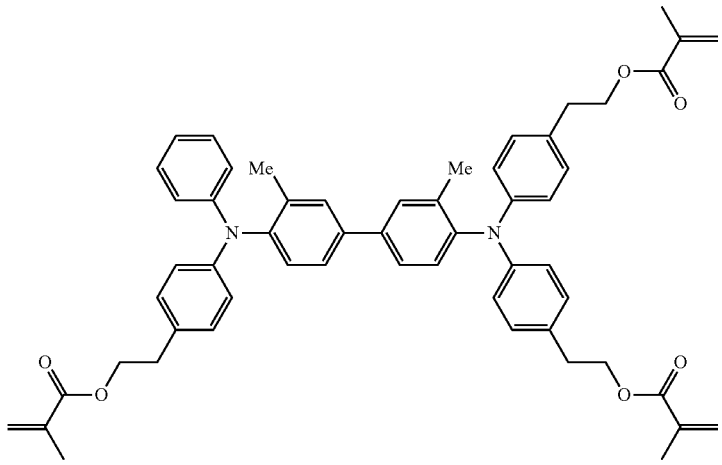 |
| III-7 | 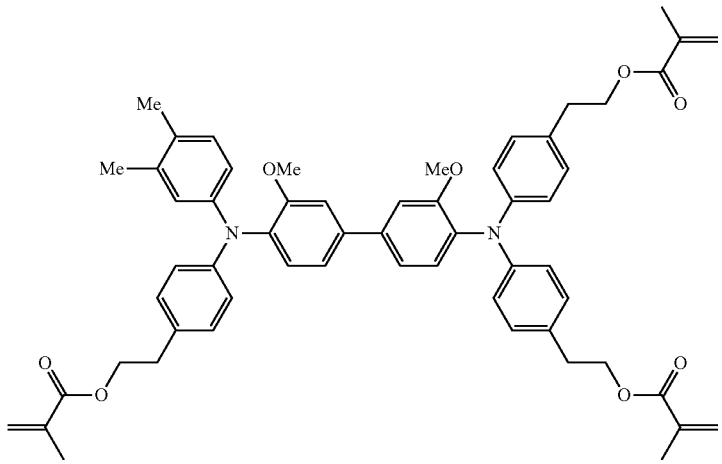 |
| III-8 | 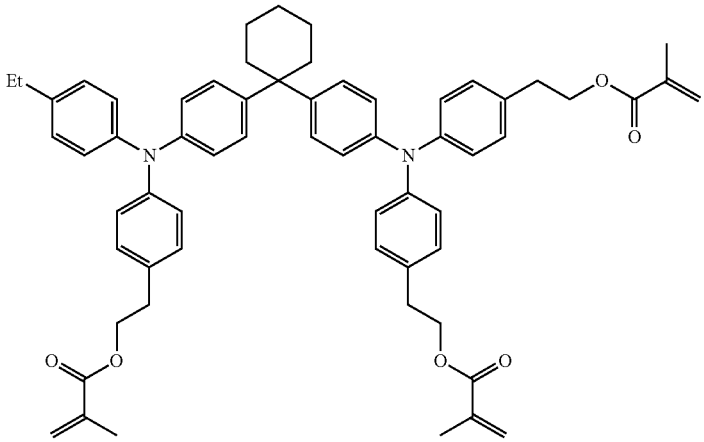 |

-continued

| No. | |
|---|---|
| III-9 | 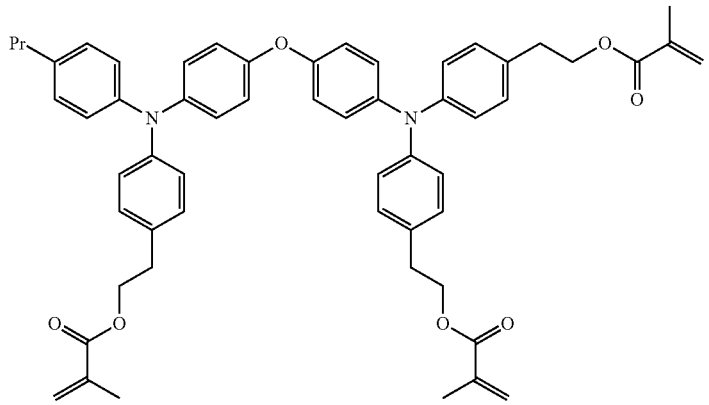 |
| III-10 | 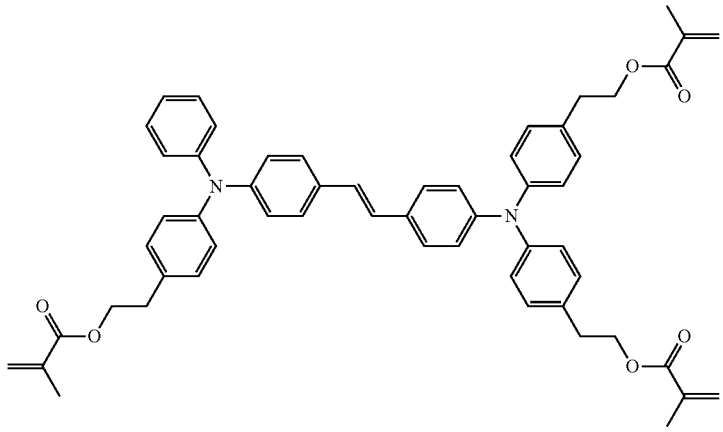 |
| III-11 | 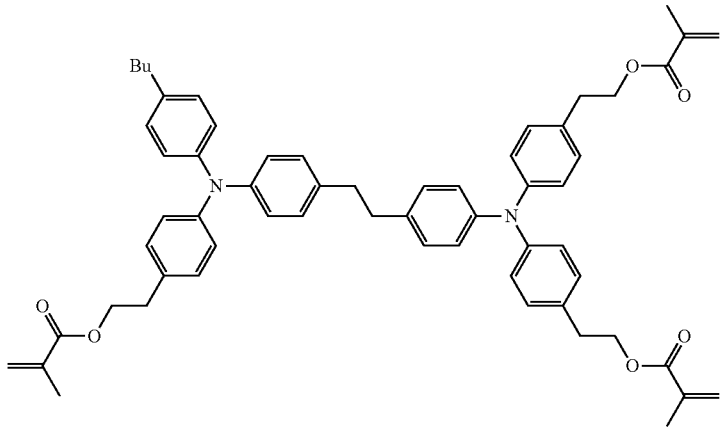 |

In the compounds I-1 to I-12, II-1 to II-19, and III-1 to III-11 described above, "Me" stands for a methyl group, "Et" stands for an ethyl group, "Pr" stands for a propyl group, and "Bu" stands for a butyl group.

The total amount of the specific charge transporting materials (a) relative to the composition (solid content) used in forming the surface protection layer may be 30 mass % or more and 100 mass % or less, 40 mass % or more and 100 mass % or less, or 50 mass % or more and 100 mass % or less.

Within this range, the cured film exhibits excellent electrical properties, and the thickness of the cured film can be increased.

The total amount of the compound having a charge transporting skeleton and three or more acryloyl or methacryloyl groups among the specific charge transporting materials (a) relative to the composition used in forming the surface protection layer may be 5 mass % or more, 10 mass % or more, or 15 mass % or more.

A compound having a charge transporting skeleton and four or more acryloyl or methacryloyl groups and a compound having a charge transporting skeleton and one or more and two or less acryloyl or methacryloyl groups may be used in combination as the specific charge transporting materials (a). In particular, a compound represented by general formula (A) and a compound having a triphenylamine skeleton and one or more and two or less acryloyl or methacryloyl groups in the same molecule may be used in combination.

According to this feature, compared to the case in which all of the specific charge transporting materials (a) are compounds having four or more methacryloyl groups (reactive groups), the crosslinking density can be decreased without decreasing the amount of the charge transporting skeleton present, and thus, the strength of the surface protection layer can be adjusted while maintaining the electrical properties.

When a compound having a charge transporting skeleton and four or more acryloyl or methacryloyl groups and a compound having a charge transporting skeleton and one or more and three or less acryloyl or methacryloyl groups are used in combination, the amount of the compound having a charge transporting skeleton and four or more acryloyl or methacryloyl groups contained in the total amount of the specific charge transporting materials (a) may be 5 mass % or more, 10 mass % or more, or 15 mass % or more.

The specific charge transporting materials (a) do not have to contain a compound having a charge transporting skeleton and four or more acryloyl or methacryloyl groups. A single compound containing a charge transporting skeleton and one or more and three or less acryloyl or methacryloyl groups may be used as the specific charge transporting material (a).

Other Charge Transporting Materials

The cured film that constitutes the surface protection layer may be a cured film obtained by using the specific charge transporting material (a) and, if necessary, a known charge transporting material that does not have a reactive group. Here, the reactive group means a radical-polymerizable unsaturated bond.

When a known charge transporting material that does not have a reactive group is used in combination, the concentration of the charge transporting component can be substantially increased because the material does not have a reactive group, and thus the electrical properties of the surface protection layer can be further improved. The known charge transporting material that does not have a reactive group can contribute to adjusting the strength of the surface protection layer. Furthermore, since the specific charge transporting material (a) has a charge transporting skeleton, the specific charge transporting material (a) has excellent compatibility with the known charge transporting material that does not have a reactive group; thus, the charge transporting material that does not have a reactive group becomes doped, and electrical properties are further improved.

Examples of the known charge transporting material that does not have a reactive group include the above-described examples of the charge transporting material that constitutes the charge transporting layer. Among these, a charge transporting material having a triphenylamine skeleton may be used from the viewpoints of mobility, compatibility, etc.

The amount of the known charge transporting material that does not have a reactive group relative to the solid content in the composition used in forming the surface protection layer may be 2 mass % or more and 50 mass % or less, 5 mass % or more and 45 mass % or less, or 10 mass % or more and 40 mass % or less.

Polymerization Initiator

The surface protection layer is formed by applying at least one energy selected from thermal energy, light energy, and electron beam energy so as to polymerize and cure the composition containing the specific charge transporting material (a). Although the polymerization initiator (b) need not be used in the polymerization and curing reaction, the reaction proceeds smoothly when at least one polymerization initiator (b) selected from the following photopolymerization initiators and thermal polymerization initiators is used.

Examples of the photopolymerization initiators include intramolecular cleavage-type polymerization initiators and hydrogen abstraction-type polymerization initiators.

Examples of the intramolecular cleavage-type photopolymerization initiators include photopolymerization initiators based on benzylketal, alkylphenone, aminoalkylphenone, phosphine oxide, titanocene, and oxime.

A specific example of the benzylketal photopolymerization initiator is 2,2-dimethoxy-1,2-diphenylethan-1-one.

Examples of the alkylphenone photopolymerization initiators include 1-hydroxy-cyclohexyl-phenyl-ketone, 2-hydroxy-2-methyl-1-phenyl-propan-1-one, 1-[4-(2-hydroxyethoxy)-phenyl]-2-hydroxy-2-methyl-1-propan-1-one, 2-hydroxy-1-[4-[4-(2-hydroxy-2-methyl-propionyl)-benzyl]phenyl]-2-methyl-propan-1-one, acetophenone, and 2-phenyl-2-(p-toluenesulfonyloxy)acetophenone.

Examples of the aminoalkylphenone photopolymerization initiators include p-dimethylaminoacetophenone, p-dimethylaminopropiophenone, 2-methyl-1-(4-methylthiophenyl)-2-morpholinopropan-1-one, 2-benzyl-2-dimethylamino-1-(4-morpholinophenyl)-butanone-1, and 2-(dimethylamino)-2-[(4-methylphenyl)methyl]-1-[4-(4-morpholinyl)phenyl]-1-butanone.

Examples of the phosphine oxide photopolymerization initiators include 2,4,6-trimethylbenzoyl-diphenyl-phosphine oxide and bis(2,4,6-trimethylbenzoyl)-phenylphosphine oxide.

An example of the titanocene photopolymerization initiators is bis(η5-2,4-cyclopentadien-1-yl)-bis(2,6-difluoro-3-(1H-pyrrol-1-yl)-phenyl) titanium.

Examples of the oxime photopolymerization initiators include 1,2-octanedione, 1-[4-(phenylthio)-2-(0-benzoyloxime)], ethanone, and 1-[9-ethyl-6-(2-methylbenzoyl)-9H-carbazol-3-yl]-1-(0-acetyloxime).

Examples of the hydrogen abstraction-type photopolymerization initiators include photopolymerization initiators based on benzophenone, thioxanthone, benzyl, and Michler ketone.

Specific examples of the benzophenone-based hydrogen abstraction-type photopolymerization initiators include 2-benzoylbenzoic acid, 2-chlorobenzophenone, 4,4'-dichlorobenzophenone, 4-benzoyl-4'-methyldiphenyl sulfide, and p,p'-bisdiethylaminobenzophenone.

Examples of those based on thioxanthone include 2,4-diethylthioxanthen-9-one, 2-chlorothioxanthone, and 2-isopropylthioxanthone.

Examples of those based on benzyl include benzyl, (+)-camphor quinone, and p-anisyl.

Known thermal polymerization initiators can be used as the thermal polymerization initiator used in thermal curing. Specifically, for example, any of the following commercially available thermal polymerization initiators may be used.

When a composition containing the specific charge transporting material (a) is cured by light or an electron beam, the curing reaction may proceed excessively rapidly, and a surface protection layer that has nonuniformity and wrinkles may result due to residual strain. In such a case, a thermal polymerization initiator may be used as the polymerization initiator. In particular, when the specific charge transporting material (a) contains a methacryloyl group, which has lower reactivity than the acryloyl group, use of a thermal polymerization initiator facilitates suppression of residual strain; thus, occurrence of nonuniformity and wrinkles in the surface protection layer is easily suppressed.

Examples of the commercially available products of the thermal polymerization initiator include azo initiators such as V-30 (10-hour half-life temperature: 104° C.), V-40 (10-hour half-life temperature: 88° C.), V-59 (10-hour half-life temperature: 67° C.), V-601 (10-hour half-life temperature: 66° C.), V-65 (10-hour half-life temperature: 51° C.), V-70 (10-hour half-life temperature: 30° C.), VF-096 (10-hour half-life temperature: 96° C.), Vam-110 (10-hour half-life temperature: 111° C.), and Vam-111 (10-hour half-life temperature: 111° C.) (products up to here are produced by Wako Pure Chemical Industries, Ltd.), and OTAZO-15 (10-hour half-life temperature: 61° C.), OTAZO-30, AIBN (10-hour half-life temperature: 65° C.), AMBN (10-hour half-life temperature: 67° C.), ADVN (10-hour half-life temperature: 52° C.), and ACVA (10-hour half-life temperature: 68° C.) (products up to here are produced by Otsuka Chemical Co., Ltd.).

Other examples of the commercially available products of the thermal polymerization initiator include PERTETRA A, PERHEXA HC, PERHEXA C, PERHEXA V, PERHEXA 22, PERHEXA MC, PERBUTYL H, PERCUMYL H, PERCUMYL P, PERMENTA H, PEROCTA H, PERBUTYL C, PERBUTYL D, PERHEXYL D, PERLOYL IB, PERLOYL 355, PERLOYL L, PERLOYL SA, NYPER BW, NYPER BMT-K40/M, PERLOYL IPP, PERLOYL NPP, PERLOYL TCP, PERLOYL OPP, PERLOYL SBP, PERCUMYL ND, PEROCTA ND, PERHEXYL ND, PERBUTYL ND, PERBUTYL NHP, PERHEXYL PV, PERBUTYL PV, PERHEXA 250, PEROCTA O, PERHEXYL O, PERBUTYL O, PERBUTYL L, PERBUTYL 355, PERHEXYL I, PERBUTYL I, PERBUTYL E, PERHEXA 25Z, PERBUTYL A, PERHEXYL Z, PERBUTYL ZT, and PERBUTYL Z (products up to here are produced by NOF CORPORATION);

Kayaketal AM-C55, Trigonox 36-C75, Laurox, Perkadox L-W75, Perkadox CH-50L, Trigonox TMBH, Kayacumen H, Kayabutyl H-70, Perkadox BC-FF, Kayahexa AD, Perkadox 14, Kayabutyl C, Kayabutyl D, KayahexaYD-E85, Perkadox 12-XL25, Perkadox 12-EB20, Trigonox 22-N70, Trigonox 22-70E, Trigonox D-T50, Trigonox 423-C70, Kayaester CND-C70, Kayaester CND-W50, Trigonox 23-C70, Trigonox 23-W50N, Trigonox 257-C70, Kayaester P-70, Kayaester TMPO-70, Trigonox 121, Kayaester O, Kayaester HTP-65W, Kayaester AN, Trigonox 42, Trigonox F-C50, Kayabutyl B, Kayacarbon EH-C70, Kayacarbon EH-W60, Kayacarbon I-20, Kayacarbon BIC-75, Trigonox 117, and Kayaren 6-70 (products up to here are produced by Kayaku Akzo Corporation); and LUPEROX LP (10-hour half-life temperature: 64° C.), LUPEROX 610 (10-hour half-life temperature: 37° C.), LUPEROX 188 (10-hour half-life temperature: 38° C.), LUPEROX 844 (10-hour half-life temperature: 44° C.), LUPEROX 259 (10-hour half-life temperature: 46° C.), LUPEROX 10 (10-hour half-life temperature: 48° C.), LUPEROX 701 (10-hour half-life temperature: 53° C.), LUPEROX 11 (10-hour half-life temperature: 58° C.), LUPEROX 26 (10-hour half-life temperature: 77° C.), LUPEROX 80 (10-hour half-life temperature: 82° C.), LUPEROX 7 (10-hour half-life temperature: 102° C.), LUPEROX 270 (10-hour half-life temperature: 102° C.), LUPEROX P (10-hour half-life temperature: 104° C.), LUPEROX 546 (10-hour half-life temperature: 46° C.), LUPEROX 554 (10-hour half-life temperature: 55° C.), LUPEROX 575 (10-hour half-life temperature: 75° C.), LUPEROX TANPO (10-hour half-life temperature: 96° C.), LUPEROX 555 (10-hour half-life temperature: 100° C.), LUPEROX 570 (10-hour half-life temperature: 96° C.), LUPEROX TAP (10-hour half-life temperature: 100° C.), LUPEROX TBIC (10-hour half-life temperature: 99° C.), LUPEROX TBEC (10-hour half-life temperature: 100° C.), LUPEROX JW (10-hour half-life temperature: 100° C.), LUPEROX TAIC (10-hour half-life temperature: 96° C.), LUPEROX TAEC (10-hour half-life temperature: 99° C.), LUPEROX DC (10-hour half-life temperature: 117° C.), LUPEROX 101 (10-hour half-life temperature: 120° C.), LUPEROX F (10-hour half-life temperature: 116° C.), LUPEROX DI (10-hour half-life temperature: 129° C.), LUPEROX 130 (10-hour half-life temperature: 131° C.), LUPEROX 220 (10-hour half-life temperature: 107° C.), LUPEROX 230 (10-hour half-life temperature: 109° C.), LUPEROX 233 (10-hour half-life temperature: 114° C.), and LUPEROX 531 (10-hour half-life temperature: 93° C.) (products up to here are produced by ARKEMA Yoshitomi, Ltd.).

Among the thermal polymerization initiators, a thermal polymerization initiator having a half-life temperature of 10° C. or higher and 100° C. or lower may be used. In this exemplary embodiment, the half-life temperature refers to the 10-hour half-life temperature.

The curing reaction proceeds by using just one thermal polymerization initiator; however, using two or more thermal polymerization initiators contributes to obtaining a surface protection layer, which is a cured product, in which residual strain is suppressed.

In particular, when two or more thermal polymerization initiators are to be used, the thermal polymerization initiators to be used in combination may be selected such that the difference between the lowest 10-hour half-life temperature and the highest 10-hour half-life temperature is 20° C. or more. When two thermal polymerization initiators that differ in 10-hour half-life temperature by 20° C. or more are used in combination, a surface protection layer, which is a cured product, in which residual strain is suppressed can be more easily obtained.

From the viewpoints of the pot life of the coating solution and the progress of the curing reaction, the thermal polymerization initiators with 10-hour half-life temperatures of 40° C. or higher and 120° C. or lower may be used in combination, or thermal polymerization initiators with 10-hour half-life temperatures of 50° C. or higher 110° C. or lower may be used in combination.

The ratio at which the thermal polymerization initiators that have 10-hour half-life temperatures different from each other by 20° C. or more may be any; however, the total amount of the thermal polymerization initiator having the lowest 10-hour half-life temperature and the thermal polymerization initiator having the highest 10-hour half-life temperature may be 30 mass % or more of the total amount of the thermal polymerization initiators. The total amount may be 40 mass % or more or may be 50 mass % or more. When the amount is set within this range, a surface protection layer, which is a cured product, in which residual strain is suppressed can be easily obtained.

For the thermal polymerization initiators that have 10-hour half-life temperatures different from each other by 20° C. or more, the ratio of the mass (L) of the thermal polymerization initiator having the lowest 10-hour half-life temperature to the mass (H) of the thermal polymerization initiator having the highest 10-hour half-life temperature may be L:H=2:8 or more and 9:1 or less, more preferably L:H=3:7 or more and 9:1 or less, and yet more preferably L:H=4:6 or more and 9:1 or less. It is presumed that when the mass ratio of the thermal polymerization initiator with the lowest 10-hour half-life temperature is set to a particular value or higher, the curing reaction can proceed more gently, and a surface protection layer, which is a cured product, in which residual strain is suppressed is easily obtained.

The total amount of the polymerization initiators relative to the total solid content of the composition containing the specific charge transporting material (a) may be 0.2 mass % or more and 10 mass % or less, may be 0.5 mass % or more and 8 mass % or less, or may be 0.7 mass % or more and 5 mass % or less.

The composition containing the specific charge transporting material (a) may contain a reactive compound (c) that does not have a charge transporting property. The reactive compound (c) that does not have a charge transporting property may be used to adjust the mechanical strength of the surface protection layer.

Here, the phrase "does not have a charge transporting property" means that carrier transportation is not observed by a time-of-flight method.

Examples of such a reactive compound include monofunctional or higher functional polymerizable monomers, oligomers, and polymers, such as monomers, oligomers, and polymers of acrylate or methacrylate.

Specific examples of the monofunctional monomer include isobutyl acrylate, t-butyl acrylate, isooctyl acrylate, lauryl acrylate, stearyl acrylate, isobornyl acrylate, cyclohexyl acrylate, 2-methoxyethyl acrylate, methoxytriethylene glycol acrylate, 2-ethoxyethyl acrylate, tetrahydrofurfuryl acrylate, benzyl acrylate, ethylcarbitol acrylate, phenoxyethyl acrylate, 2-hydroxy acrylate, 2-hydroxypropyl acrylate, 4-hydroxybutyl acrylate, methoxypolyethylene glycol acrylate, methoxypolyethylene glycol methacrylate, phenoxypolyethylene glycol acrylate, phenoxypolyethylene glycol methacrylate, hydroxyethyl-o-phenylphenol acrylate, and o-phenylphenol glycidyl ether acrylate.

Examples of the difunctional monomers, oligomers, and polymers include diethylene glycol di(meth)acrylate, polyethylene glycol di(meth)acrylate, polypropylene glycol di(meth)acrylate, neopentyl glycol di(meth)acrylate, and 1,6-hexanediol di(meth)acrylate.

Examples of the trifunctional monomers, oligomers, and polymers include trimethylolpropane tri(meth)acrylate, pentaerythritol tri(meth)acrylate, and aliphatic tri(meth)acrylates.

Examples of the tetrafunctional monomers, oligomers, and polymers include pentaerythritol tetra(meth)acrylate, ditrimethylolpropane tetra(meth)acrylate, and aliphatic tetra (meth)acrylates.

Examples of the pentafunctional or higher functional monomers, oligomers, and polymers include dipentaerythritol penta(meth)acrylate, dipentaerythritol hexa(meth)acrylate, and (meth)acrylates having polyester, urethane, and phosphazene skeletons.

The above-described monomers, oligomers, and polymers may be used alone or as a mixture of two or more.

The amount of the monomers, oligomers, and polymers described above relative to the total amount of the compounds having a charge transporting property contained in the composition containing the specific charge transporting material (the total amount of the specific charge transporting material and other charge transporting materials) may be 100 mass % or less, may be 50 mass % or less, or may be 30 mass % or less.

In order to control particle dispersibility and viscosity, to control the discharge gas resistance, mechanical strength, scratch resistance, torque reduction, and wear amount of the surface protection layer, and to extend pot-life etc., a polymer (d) that reacts with the specific charge transporting material (a) or a polymer (e) that does not react with the specific charge transporting material (a) may be added to the composition containing the specific charge transporting material (a).

Since the surface protection layer formed of the cured product of the composition containing the specific charge transporting material (a) has electrical properties and mechanical strength, various polymers may be used in combination as a binder resin. When such polymers are used, the viscosity of the composition is improved, and a surface protection layer with excellent surface properties is obtained; moreover, the gas barrier property that prevents mixing of gas into the outermost surface is improved, and adhesion to the underlying layer can be improved.

The polymer (d) that reacts with the specific charge transporting material (a) may be any polymer that has a radical-polymerizable unsaturated double bond as a reactive group; and examples thereof include polymers of the acrylate and methacrylate described above, and polymers described in Japanese Laid Open Patent Application Publication No. 5-216249, paragraphs [0026] to [0059], Japanese Laid Open Patent Application Publication No. 5-323630, paragraphs [0027] to [0029], Japanese Laid Open Patent Application Publication No. 11-52603, paragraphs [0089] to [0100], and Japanese Laid Open Patent Application Publication No. 2000-264961, paragraphs [0107] to [0128].

The polymer (e) that does not react with the specific charge transporting material (a) may be any polymer that does not contain a radical-polymerizable unsaturated double bond; and specific examples thereof include polycarbonate resins, polyester resins, polyarylate resins, methacrylic resins, acrylic resins, polyvinyl chloride resins, polyvinylidene chloride resins, and polystyrene resins known in the art.

The amount of the monomers, oligomers, and polymers described above relative to the total amount of the compounds having a charge transporting property contained in the composition containing the specific charge transporting material (the total amount of the specific charge transporting material and other charge transporting materials) may be 100 mass % or less, may be 50 mass % or less, or may be 30 mass % or less.

A coupling agent, a hard coating agent, and a fluorine-containing compound may be added to the composition containing the specific charge transporting material (a) in order to adjust the film forming property, flexibility, lubricity, and adhesion of the surface protection layer, for example. Specific examples of these additives include various silane coupling agents and commercially available silicone hard coating agents.

Examples of the silane coupling agent include vinyltrichlorosilane, vinyltrimethoxysilane, vinyltriethoxysilane, γ-glycidoxypropylmethyldiethoxysilane, γ-glycidoxypropyltrimethoxysilane, γ-aminopropyltriethoxysilane, γ-aminopropyltrimethoxysilane, γ-aminopropylmethyldimethoxysilane, N-β(aminoethyl)γ-aminopropyltriethoxysilane, tetramethoxysilane, methyltrimethoxysilane, and dimethyldimethoxysilane.

Examples of the commercially available hard coating agents include KP-85, X-40-9740, and X-8239 (products up to here are produced by Shin-Etsu Chemical Co., Ltd.) and AY42-440, AY42-441, and AY49-208 (products up to here are produced by Dow Corning Toray Co., Ltd.).

In order to impart a water repelling property and the like, a fluorine-containing compound such as (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H, 1H,2H,2H-perfluoroalkyltriethoxysilane, 1H,1H,2H,2H-perfluorodecyltriethoxysilane, or 1H,1H,2H,2H-perfluorooctyltriethoxysilane may be added. Furthermore, a fluorine-containing reactive compound, such the one described in Japanese Laid Open Patent Application Publication No. 2001-166510 etc., may be added.

The amount of the silane coupling agent is not particularly limited; however, the amount of the fluorine-containing compound may be at most 0.25 times the amount of the compound not containing fluorine in terms of mass ratio.

In order to control the discharge gas resistance, mechanical strength, scratch resistance, torque reduction, and wear amount of the surface protection layer, to extend the pot life, and to control the particle dispersibility and viscosity, a resin that dissolves in alcohol may be added to the surface protection layer.

An antioxidant may be added to the surface protection layer in order to suppress deterioration of the surface protection layer by oxidizing gas such as ozone generated in the charging device. When the mechanical strength of the photoreceptor surface is increased and the service life of the photoreceptor is extended, the photoreceptor contacts the oxidizing gas for a long time, and thus a higher oxidation resistance than in the related art is desirable.

The antioxidant may be a hindered phenol or hindered amine antioxidant. Known antioxidants, such as an organic sulfur antioxidant, a phosphite antioxidant, a dithiocarbamic acid salt antioxidant, a thiourea antioxidant, and a benzimidazole antioxidant may be used. The amount of the antioxidant added relative to the total solid content in the composition for forming the surface protection layer may be 20 mass % or less or may be 10 mass % or less.

Examples of the hindered phenol antioxidants include "IRGANOX 1076", "IRGANOX 1010", "IRGANOX 1098", "IRGANOX 245", "IRGANOX 1330", "IRGANOX 3114", "IRGANOX 1076", and "3,5-di-t-butyl-4-hydroxyviphenyl".

Examples of the hindered amine antioxidants include "Sanol LS2626", "Sanol LS765", "Sanol LS770", "Sanol LS744", "Tinuvin 144", "Tinuvin 622LD", "Mark LA57", "Mark LA67", "Mark LA62", "Mark LA68", and "Mark LA63". Examples of the thioether antioxidants include "SUMILIZER TPS" and "SUMILIZER TP-D". Examples of the phosphite antioxidants include "Mark 2112", "Mark PEP-8", "Mark PEP-24G", "Mark PEP-36", "Mark 329K", and "Mark HP-10".

In order to decrease the residual potential of the surface protection layer or improve the strength of the surface protection layer, various particles may be added to the surface protection layer.

One example of the particles is silicon-containing particles. Silicon-containing particles are particles that contain silicon as a constituent element, and specific examples thereof include colloidal silica and silicone particles. The colloidal silica used as the silicon-containing particles is selected from those prepared by dispersing silica having an average particle diameter of 1 nm or more and 100 nm or less (or 10 nm or more and 30 nm or less) in an acidic or alkaline aqueous dispersing liquid or an organic solvent, such as alcohol, ketone, or ester. A commercially available colloidal silica product may also be used.

The solid content of the colloidal silica in the surface protection layer is not particularly limited. From the viewpoints of the film forming property, electrical properties, and strength, the solid content may be 0.1 mass % or more and 50 mass % or less (or 0.1 mass % or more and 30 mass % or less) with respect to the total solid content of the surface protection layer.

The silicone particles used as the silicon-containing particles are selected from silicone resin particles, silicone rubber particles, and silicone-surface-treated silica particles, and a commercially available silicone particle product is used. These silicone particles have an approximately spherical shape and have an average particle diameter of 1 nm or more and 500 nm or less, or may have an average particle diameter of 10 nm or more and 100 nm or less. The silicone particles are chemically inactive, small-diameter particles with excellent dispersibility in resins; thus, the surface properties of the photoreceptor are improved without inhibiting the crosslinking reaction. In other words, when silicone particles are substantially evenly incorporated in the crosslinked structures, the lubricity and water repellency of the photoreceptor surface are improved, and the wear resistance and the antifouling property are easily maintained.

The amount of the silicone particles contained in the surface protection layer with respect to the total solid content of the surface protection layer may be 0.1 mass % or more and 30 mass % or less or 0.5 mass % or more and 10 mass % or less.

Examples of other particles include fluorine particles such as tetraethylene fluoride, triethlyene fluoride, hexapropylene fluoride, vinyl fluoride, and vinylidene fluoride; particles formed of a resin prepared by copolymerizing a fluorine resin and a monomer having a hydroxyl group as indicated in p. 89 of "The Proceedings of the 8th Polymer Material Forum"; and semiconducting metal oxides such as ZnO—$Al_2O_3$, $SnO_2$—$Sb_2O_3$, $In_2O_3$—$SnO_2$, $ZnO_2$—$TiO_2$, ZnO—$TiO_2$, MgO—$Al_2O_3$, FeO—$TiO_2$, $TiO_2$, $SnO_2$, $In_2O_3$, ZnO, and MgO.

Among these particles, silicon-containing particles may be used.

For the same purposes, oil such as silicone oil may be added to the surface protection layer. Examples of the silicone oil include silicone oils such as dimethylpolysiloxane, diphenylpolysiloxane, and phenylmethylsiloxane; reactive silicone oils such as amino-modified polysiloxane, epoxy-modified polysiloxane, carboxyl-modified polysiloxane, carbinol-modified polysiloxane, methacryl-modified polysiloxane, mercapto-modified polysiloxane, and phenol-modified polysiloxane; cyclic dimethylcyclosiloxanes such as hexamethylcyclotrisiloxane, octamethylcyclotetrasiloxane, decamethylcyclopentasiloxane, and dodecamethylcyclohexasiloxane; cyclic methylphenylcyclosiloxanes such as 1,3,5-trimethyl-1.3.5-triphenylcyclotrisiloxane, 1,3,5,7-tetramethyl-1,3,5,7-tetraphenylcyclotetrasiloxane, and 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes such as (3,3,3-trifluoropropyl)methylcyclotrisiloxane; hydrosilyl-group-containing cyclosiloxanes such as a methylhydrosiloxane mixture, pentamethylcyclopentasiloxane, and phenylhydrocyclosiloxane; and vinyl group-containing cyclosiloxanes such as pentavinylpentamethylcyclopentasiloxane.

A metal, a metal oxide, carbon black, etc., may be added to the surface protection layer. Examples of the metal include aluminum, zinc, copper, chromium, nickel, silver, stainless steel, and plastic particles with any of these metals vapor-deposited on the surfaces. Examples of the metal oxide include zinc oxide, titanium oxide, tin oxide, antimony oxide, indium oxide, bismuth oxide, indium oxide doped with tin, tin oxide doped with antimony or tantalum, and zirconium oxide doped with antimony. These may be used alone or in combination. When two or more of these materials are used in combination, they may be simply mixed or may take a form of solid solution or fusion. The average particle diameter of the conductive particles may be 0.3 μm or less, and in particular, may be 0.1 μm or less from the viewpoint of transparency of the protection layer.

The metal oxide particles may be surface-treated with a silane coupling agent. An example of the silane coupling agent is a silane coupling agent that has at least one group selected from an acryloyl group, a methacryloyl group, and an amino group in the molecular structure.

The composition that contains the specific charge transporting material (a) and is used for forming the surface protection layer may be prepared as a surface-protection-layer-forming solution.

The surface-protection-layer-forming solution may be free of any solvent, or may be prepared by using a single solvent or a mixture of solvents, if needed. Examples of the solvents include aromatic solvents such as toluene and xylene, ketone solvents such as methyl ethyl ketone, methyl isobutyl ketone, and cyclohexanone, ester solvents such as ethyl acetate and butyl acetate, ether solvents such as tetrahydrofuran and dioxane, cellosolve solvents such as ethylene glycol monomethyl ether, and alcohol solvents such as isopropyl alcohol and butanol.

In order to obtain a solution by reacting the aforementioned components, the components may be simply mixed and dissolved. However, heating may be conducted under the conditions of room temperature or higher and 100° C. or lower or 30° C. or higher and 80° C. or lower for 10 minutes or more and 100 hours or less or 1 hour or more and 50 hours or less. During this process, ultrasonic waves may be applied.

The surface protection layer-forming solution composed of a composition containing the specific charge transporting material (a) is applied to the charge transporting layer, which forms the surface to be coated, by a common method, such as a blade coating method, a wire bar coating method, a spray coating method, a dip coating method, a bead coating method, an air knife coating method, or a curtain coating method.

Then the obtained film is heated so as to induce radical polymerization, and as a result, the film is polymerized and cured.

When the film is to be polymerized and cured by heating, the heating condition may be 50° C. or higher. The service life of the cured film is short when the temperature is lower than this temperature. In particular, the heating temperature may be 100° C. or higher and 170° C. or lower from the viewpoints of strength, electrical properties, and surface properties of the cured film.

The polymerization and curing reaction described above may be performed in vacuum or a low-oxygen-concentration atmosphere, such as an inert gas atmosphere, so that the chain reaction proceeds without deactivation of the radicals generated by heat. The oxygen concentration may be 10% or less, may be 5% or less, may be 2% or less, or may be 500 ppm or less.

In the description above, the cured product (cured film) of the composition containing a compound having at least one of an acryloyl group and a methacryloyl group is described through an example of the cured product composed of the composition containing the specific charge transporting material (a), but is not limited to this.

Another example is a cured product of a composition containing a compound that has at least one of an acryloyl group and a methacryloyl group but has no charge transporting skeleton in the same molecule. In this case, the cured product may be a cured product of a composition containing a compound that has at least one of an acryloyl group and a methacryloyl group but has no charge transporting skeleton in the same molecule, a non-reactive charge transporting material, and various particles (metal particles, metal oxide particles, resin particles, silicon-containing particles, or the like).

Examples of the compound that has at least one of an acryloyl group and a methacryloyl group but has no charge transporting property include the same compounds as the monofunctional or higher functional monomers, oligomers, and polymers of acrylate or methacrylate described above.

Examples of the non-reactive charge transporting material include known charge transporting materials.

The particles are preferably at least one selected from the metal particles, the metal oxide particles, the resin particles, and the silicon-containing particles described above. Specific examples thereof are the same various particles described above. When metal oxide particles are to be contained, the metal oxide particles may be surface-treated with a coupling agent. For example, metal oxide particles surface-treated with a silane coupling agent having at least one of an acryloyl group and a methacryloyl group may be used.

The thickness of the protection layer is set within the range of, for example, 1 μm or more and 20 μm or less, or within the range of 2 μm or more and 10 μm or less.

Hardness of the Surface Protection Layer and Photosensitive Layer

The hardness (Martens hardness) of the surface protection layer in the photoreceptor of this exemplary embodiment may be 20 $mN/mm^2$ or more and 90 $mN/mm^2$ or less, 30 $mN/mm^2$ or more and 80 $mN/mm^2$ or less, or 40 $mN/mm^2$ or more and 70 $mN/mm^2$ or less in order to stabilize the contact posture of the cleaning blade with respect to the photoreceptor surface and facilitate suppression of filming.

The hardness (Martens hardness) of a surface (a surface on the side close to the surface protection layer) of the photosensitive layer in the photoreceptor may be 1 $mN/mm^2$ or more and 19 $mN/mm^2$ or less, or 2 $mN/mm^2$ or more and 10 $mN/mm^2$ or less in order to facilitate suppression of cracking of the surface protection layer.

The Martens hardness is measured with a micro hardness meter (tradename: PICODENTER HM500 produced by Fischer Instruments K.K.) based on the load (mN) observed when indentation is made to a depth of 1 μm.

The Martens hardness is measured at 5 points in the measurement sample to obtain an average value.

Environmental conditions: 23° C., 55% RH, Indenter used: diamond regular three-sided pyramid indenter with a 1150 angle between faces.

The Martens hardness of a surface of the photosensitive layer, the surface being on the side close to the surface protection layer, is measured by removing the surface protection layer from the photoreceptor and exposing the photosensitive layer. However, when the surface protection layer is difficult to remove, etc., a measurement sample composed of the same material as the outermost layer of the photosensitive layer, the outermost layer being on the side close to the surface protection layer, may be separately prepared, and the hardness of this measurement sample may be measured.

The Martens hardness of the surface protection layer is measured by directly measuring the surface of the surface protection layer, which constitutes the outermost surface of the photoreceptor. However, when the thickness of the surface protection layer is small and the hardness of the photosensitive layer underneath affects the measurement value, etc., a measurement sample composed of the same material as the surface protection layer may be separately prepared, and the hardness of this measurement sample may be measured.

Single-Layer-Type Photosensitive Layer

The single-layer-type photosensitive layer (charge generating/charge transporting layer) is, for example, a layer that contains a charge generating material, a charge transporting material, and, if needed, a binder resin and other known additives. These materials are the same as those described for the charge generating layer and the charge transporting layer.

The amount of the charge generating material contained in the single-layer-type photosensitive layer relative to the total solid content may be 0.1 mass % or more and 10 mass % or less, or may be 0.8 mass % or more and 5 mass % or less. The amount of the charge transporting material contained in the single-layer-type photosensitive layer relative to the total solid content may be 5 mass % or more and 50 mass % or less.

The method for forming the single-layer-type photosensitive layer is the same as the method for forming the charge generating layer or the charge transporting layer.

The thickness of the single-layer-type photosensitive layer is, for example, 5 μm or more and 50 μm or less or may be 10 μm or more and 40 μm or less.

Charging Device

The charging device 15 charges the surface of the photoreceptor 12. The charging device 15 is equipped with a charging member 14 that is in contact or non-contact with the surface of the photoreceptor 12 and that charges the surface of the photoreceptor 12; and a power supply 28 (one example of the voltage applying portion for the charging member) that applies a charging voltage to the charging member 14. The power supply 28 is electrically coupled to the charging member 14.

Examples of the charging member 14 of the charging device 15 include contact-type chargers such as conductive charging rollers, charging brushes, charging films, charging rubber blades, and charging tubes. Other examples of the charging member 14 include known chargers such as non-contact-type roller chargers, and scorotron charges and corotron chargers that utilize corona discharge.

Electrostatic Image-Forming Device

The electrostatic image-forming device 16 forms an electrostatic image on the charged surface of the photoreceptor 12. Specifically, for example, the electrostatic image-forming device 16 applies, to the surface of the photoreceptor 12 charged by the charging member 14, light L modified on the basis of the image information of the image to be formed so as to form an electrostatic image corresponding to the image of the image information on the photoreceptor 12.

An example of the electrostatic image-forming device 16 is an optical device that has a light source that can apply light, such as semiconductor laser light, LED light, or liquid crystal shutter light, into an image shape.

Developing Device

The developing device 18 is, for example, disposed downstream of the position irradiated with light L from the electrostatic image-forming device 16 in the rotation direction of the photoreceptor 12. A container that contains a developer is installed in the developing device 18. The container contains an electrostatic image developer that contains a specific toner. The toner in a charged state is, for example, contained in the developing device 18.

The developing device 18 is equipped with a developing member 18A that develops the electrostatic image on the surface of the photoreceptor 12 by using a toner-containing developer, and a power supply 32 that applies a developing voltage to the developing member 18A. The developing member 18A is, for example, electrically coupled to the power supply 32.

The developing member 18A of the developing device 18 is selected according to the type of the developer, and an example thereof is a developing roller that has a developing sleeve with a built-in magnet.

The developing device 18 (including the power supply 32) is electrically coupled to the control device 36 in the image forming apparatus 10, and is driven and controlled by the control device 36 so as to apply the developing voltage to the developing member 18A. The developing member 18A to which the developing voltage is applied is charged to the developing potential corresponding to the developing voltage. The developing member 18A charged to the charging potential retains, on the surface thereof, the developer contained in the developing device 18 and supplies the toner contained in the developer from the inside of the developing device 18 to the surface of the photoreceptor 12. The electrostatic image formed on the surface of the photoreceptor 12 supplied with the toner is developed into a toner image.

Transfer Device

The transfer device 31 is, for example, disposed downstream of the position where the developing member 18A is installed in the rotation direction of the photoreceptor 12. The transfer device 31 is equipped with, for example, a transfer member 20 that transfers the toner image on the surface of the photoreceptor 12 onto a recording medium 30A, and a power supply 30 that applies a transfer voltage to the transfer member 20. The transfer member 20 has, for example, a cylindrical shape, and the recording medium 30A is sandwiched between the transfer member 20 and the photoreceptor 12 and carried. The transfer member 20 is, for example, electrically coupled to the power supply 30.

Examples of the transfer member 20 include contact-type transfer chargers that use belts, rollers, films, rubber cleaning blades, etc., and known non-contact-type transfer chargers such as scorotron transfer chargers and corotron transfer chargers that utilize corona discharge.

The transfer device 31 (including the power supply 30) is, for example, electrically coupled to the control device 36 in the image forming apparatus 10, and is driven and controlled by the control device 36 so as to apply the transfer voltage to the transfer member 20. The transfer member 20 to which the transfer voltage is applied is charged to the transfer potential corresponding to the transfer voltage.

When the transfer voltage, which has an opposite polarity from the toner constituting the toner image on the photoreceptor 12, is applied from the power supply 30 of the transfer member 20 to the transfer member 20, for example, a transfer electric field intense enough to electrostatically transfer the toner constituting the toner image from the photoreceptor 12 to the transfer member 20 side is formed in a region where the photoreceptor 12 and the transfer member 20 oppose each other (refer to the transfer region 32A illustrated in FIG. 1).

The recording medium 30A is, for example, contained in the container (not illustrated in the drawing), is fed along a feed path 34 by multiple feeding members (not illustrated in the drawing), and reaches the transfer region 32A, which is the region where the photoreceptor 12 and the transfer member 20 oppose each other. In the example illustrated in FIG. 1, the recording medium is fed in the arrow B direction. When the recording medium 30A arrives at the transfer region 32A, for example, the toner image on the photoreceptor 12 is transferred onto the recording medium 30A by the transfer electric field formed in the region by applying the transfer voltage to the transfer member 20. In other words, the toner image is transferred onto the recording medium 30A as the toner moves from the surface of the photoreceptor 12 to the recording medium 30A. As a result, the toner image on the photoreceptor 12 is transferred onto the recording medium 30A by the transfer electric field.

Cleaning Device

The cleaning device 22 is disposed downstream of the transfer region 32A in the rotation direction of the photoreceptor 12. After the toner image is transferred onto the recording medium 30A, the cleaning device 22 cleans the residual toner attached to the photoreceptor 12. The cleaning device 22 also cleans the attaching matters, such as paper powder, in addition to the residual toner.

The cleaning device 22 is equipped with a cleaning blade 220, and the attaching matters on the surface of the photoreceptor 12 are removed by orienting the tip of the cleaning blade 220 in a direction that opposes the rotation direction of the photoreceptor 12 and bringing the tip into contact with the surface.

The cleaning device 22 will now be described with reference to FIG. 4.

Figure 4:
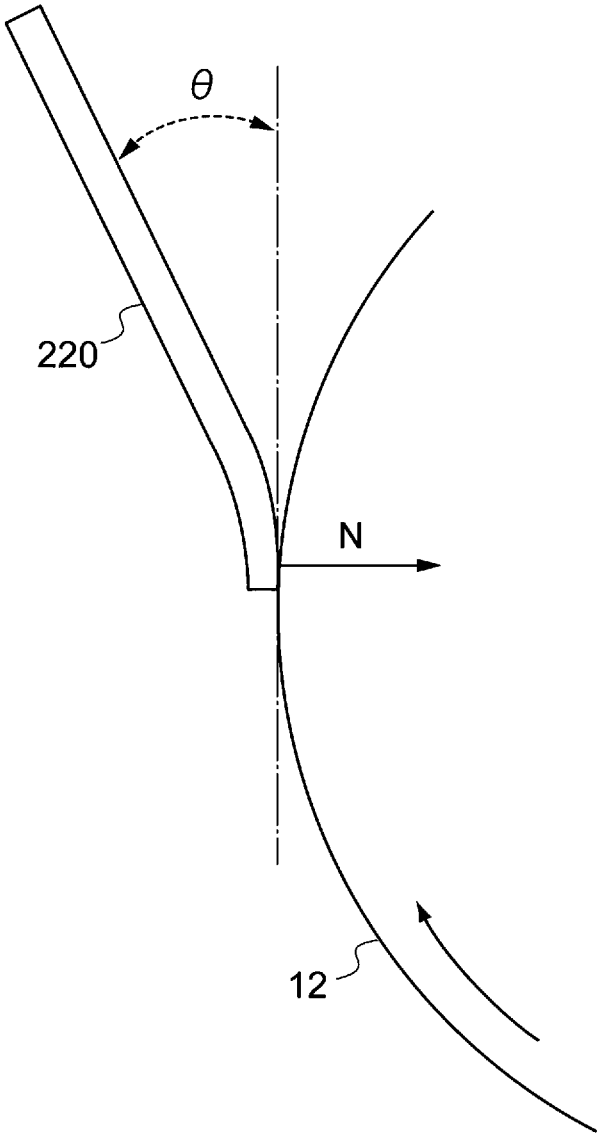
FIG. 4 is an enlarged view taken at a position where a cleaning blade contacts a photoreceptor in the image forming apparatus illustrated in FIG. 1.

FIG. 4 is a schematic diagram illustrating the arrangement of installing the cleaning blade 220 in the cleaning device 22 illustrated in FIG. 1.

As illustrated in FIG. 4, the tip of the cleaning blade 220 is oriented in a direction opposing the rotation direction (arrow direction) of the photoreceptor 12, and contacts the surface of the photoreceptor 12 while maintaining such a state.

The angle θ between the cleaning blade 220 and the photoreceptor 12 may be set to 50 or more and 35° or less, or may be set to 100 or more and 25° or less.

The pressure N from the cleaning blade 220 against the photoreceptor 12 may be set to 0.6 gf/mm$^2$ or more and 6.0 gf/mm$^2$ or less.

Specifically, the angle θ refers to, as illustrated in FIG. 4, the angle formed between a non-deformed part of the cleaning blade 220 and the tangent line (a dotted chain line in FIG. 4) at the contact portion between the tip of the cleaning blade 220 and the photoreceptor 12.

The pressure N is, as illustrated in FIG. 4, the pressure (gf/mm$^2$) that works toward the center of the photoreceptor 12 at the position where the cleaning blade 220 contacts the photoreceptor 12.

In this exemplary embodiment, the cleaning blade 220 is an elastic plate-shaped object. Examples of the material constituting the cleaning blade 220 include elastic materials such as silicone rubber, fluororubber, ethylene-propylene-diene rubber, and polyurethane rubber. Among these, polyurethane rubber, which has excellent mechanical properties such as wear resistance, chipping resistance, and creeping resistance, may be used.

A support member (not illustrated in FIG. 4) is joined to a surface of the cleaning blade 220 opposite of the surface in contact with the photoreceptor 12, and the cleaning blade 220 is supported by this support member. The support member presses the cleaning blade 220 against the photoreceptor 12 at the above-described pressure. The support member may be formed of a metal material, such as aluminum or stainless steel. An adhesive layer formed of an adhesive or the like may be provided between the support member and the cleaning blade 220 so as to bond the support member and the cleaning blade 220.

The cleaning device may also be equipped with known parts in addition to the cleaning blade 220 and the support member that supports the cleaning blade 220.

Charge Erasing Device

The charge erasing device 24 is disposed downstream of the cleaning device 22 in the rotation direction of the photoreceptor 12. The change erasing device 24 erases the charges on the surface of the photoreceptor 12 by exposure after the transfer of the toner image. Specifically, for example, the charge erasing device 24 is electrically coupled to the control device 36 in the image forming apparatus 10, and is driven and controlled by the control device 36 so as to expose the entire surface (the entire surface in the image-forming region, for example, to be specific) of the photoreceptor 12 to erase the charges.

Examples of the charge erasing device 24 include devices equipped with light sources such as tungsten lamps that emit white light, and light-emitting diodes (LEDs) that emit red light.

Fixing Device

The fixing device 26 is disposed downstream of the transfer region 32A in the feeding direction of the feed path 34 of the recording medium 30A. The fixing device 26 is equipped with the fixing member 26A and a pressurizing member 26B in contact with the fixing member 26A. The toner image transferred onto the recording medium 30A is fixed in the contact portion between the fixing member 26A and the pressurizing member 26B. Specifically, for example, the fixing device 26 is electrically coupled to the control device 36 in the image forming apparatus 10, and is driven and controlled by the control device 36 so as to fix the toner image on the recording medium 30A by heat and pressure.

Examples of the fixing device 26 include known fixers, such as a thermal roller fixer and an oven fixer.

Specifically, for example, a known fixing device equipped with a fixing roller or a belt serving as the fixing member 26A and a pressurizing roller or belt serving as the pressurizing member 26B is used as the fixing device 26.

Here, the recording medium 30A having a toner image transferred thereon while the recording medium 30A is fed along the feed path 34 and passes through the region (transfer region 32A) where the photoreceptor 12 and the transfer member 20 oppose each other is carried by a feeding member (not illustrated) along the feed path 34 to a position where the fixing device 26 is installed, and then the toner image on the recording medium 30A is fixed.

The recording medium 30A having an image formed thereon as a result of fixing of the toner image is discharged to the outside of the image forming apparatus 10 by multiple feeding members not illustrated in the drawings. The photoreceptor 12 is again charged to the charging potential by the charging device 15 after the charges are erased by the charge erasing device 24.

Operation of Image Forming Apparatus

An example of the operations of the image forming apparatus 10 according to the exemplary embodiment will now be described. The operations of the image forming apparatus 10 are carried out by a control program executed in the control device 36.

An image forming operation of the image forming apparatus 10 will now be described.

First, the surface of the photoreceptor 12 is charged by the charging device 15. The electrostatic image-forming device 16 exposes the charged surface of the photoreceptor 12 on the basis of the image information. As a result, an electrostatic image corresponding to the image information is formed on the photoreceptor 12. In the developing device 18, the electrostatic image on the surface of the photoreceptor 12 is developed by the specific-toner-containing developer. As a result, a toner image is formed on the surface of the photoreceptor 12.

In the transfer device 31, the toner image on the photoreceptor 12 is transferred onto the recording medium 30A. The toner image transferred to the recording medium 30A is fixed by the fixing device 26.

Meanwhile, the surface of the photoreceptor 12 after the transfer of the toner image is cleaned by the cleaning blade 220 of the cleaning device 22, and then charges are erased by the charge erasing device 24.

Electrostatic Image Developer

Next, the electrostatic image developer contained in the developing unit of the image forming apparatus of the exemplary embodiment (hereinafter, may be referred to as the "electrostatic image developer of the exemplary embodiment") is described in detail.

The electrostatic image developer of the exemplary embodiment contains at least a toner.

The electrostatic image developer of the exemplary embodiment may be a one-component developer that contains only a toner or a two-component developer that contains a toner and a carrier.

Toner

The toner includes toner particles. The toner may include an external additive in addition to the toner particles.

Toner Particles

The toner particles contain, for example, a binder resin. The toner particles may further contain a coloring agent, a releasing agent, and other additives.

Binder Resin

An amorphous polyester resin is used as the binder resin.

The amorphous resin refers to a resin that has no clear endothermic peak in thermal analysis by differential scanning calorimetry (DSC), but only step-wise endothermic changes, is solid at room temperature, and becomes thermoplastic at a temperature equal to or higher than the glass transition temperature.

In contrast, a crystalline resin refers to a resin that has a clear endothermic peak instead of step-wise endothermic changes in differential scanning calorimetry (DSC).

Specifically, for example, a crystalline resin refers to a resin that has an endothermic peak half-width of 10° C. or lower when measured at a heating rate of 10° C./min, and an amorphous resin refers to a resin that has a half-width exceeding 10° C. or has no clear endothermic peak.

Examples of the amorphous polyester resin include polycondensation products between polyvalent carboxylic acids and polyhydric alcohols. The amorphous polyester resin may be a commercially available product or may be synthesized and used.

Examples of the polyvalent carboxylic acid include aliphatic dicarboxylic acids (for example, oxalic acid, malonic acid, maleic acid, fumaric acid, citraconic acid, itaconic acid, glutaconic acid, succinic acid, alkenylsuccinic acid, adipic acid, and sebacic acid), alicyclic dicarboxylic acids (for example, cyclohexanedicarboxylic acid), aromatic dicarboxylic acids (for example, terephthalic acid, isophthalic acid, phthalic acid, and naphthalene dicarboxylic acid), anhydrides thereof, and lower (for example, having 1 to 5 carbon atoms) alkyl esters thereof. Among these, aromatic dicarboxylic acids may be used as the polyvalent carboxylic acid.

For the polyvalent carboxylic acids, a trivalent or higher carboxylic acid that has a crosslinked structure or a branched structure may be used in combination with a dicarboxylic acid. Examples of the trivalent or higher carboxylic acids include trimellitic acid, pyromellitic acid, anhydrides thereof, and lower (for example, having 1 to 5 carbon atoms) alkyl esters thereof.

The polyvalent carboxylic acids may be used alone or in combination.

Examples of the polyhydric alcohol include aliphatic diols (for example, ethylene glycol, diethylene glycol, triethylene glycol, propylene glycol, butanediol, hexanediol, and neopentyl glycol), alicyclic diols (for example, cyclohexanediol, cyclohexanedimethanol, and hydrogenated bisphenol A), and aromatic diols (for example, an ethylene oxide adduct of bisphenol A and a propylene oxide adduct of bisphenol A). Among these, aromatic diols and alicyclic diols may be used as the polyhydric alcohol. Aromatic diols are more preferable.

For the polyhydric alcohols, a trihydric or higher alcohol that has a crosslinked structure or a branched structure may be used in combination with a diol. Examples of the trihydric or higher alcohols include glycerin, trimethylolpropane, and pentaerythritol.

The polyhydric alcohols may be used alone or in combination.

However, no or very little, if any, alkylene oxide adduct of bisphenol A (an ethylene oxide adduct of bisphenol A, a propylene oxide adduct of bisphenol A, an ethylene oxide propylene oxide adduct of bisphenol A, or the like) is to be used as the polyhydric alcohol. Specifically, when an alkylene oxide adduct of bisphenol A is to be used, the amount thereof may be more than 0 mol % but not more than 5 mol % relative to the total amount of the polyhydric alcohols.

The glass transition temperature (Tg) of the amorphous polyester resin may be 50° C. or higher and 80° C. or lower or may be 50° C. or higher and 65° C. or lower.

The glass transition temperature is determined from a DSC curve obtained by differential scanning calorimetry (DSC). More specifically, the glass transition temperature is determined by the method described in "Extrapolated glass transition start temperature", which is one method for determining the glass transition temperature in JIS K7121-1987 "Testing Methods for Transition Temperatures of Plastics".

The weight-average molecular weight (Mw) of the amorphous polyester resin may be 5,000 or more and 1,000,000 or less, may be 7,000 or more and 500,000 or less, or may be 30,000 or more and 50,000 or less.

The number-average molecular weight (Mn) of the amorphous polyester resin may be 2,000 or more and 100,000 or less.

The molecular weight distribution Mw/Mn of the amorphous polyester resin may be 1.5 or more and 100 or less or may be 2 or more and 60 or less.

The weight-average molecular weight and the number-average molecular weight are measured by gel permeation chromatography (GPC). The molecular weight measurement by GPC is conducted by using GPC-HLC-8120GPC produced by TOSOH CORPORATION as a measuring instrument with columns, TSKgel Super HM-M (15 cm) produced by TOSOH CORPORATION, and a THF solvent. The weight-average molecular weight and the number-average molecular weight are calculated from the measurement results by using the molecular weight calibration curves obtained from monodisperse polystyrene standard samples.

The amorphous polyester resin is obtained by a known production method. Specifically, for example, the amorphous polyester resin is obtained by setting the polymerization temperature to 180° C. or higher and 230° C. or lower, decreasing the pressure in the reaction system as necessary, and performing reaction while removing water and alcohol generated during condensation.

When the monomers used as the raw materials do not dissolve or are not compatible with each other at a reaction temperature, a solvent having a high boiling point may be added as a dissolving aid to dissolve the monomers. In this case, the polycondensation reaction is performed while distilling away the dissolving aid. When monomers poorly compatible with each other are present, the poorly compatible monomer and an acid or alcohol to be subjected to polycondensation with that monomer may be preliminarily condensed, and then the resulting product may be subjected to polycondensation with the main component.

The amount of the amorphous polyester resin in terms of a fraction relative to the total amount of the binder resin may be 60 mass % or more and 98 mass % or less, may be 70 mass % or more and 98 mass % or less, or may be 80 mass % or more and 98 mass % or less.

Here, a crystalline resin may be used in combination with the amorphous polyester resin. When a crystalline resin is used in combination, the hygroscopic property of the toner particles is decreased, and occurrence of filming is easily suppressed. However, the amount of the crystalline polyester resin relative to all binder resins may be in the range of 2 mass % or more and 40 mass % or less (or 2 mass % or more and 20 mass % or less).

Examples of the crystalline resin include known crystalline resins such as crystalline polyester resins and crystalline vinyl resins (for example, polyalkylene resins and long-chain alkyl (meth)acrylate resins). Among these, from the viewpoint of suppressing the occurrence of filming, crystalline polyester resins may be used.

An example of the crystalline polyester resin is a polycondensation product of a polyvalent carboxylic acid and a polyhydric alcohol. The crystalline polyester resin may be a commercially available product or may be synthesized and used.

Here, in order to easily form the crystal structure, the crystalline polyester resin may be a polycondensation product prepared by using a polymerizable monomer having a straight-chain aliphatic rather than a polymerizable monomer having an aromatic.

Examples of the polyvalent carboxylic acids include aliphatic dicarboxylic acids (for example, oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (for example, dibasic acids such as phthalic acid, isophthalic acid, terephthalic acid, and naphthalene-2,6-dicarboxylic acid), anhydrides thereof, and lower (for example, having 1 to 5 carbon atoms) alkyl esters thereof.

For the polyvalent carboxylic acids, a trivalent or higher carboxylic acid that has a crosslinked structure or a branched structure may be used in combination with a dicarboxylic acid. Examples of the trivalent carboxylic acids include aromatic carboxylic acids (for example, 1,2,3-benzenetricarboxylic acid, 1,2,4-benzenetricarboxylic acid, and 1,2,4-naphthalenetricarboxylic acid), anhydrides thereof, and lower (for example, having 1 to 5 carbon atoms) alkyl esters thereof.

For the polyvalent carboxylic acids, a dicarboxylic acid having a sulfonic acid group or a dicarboxylic acid having an ethylenic double bond may be used in combination with these dicarboxylic acids.

The polyvalent carboxylic acids may be used alone or in combination.

Examples of the polyhydric alcohol include aliphatic diols (for example, straight-chain aliphatic diols having a main chain containing 7 or more and 20 or less carbon atoms). Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these, 1,8-octanediol, 1,9-nonanediol, and 1,10-decanediol are preferable.

For the polyhydric alcohols, a trihydric or higher alcohol that has a crosslinked structure or a branched structure may be used in combination with a diol. Examples of the trihydric or higher alcohols include glycerin, trimethylolpropane, trimethylol propane, and pentaerythritol.

The polyhydric alcohols may be used alone or in combination.

The polyhydric alcohol may contain 80 mol % or more or 90 mol % or more of the aliphatic diol.

The melting temperature of the crystalline polyester resin may be 50° C. or higher and 100° C. or lower, may be 55° C. or higher and 90° C. or lower, or may be 60° C. or higher and 85° C. or lower.

The melting temperature is determined from the DSC curve obtained by differential scanning calorimetry (DSC) by the method described in "Melting peak temperature", which is one method for determining the melting temperature in JIS K7121-1987 "Testing Methods for Transition Temperatures of Plastics".

The weight-average molecular weight (Mw) of the crystalline polyester resin may be 6,000 or more and 35,000 or less.

The crystalline polyester resin is obtained by a known production method as with the amorphous polyester resin, for example.

The amount of the crystalline resin (preferably a crystalline polyester resin) contained relative to the total amount of the toner may be 3 mass % or more and 20 mass % or less or may be 5 mass % or more and 15 mass % or less, or about 3 mass % or more and about 20 mass % or less or may be about 5 mass % or more and about 15 mass % or less. When the amount of the crystalline resin contained is within the above-described range, occurrence of filming is easily suppressed.

An additional binder resin other than the amorphous polyester resin and the crystalline resin may also be used in combination as the binder resin. However, the amount of the additional binder resin contained may be 10 mass % or less in terms of the fraction relative to all binder resins.

Examples of the additional binder resin include vinyl resins such as homopolymers of monomers such as styrenes (for example, styrene, parachlorostyrene, and α-methyl styrene), (meth)acrylates (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (for example, acrylonitrile and methacrylonitrile), vinyl ethers (for example, vinyl methyl ether and vinyl isobutyl ether), vinyl ketones (vinyl methyl ketone, vinyl ethyl ketone, and vinyl isopropenyl ketone), and olefins (for example, ethylene, propylene, and butadiene); and copolymers of two or more of these monomers.

Other examples of the additional binder resin include non-vinyl resins such as epoxy resins, polyurethane resins, polyamide resins, cellulose resins, polyether resins, and modified rosin; mixtures of the non-vinyl resins and the vinyl resins; and graft polymers obtained by polymerizing vinyl monomers in the presence of the non-vinyl resins.

The amount of the binder resin relative to the entire toner particles may be 40 mass % or more and 95 mass % or less, may be 50 mass % or more and 90 mass % or less, or may be 60 mass % or more and 85 mass % or less.

Coloring Agent

Examples of the coloring agent include pigments such as carbon black, chrome yellow, hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, dupont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, and malachite green oxalate; and dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

These coloring agents may be used alone or in combination.

The coloring agent may be a surface-treated coloring agent or may be used in combination with a dispersing agent, if needed. Two or more coloring agents may be used in combination.

The amount of the coloring agents relative to the entire toner particles may be 1 mass % or more and 30 mass % or less or may be 3 mass % or more and 15 mass % or less.

Releasing Agent

Examples of the releasing agent include, but are not limited to, hydrocarbon wax; natural wax such as carnauba wax, rice wax, and candelilla wax; synthetic or mineral or petroleum wax such as montan wax; and ester wax such as fatty acid esters and montanic acid esters.

The melting temperature of the releasing agent may be 50° C. or higher and 110° C. or lower or may be 60° C. or higher and 100° C. or lower.

The melting temperature is determined from the DSC curve obtained by differential scanning calorimetry (DSC) by the method described in "Melting peak temperature", which is one method for determining the melting temperature in JIS K7121-1987 "Testing Methods for Transition Temperatures of Plastics".

The amount of the releasing agent relative to the entire toner particles may be 1 mass % or more and 20 mass % or less or may be 5 mass % or more and 15 mass % or less.

Other Additives

Examples of other additives include known additives such as magnetic materials, charge controllers, and inorganic powder. These additives are internal additives and contained inside the toner particles.

Properties, Etc., of Toner Particles

The ratio of the absorbance for a wavelength of 1500 $cm^{-1}$ to the absorbance for a wavelength of 720 $cm^{-1}$ in infrared absorption spectrum analysis of the toner particles is 0.6 or less (or may be 0.5 or less or about 0.5 or less, or may be 0.48 or less), and the ratio of the absorbance for a wavelength of 820 $cm^{-1}$ to the absorbance for a wavelength of 720 $cm^{-1}$ is 0.4 or less or about 0.4 or less (or may be 0.3 or less or may be 0.2 or less).

As described above, when no or little, if any, alkylene oxide adduct of bisphenol A is contained in the polyhydric alcohol component in the amorphous polyester resin serving as a binder resin, the toner particles have such infrared absorption spectral characteristics.

Meanwhile, from the viewpoint of the toner storage stability, the ratio of the absorbance for a wavelength of 1500 $cm^{-1}$ to the absorbance for a wavelength of 720 $cm^{-1}$ in infrared absorption spectrum analysis of the toner particles may be 0.2 or more (or 0.3 or more), and the ratio of the absorbance for a wavelength of 820 $cm^{-1}$ to the absorbance for a wavelength of 720 $cm^{-1}$ may be 0.05 or more (or 0.08 or more).

From the viewpoint of the strength of the toner particles, the ratio of the absorbance for a wavelength of 820 $cm^{-1}$ to the absorbance for a wavelength of 1500 $cm^{-1}$ in infrared absorption spectrum analysis of the toner particles may be 0.5 or less (or 0.4 or less, or 0.35 or less).

Meanwhile, from the viewpoint of the toner storage stability, the ratio of the absorbance for a wavelength of 820 $cm^{-1}$ to the absorbance for a wavelength of 1500 $cm^{-1}$ in infrared absorption spectrum analysis of the toner particles may be 0.1 or more (or 0.15 or more).

The absorbance for each wavelength measured by infrared absorption spectrum analysis is measured by the following procedure. First, a measurement sample is prepared by a KBr tablet method from toner particles (or toner) to be measured. The measurement sample is analyzed with an infrared spectrophotometer (FT-IR-410 produced by JASCO Corporation) under the conditions of a number of scans of 300 and resolution of 4 $cm^{-1}$ within a wavenumber range of 500 $cm^{-1}$ or more and 4000 $cm^{-1}$ or less. Then the baseline correction is performed in an offset portion where absorbed light is absent, and the absorbance for each wavelength is determined.

When the weight-average molecular weight and the number-average molecular weight in the GPC measurement of the THF-soluble component in the toner particles are respectively assumed to be Mw and Mn, Mw is 25,000 or more and 60,000 or less (preferably 30,000 or more and 50,000 or less and more preferably 32,000 or more and 48,000 or less), and Mw/Mn is 5 or more and 10 or less (preferably 6 or more and 8 or less and more preferably 6.2 or more and 7.8 or less). As described above, when the toner particles satisfy the aforementioned molecular weight properties, fixability of the fixed image is improved even when a toner, which contains toner particles containing an amorphous polyester resin that uses no or little, if any, alkylene oxide adduct of bisphenol A, is used.

The peak molecular weight of the molecular weight distribution curve obtained by the GPC measurement of the THF-soluble component in the toner particles may be 7,000 or more and 11,000 or less, may be 8,000 or more and 11,000 or less, or may be 8,200 or more and 10,500 or less.

When the peak molecular weight is within the aforementioned range, fixability of the fixed image is improved even when a toner, which contains toner particles containing an amorphous polyester resin that uses no or little, if any, alkylene oxide adduct of bisphenol A, is used.

The peak molecular weight of the molecular weight distribution curve obtained by GPC measurement of the THF-soluble component in the toner particles refers to the molecular weight of the largest peak among multiple peaks in the molecular weight distribution curve.

The molecular weight distribution curve, the average molecular weights, and the peak molecular weight in the GPC measurement of the THF-soluble component in the toner particles are measured as follows.

First, 0.5 mg of toner particles (or toner) to be measured are dissolved in 1 g of tetrahydrofuran (THF). The resulting mixture is ultrasonically dispersed and adjusted to have a concentration of 0.5%. The dissolved components are then measured by GPC.

As a GPC system, "HLC-8120GPC, SC-8020 (product of TOSOH CORPORATION)" is used. Two columns, "TSK-gel, SuperHM-H (product of TOSOH CORPORATION, 6.0 mm ID×15 cm)" are used. THF is used as an eluent. Experimental conditions are sample concentration: 0.5%, flow rate: 0.6 ml/min, sample injection amount: 10 μl, measurement temperature: 40° C., and experiments are conducted by using a refractive index (RI) detector. The calibration curves are prepared from ten samples of "polystyrene standard samples, TSK standard": "A-500", "F-1", "F-10", "F-80", "F-380", "A-2500", "F-4", "F-40", "F-128", and "F-700".

The amount of the toluene-insoluble component in the toner particles may be 25 mass % or more and 45 mass % or less, may be 28 mass % or more and 38 mass % or less, or may be 30 mass % or more and 35 mass % or less.

When the amount of the toluene-insoluble component in the toner particles is within the above-described range, the hygroscopic property of the toner particles is decreased, and occurrence of filming is easily suppressed.

Here, the toluene-insoluble component in the toner particles refers to a constituent component in the toner particles that is insoluble in toluene. In other words, the toluene insoluble is an insoluble component that is mainly (for example, 50 mass % or more of the entirety) composed of toluene-insoluble components in the binder resin (in particular, high-molecular-weight components in the binder resin). The amount of the toluene-insoluble component is regarded as the indicator of the amount of the crosslinked resin contained in the toner.

The amount of the toluene-insoluble component is the value measured by the following procedure.

Into a glass fiber cylindrical filter paper weighed, 1 g of toner particles (or toner) weighed are placed, and the filter paper is loaded in an extractor tube of a heating-type Soxhlet extractor. Toluene is injected to a flask and heated to 110° C. with a heating mantle. A heater attached to the extraction tube is used to heat the periphery of the extraction tube to 125° C. Extraction is performed at a reflux rate such that one extraction cycle lasts 4 minutes or longer but 5 minutes or shorter. After extracting for 10 hours, the cylindrical filter paper and the toner residue are discharged, dried, and weighed.

Then the amount (mass %) of the toner particle (or toner) residue is calculated from the formula: amount of toner particle (or toner) residue (mass %)=[(weight of cylindrical filter paper+amount of toner residue) (g)−weight of cylindrical filter paper (g)]÷mass (g) of toner particles (or toner)×100, and this amount of the toner particle (or toner) residue is assumed to be the amount (mass %) of the toluene-insoluble component.

The toner particle (or toner) residue is composed of inorganic matters, such as a coloring agent, external additives, high-molecular-weight components of the binder resin, etc. When the toner particles contain a releasing agent, the releasing agent constitutes the toluene-soluble component since extraction is performed under heating.

The amount of the toluene insoluble in the toner particles can be adjusted by, for example, the following methods: 1) a method involving adding a crosslinking agent to a polymer component having a terminal reactive functional group so as to form a crosslinked structure or a branched structure in the binder resin; 2) a method involving using polyvalent metal ions with a polymer component having a terminal ionic functional group so as to form a crosslinked structure or a branched structure in the binder resin; and 3) a method involving extending the resin chain length or forming branches in the binder resin by a treatment with an isocyanate or the like.

The toner particles may be a single-layer-structure toner particles, or core-shell-structure toner particles each constituted by a core (core particle) and a coating layer (shell) coating the core.

Core-shell toner particles may include a core containing a binder resin and, optionally, a coloring agent and other additives such as a releasing agent and a coating layer that contains a binder resin, for example.

The volume-average particle diameter (D50v) of the toner particles may be 2 μm or more and 10 μm or less or may be 4 μm or more and 8 μm or less.

The average particle diameters and particle size distribution indices of the toner particles are measured by using a COULTER MULTISIZER II (produced by Beckman Coulter Inc.) with ISOTON-II (produced by Beckman Coulter Inc.) as the electrolyte.

In measurement, 0.5 mg or more and 50 mg of the measurement sample is added to 2 ml of a 5% aqueous solution of a surfactant (may be sodium alkyl benzenesulfonate) as the dispersing agent. The resulting mixture is added to 100 ml or more and 150 ml or less of the electrolyte.

The electrolyte in which the sample is suspended is dispersed for 1 minute with an ultrasonic disperser, and the particle size distribution of the particles having a diameter in the range of 2 μm or more and 60 μm or less is measured by using COULTER MULTISIZER II with apertures having an aperture diameter of 100 μm. The number of the particles sampled is 50,000.

With respect to the particle size ranges (channels) divided on the basis of the measured particle size distribution, cumulative distributions of the volume and the number are plotted from the small diameter side. The particle diameters at 16% cumulation are defined as a volume particle diameter D16v and a number particle diameter D16p, the particle diameter at 50% cumulation are defined to be a volume-average particle diameter D50v and cumulative number-average particle diameter D50p, and the particle diameters at 84% cumulation are defined as a volume particle diameter D84v and a number particle diameter D84p.

The volume particle size distribution index (GSDv) is calculated as $(D84v/D16v)^{1/2}$, and the number particle size distribution index (GSDp) is calculated as $(D84p/D16p)^{1/2}$ by using these values.

The average circularity of the toner particles may be 0.94 or more and 1.00 or less, or may be 0.95 or more and 0.98 or less.

The average circularity of the toner particles is determined by (circle-equivalent perimeter)/(perimeter)[(perimeter of the circle having the same projection area as the particle image)/(perimeter of particle projection image)]. Specifically, it is the value measured by the following method.

First, toner particles to be measured are sampled by suction so as to form a flat flow, and particle images are captured as a still image by performing instantaneous strobe light emission. The particle image is analyzed by a flow particle image analyzer (FPIA-3000 produced by Sysmex Corporation) to determine the average circularity. The number of particles sampled in determining the average circularity is 3500.

When the toner contains an external additive, the toner (developer) to be measured is dispersed in a surfactant-containing water, and then ultrasonically processed to obtain the toner particles from which the external additive has been removed.

External Additive

An example of the external additive is inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

The surfaces of the inorganic particles serving as the external additive may be hydrophobized. Hydrophobizing may involve, for example, immersing inorganic particles in a hydrophobizing agent. The hydrophobizing agent may be any, and examples thereof include silane coupling agents, silicone oils, titanate coupling agents, and aluminum coupling agents. These may be used alone or in combination.

The amount of the hydrophobizing agent is typically 1 part by mass or more and 10 parts by mass or less relative to 100 parts by mass of the inorganic particles.

Examples of the external additive include resin particles (resin particles of polystyrene, polymethylmethacrylate (PMMA), melamine resin, etc.), and cleaning activating agents (for example, particles metal salts of higher aliphatic acids such as zinc stearate and fluorine-based high-molecular-weight materials).

The amount of the external additive externally added may be, for example, 0.01 mass % or more and 5 mass % or less or may be 0.01 mass % or more and 2.0 mass % or less relative to the toner particles.

Method for Producing Toner

Next, a method for producing the toner of the exemplary embodiment is described.

The toner of this exemplary embodiment is obtained by preparing toner particles and then externally adding an external additive to the toner particles.

The toner particles may be produced by a dry method (for example, a kneading and pulverizing method) or a wet method (for example, an aggregation and uniting method, a suspension polymerization method, or a dissolution suspension method). The toner particles may be made by any known process.

The toner of this exemplary embodiment is produced by, for example, adding an external additive to the obtained toner particles in a dry state, and mixing the resulting mixture. Mixing may be performed by using a V blender, a HENSCHEL mixer, a Loedige mixer, or the like. If needed, a vibrating screen, an air screen, or the like may be used to remove coarse particles of the toner.

Carrier

The carrier is not particularly limited and may be any known carrier. Examples of the carrier include a coated carrier prepared by covering the surface of a magnetic powder core with a coating resin, a magnetic powder-dispersed carrier prepared by dispersing and distributing magnetic powder in a matrix resin, and a resin-impregnated carrier prepared by impregnating porous magnetic powder with a resin.

The magnetic powder-dispersed carrier and the resin-impregnated carrier may each be a carrier prepared by covering a core formed of the particle that constitutes that carrier with a coating resin.

Examples of the magnetic powder include magnetic metals such as iron, nickel, and cobalt, and magnetic oxides such as ferrite and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylate copolymer, a straight silicone resin containing an organosiloxane bond and modified products thereof, fluororesin, polyester, polycarbonate, phenolic resin, and epoxy resin.

The coating resin and the matrix resin may contain other additives, such as conductive particles.

Examples of the conductive particles include particles of metals such as gold, silver, and copper, and particles of carbon black, titanium oxide, zinc oxide, tin oxide, barium sulfate, aluminum borate, and potassium titanate.

In order to cover the surface of the core with the coating resin, for example, a method may be used, which involves using a coating-layer-forming solution prepared by dissolving the coating resin and, if needed, various additives in an appropriate solvent. The solvent is not particularly limited and may be selected by considering the coating resin used, the suitability of application, etc.

Specific examples of the resin coating method include a dipping method involving dipping cores in the coating-layer-forming solution, a spraying method involving spraying the coating-layer-forming solution onto core surfaces, a fluid bed method involving spraying a coating-layer-forming solution while having the cores float on a bed of air, and a kneader coater method involving mixing cores serving as carriers and a coating-layer-forming solution in a kneader coater and removing the solvent.

In a two component developer, the toner-to-carrier mixing ratio (mass ratio) may be 1:100 to 30:100 or may be 3:100 to 20:100.

The structure of the image forming apparatus described in the exemplary embodiment is merely one example, and, naturally, the structure may be modified without departing from the gist of the exemplary embodiment.

EXAMPLES

The present invention will now be more specifically described through Examples and Comparative Examples which do not limit the present invention.

Preparation of Amorphous Polyester Resin

Preparation of Amorphous Polyester Resin (A1)

In a three-necked flask with a dried interior, 60 parts by mass of dimethyl terephthalate, 74 parts by mass of dimethyl fumarate, 30 parts by mass of dodecenylsuccinic anhydride, 22 parts by mass of trimellitic acid, 138 parts by mass of propylene glycol, and 0.3 parts by mass of dibutyltin oxide are reacted at 185° C. for 3 hours in a nitrogen atmosphere while removing water generated by reaction out of the system. Then, while the pressure is slowly decreased, the temperature is elevated to 240° C., and reaction is further conducted for 4 hours. The resulting mixture is then cooled. As a result, an amorphous polyester resin (A1) having a weight-average molecular weight of 39,000 is obtained.

Preparation of Amorphous Polyester Resin (A2)

An amorphous polyester resin (A2) is prepared by the same method as that for the amorphous polyester resin (A1) except that, after performing the reaction at 190° C. for 3 hours, the temperature is elevated to 220° C. while slowly decreasing the pressure, and the reaction is further conducted for 2.5 hours. The weight-average molecular weight is 26,000.

Preparation of Amorphous Polyester Resin (A3)

An amorphous polyester resin (A3) is prepared by the same method as that for the amorphous polyester resin (A1) except that 128 parts by mass of propylene glycol and 19 parts by mass of butylene glycol are used instead of 138 parts by mass of propylene glycol, and that after performing the reaction at 195° C. for 4 hours, the temperature is elevated to 240° C. while slowly decreasing the pressure, and the reaction is further conducted for 6 hours. The weight-average molecular weight is 56,000.

Preparation of Crystalline Resin

Preparation of Crystalline Polyester Resin (B1)

In a three-necked flask, 100 parts by mass of dimethyl sebacate, 67.8 parts by mass of hexanediol, and 0.10 parts by mass of dibutyltin oxide are reacted at 185° C. for 5 hours in a nitrogen atmosphere while removing water generated by the reaction out of the system. Then, while the pressure is slowly decreased, the temperature is elevated to 220° C., and the reaction is conducted for 6 hours. The resulting mixture is then cooled. As a result, a crystalline polyester resin (B1) having a weight-average molecular weight of 33,700 is obtained.

The melting temperature of this crystalline polyester resin (B 1) is determined from the DSC curve obtained by differential scanning calorimetry (DSC) by the method described in "Melting peak temperature", which is one method for determining the melting temperature in JIS K7121-1987 "Testing Methods for Transition Temperatures of Plastics". The melting temperature is 71° C.

Preparation of Reference Amorphous Polyester Resin

Preparation of Reference Amorphous Polyester Resin (C1)

A reference amorphous polyester resin (C1) is prepared by the same method as that for the amorphous polyester resin (A1) except that 60 parts by mass of dimethyl terephthalate, 74 parts by mass of dimethyl fumarate, 30 parts by mass of dodecenylsuccinic anhydride, 22 parts by mass of trimellitic acid, 137 parts by mass of bisphenol A ethylene oxide adduct, 191 parts by mass of bisphenol A propylene oxide adduct, and 0.3 parts by mass of dibutyltin oxide used. The weight-average molecular weight is 27,000.

Preparation of Toner

Preparation of Toner (1)

Into a Henschel mixer (produced by NIPPON COKE & ENGINEERING. CO., LTD.), 73 parts by mass of the amorphous polyester resin (A1), 6 parts by mass of the crystalline polyester resin (B 1), 7 parts by mass of a coloring agent (C.I. Pigment Red 122), 5 parts by mass of a releasing agent (paraffin wax, melting temperature: 73° C., produced by Nippon Seiro Co., Ltd.), and 2 parts by mass of ester wax (behenyl behenate, Unister M-2222SL produced by NOF CORPORATION) are placed, and the resulting mixture is stirred and mixed at a circumferential velocity of 15 m/second for 5 minutes. The resulting mixture is melted and kneaded in an extruder-type continuous kneader.

The setting conditions of the extruder are: supply side temperature: 160° C., delivery side temperature: 130° C., supply side temperature of cooling roller: 40° C., and delivery side temperature of cooling roller: 25° C. The temperature of the cooling belt is set to 10° C.

After the melted and kneaded mixture is cooled, the cooled mixture is roughly pulverized by using a hammer mill, finely pulverized to 6.5 μm by using a jet-type grinder (produced by Nippon Pneumatic Mfg. Co., Ltd.), and then classified by using an elbow-jet classifier (model EJ-LABO produced by Nittetsu Mining Co., Ltd.) so as to obtain toner particles (1). The volume-average particle diameter of the toner particles (1) is 7.0 μm.

In a HENSCHEL mixer (produced by Mitsui Miike Machinery Co., Ltd.), 100 parts by mass of the toner particles (1) and 1.2 parts by mass of commercially available fumed silica RX50 (produced by Nippon Aerosil Co., Ltd.) serving as an external additive are mixed under the conditions of a circumferential velocity of 30 m/s for 5 minutes so as to obtain the toner (1).

Preparation of Toner (2)

Toner particles (2) are prepared as with the toner particles (1) except that the amorphous polyester resin (A1) is changed to the amorphous polyester resin (A2). The volume-average particle diameter of the toner particles (2) is 6.8 μm.

The toner (2) is obtained as with the toner (1) except that the toner particles (2) are used.

Preparation of Toner (3)

Toner particles (3) are prepared as with the toner particles (1) except that the amorphous polyester resin (A1) is changed to the amorphous polyester resin (A3). The volume-average particle diameter of the toner particles (3) is 7.5 μm.

The toner (3) is obtained as with the toner (1) except that the toner particles (3) are used.

Preparation of Toner (4)

Toner particles (4) are prepared as with the toner particles (1) except that the crystalline polyester resin (B 1) is not used and the amount of the amorphous polyester resin (A1) is changed to 79 parts by mass. The volume-average particle diameter of the toner particles (4) is 7.1 μm.

The toner (4) is obtained as with the toner (1) except that the toner particles (4) are used.

Preparation of Reference Toner (C1)

Reference toner particles (C1) are prepared as with the toner particles (4) except that the amorphous polyester resin (A1) is changed to the reference amorphous polyester resin (C1). The volume-average particle diameter of the reference toner particles (C1) is 7.7 μm.

The reference toner (C1) is obtained as with the toner (1) except that the reference toner particles (C1) are used.

Preparation of Developer

Developers (1) to (4) and Reference Developer (C1)

Developers (1) to (4) and reference developer (C1) are each prepared by mixing 8 parts by mass of the corresponding toner and 100 parts by mass of a carrier.

The carrier is obtained by first preparing a coating solution by dispersing 14 parts by mass of toluene and 2 parts by mass of styrene-methyl methacrylate copolymer (component ratio: styrene/methyl methacrylate=90/10, weight-average molecular weight Mw=80,000) for 10 minutes in a stirrer to prepare a coating solution, placing 100 parts by mass of ferrite particles (volume-average particle diameter: 50 μm) and the coating solution into a vacuum deaerator-type kneader (produced by INOUE MFG., INC.), mixing the resulting mixture at 60° C. for 30 minutes, reducing the pressure and performing deaeration while heating, drying the resulting mixture, and then classifying the resulting mixture with a 105 μm sieve.

Measurements

For each of the toners, the molecular weight properties of the toner particles, the infrared absorption spectral characteristics of the toner particles, and the amount of the toluene-insoluble component are measured by the aforementioned procedures. The results are indicated in Table 1.

Preparation of Photoreceptor

Preparation of Photoreceptor (1)

Formation of Undercoat Layer

One hundred parts by mass of zinc oxide (average particle diameter: 70 nm, produced by Tayca Corporation, specific surface area: 15 $m^2/g$) and 500 parts by mass of toluene are mixed and stirred, and 1.3 parts by mass of a silane coupling agent (KBM503 produced by Shin-Etsu Chemical Co., Ltd.) is added to the resulting mixture, followed by stirring for 2 hours. Then, toluene is distilled away by vacuum distillation, baking is performed at 120° C. for 3 hours, and, as a result, zinc oxide surface-treated with the silane coupling agent is obtained. One hundred and ten parts by mass of the surface-treated zinc oxide and 500 parts by mass of tetrahydrofuran are mixed and stirred, a solution prepared by dissolving 0.6 parts by mass of alizarin in 50 parts by mass of tetrahydrofuran is added to the resulting mixture, and the resulting mixture is stirred at 50° C. for 5 hours. Subsequently, alizarin-doped zinc oxide is separated by vacuum filtration and vacuum-dried at 60° C. As a result, alizarin-doped zinc oxide is obtained.

Sixty parts by mass of the alizarin-doped zinc oxide, 13.5 parts by mass of a curing agent (blocked isocyanate, Sumidur 3175 produced by Sumitomo Bayer Urethane Co., Ltd.), 15 parts by mass of a butyral resin (S-LEC BM-1 produced by Sekisui Chemical Co., Ltd.), and 85 parts by mass of methyl ethyl ketone are mixed to obtain a mixed solution. Thirty-eight parts by mass of this mixed solution and 25 parts by mass of methyl ethyl ketone are mixed, and the resulting mixture is dispersed for 2 hours in a sand mill with glass beads having a diameter ϕ of 1 mm so as to obtain a dispersion. To the resulting dispersion, 0.005 parts by mass of dioctyltin dilaurate serving as a catalyst and 40 parts by mass of silicone resin particles (Tospearl 145 produced by Momentive Performance Materials Inc.) are added to obtain an undercoat-layer-forming solution. The undercoat-layer-forming solution is applied to an aluminum substrate by a dip coating method, and dried and cured at 170° C. for 40 minutes, so as to obtain an undercoat layer having a thickness of 20 μm.

Formation of Charge Generating Layer

A mixture containing 15 parts by mass of hydroxygallium phthalocyanine (CGM-1) serving as a charge generating material and having diffraction peaks at least at Bragg's angles (2θ±0.2°) of 7.3°, 16.0°, 24.9°, and 28.0° in an X-ray diffraction spectrum obtained by using CuKα X-ray, 10 parts by mass of a vinyl chloride-vinyl acetate copolymer resin (VMCH produced by Nippon Unicar Company Limited) serving as a binder resin, and 200 parts by mass of n-butyl acetate is dispersed in a sand mill with glass beads having a diameter ϕ of 1 mm for 4 hours. To the resulting dispersion, 175 parts by mass of n-butyl acetate and 180 parts by mass of methyl ethyl ketone are added and stirred so as to obtain a charge-generating-layer-forming solution. This charge-generating-layer-forming solution is applied to the undercoat layer by dip coating, and dried at room temperature (25° C.) to form a charge generating layer having a thickness of 0.2 μm.

Formation of Charge Transporting Layer

To 100 parts by mass of untreated (hydrophilic) silica particles "trade name: OX50 (produced by Nippon Aerosil Co., Ltd.), volume-average particle diameter: 40 nm", 30 parts by mass of a trimethylsilane compound (1,1,1,3,3,3-hexamethyldisilazane (produced by Tokyo Chemical Industry Co., Ltd.)) is added as a hydrophobizing agent, and the resulting mixture is reacted for 24 hours, followed by filtration, to obtain hydrophobized silica particles. These silica particles are assumed to be silica particles (1). The condensation ratio of these silica particles (1) is 93%.

To 50 parts by mass of silica particles (1), 250 parts by mass of tetrahydrofuran is added. To the resulting mixture kept at a liquid temperature of 20° C., 25 parts by mass of 4-(2,2-diphenylethyl)-4',4"-dimethyl-triphenylamine serving as a charge transporting material, and 25 parts by mass of a bisphenol Z-type polycarbonate resin (viscosity-average molecular weight: 30,000) serving as a binder resin are added, and the resulting mixture is stirred and mixed for 12 hours to obtain a charge-transporting-layer-forming solution.

This charge-transporting-layer-forming solution is applied to the charge generating layer, and dried at 135° C. for 40 minutes to form a charge transporting layer having a thickness of 30 μm so as to form an electrophotographic photoreceptor.

Formation of Surface Protection Layer

Synthesis of Compound A-4

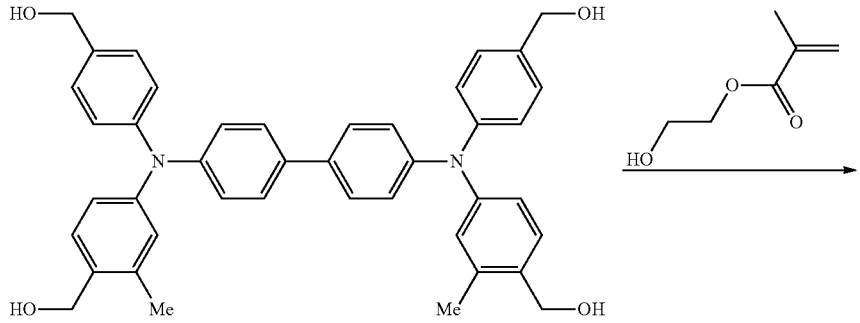

(1)

-continued

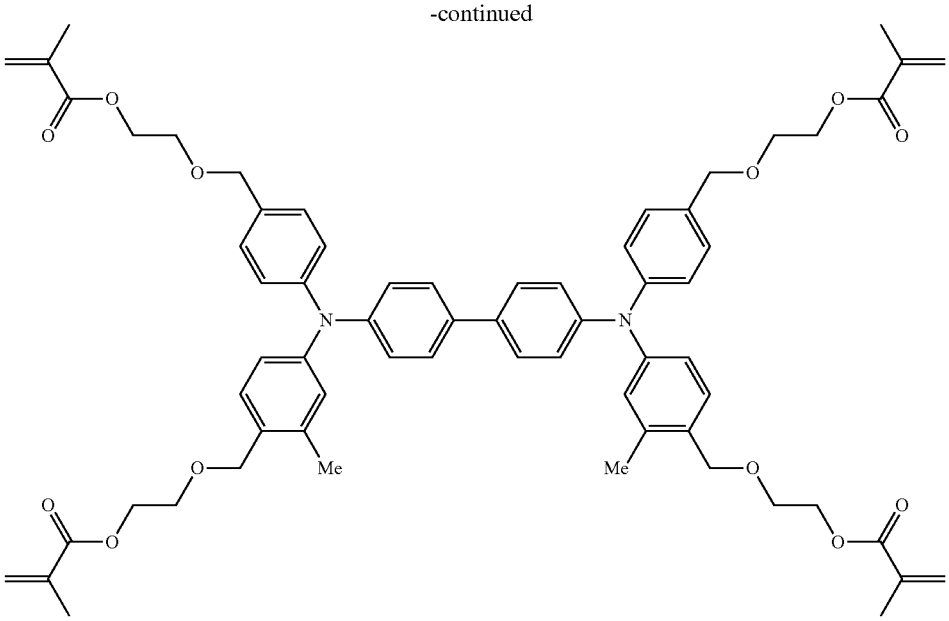

(A-4)

To a 200 ml flask, 10 g of the compound (1), 50 g of hydroxyethyl methacrylate, 20 ml of tetrahydrofuran, and 0.5 g of Amberlyst 15E (produced by Rohm and Haas Company) are added, and the resulting mixture is stirred at room temperature (25° C.) for 24 hours. Upon completion of the reaction, 100 ml of methanol is added, and an oily substance precipitated is taken out by decanting. The oily substance is purified by silica gel column chromatography, and 12 g of an oily substance (A-4) is obtained as a result.

A surface-protection-layer-forming solution is prepared by adding 30 parts by mass of a particular charge transporting material (compound A-4), 0.2 parts by mass of colloidal silica (trade name: PL-1 produced by Fuso Chemical Co., Ltd.), 30 parts by mass of toluene, 0.1 parts by mass of 3,5-di-t-butyl-4-hydroxytoluene (BHT), 0.1 parts by mass of azoisobutyronitrile (10-hour half-life temperature: 65° C.), and V-30 (produced by Wako Pure Chemical Industries, Ltd., 10-hour half-life temperature: 104° C.). The solution is applied to the charge transporting layer by a spray coating method, air-dried at room temperature (25° C.) for 30 minutes, and then heated under a nitrogen stream at an oxygen concentration of 110 ppm from room temperature to 150° C. over 30 minutes. Furthermore, a heat treatment at 150° C. is conducted for 30 minutes to cure the solution and form a surface protection layer having a thickness of 10 μm.

A photoreceptor (1) is obtained as such.

For the obtained photoreceptor, the Martens hardness of the surface protection layer, and the Martens hardness of the surface of the photosensitive layer, the surface being on the side close to the surface protection layer, are measured.

Preparation of Photoreceptor (C1)

A photoreceptor (C1) is obtained as with the photoreceptor (1) except that no surface protection layer is formed.

For the obtained photoreceptor, the Martens hardness of the surface of the photosensitive layer is measured.

Preparation of Cleaning Blade

A347 mm×10 mm×2 mm (thickness) plate-shaped object composed of polyurethane and having a hardness of 75 degrees is used as a cleaning blade (1).

Examples 1 to 4

Preparation of Image Forming Apparatus (1)

D136 Printer produced by Fuji Xerox Co., Ltd., is prepared as an image forming apparatus (1), and the photoreceptor (1) and the cleaning blade (1) are mounted to the printer to respectively serve as the photoreceptor and the cleaning blade.

The angle (contact angle) θ between the cleaning blade and the photoreceptor is set to 110, and the pressure N of pressing the cleaning blade against the photoreceptor is set to 2.5 gf/mm$^2$.

In the developing device of this image forming apparatus, developers having the toners (1) to (4) indicated in Table 1 below are housed, and replenishing toners (the same toners as those contained in the developers) are placed in a toner cartridge.

Comparative Examples 1 to 4 and Reference Example

Preparation of Image Forming Apparatus (C1) for Comparison

An image forming apparatus (C1) having the same structure as the image forming apparatus (1) except that the photoreceptor used is changed to the photoreceptor (C1) is prepared.

In the developing device of this image forming apparatus, developers having the toners (1) to (4) and (C1) indicated in Table 1 below are housed, and replenishing toners (the same toners as those contained in the developers) are placed in a toner cartridge.

Evaluation

Filming Evaluation

Occurrence of filming in a high-temperature, high-humidity environment (28° C., 85% RH) is evaluated for each of the image forming apparatuses by the following test.

After 5,000 pv (pv=print volume (number of sheets on which the image is formed)) of an image having an image density of 1% are output, an all-half-tone 50% image is output on one sheet. Occurrence of filming on the photoreceptor is observed with a microscope, and presence or absence of white streaks on the halftone image is checked.

The evaluation standards are as follows.

A: No filming on the photoreceptor, no white streaks on the image.

B: Little filming on the photoreceptor, no white streaks on the image.

C: Band-like filming on the photoreceptor, no white streaks on the image.

D: Band-like filming on the photoreceptor, white streaks on the image.

ronment is suppressed compared to the image forming apparatus of Comparative Example equipped with a photoreceptor having no surface protection layer and having a photosensitive layer constituting the outermost surface.

The image forming apparatus of Reference Example is an example in which a toner containing an amorphous polyester resin that uses an alkylene oxide adduct of bisphenol A is used. It can be understood that, in the image forming apparatus of Reference Example, occurrence of filming is suppressed even when the photoreceptor has no surface protection layer.

The foregoing description of the exemplary embodiments of the present invention has been provided for the purposes of illustration and description. It is not intended to be exhaustive or to limit the invention to the precise forms

TABLE 1

| | Developer (toner) | | | | | | | | | | | | |
|---|---|---|---|---|---|---|---|---|---|---|---|---|---|
| | | | Molecular weight properties | | | | Infrared absorption spectral characteristics of toner particles | | | | | | Amount of toluene-insoluble component in toner particles (mass %) |
| | Type | Binder resin | Mw | Mn | Mw/Mn | Peak molecular weight | Absorbance A at wavelength of 1500 $cm^{-1}$ | Absorbance B at wavelength of 820 $cm^{-1}$ | Absorbance C at wavelength of 720 $cm^{-1}$ | A/C | B/C | B/A | |
| Example 1 | (1) | (A1) + (B1) | 37000 | 5000 | 7.4 | 9500 | 0.07 | 0.02 | 0.15 | 0.5 | 0.1 | 0.3 | 34 |
| Example 2 | (2) | (A2) + (B1) | 25000 | 3000 | 8.3 | 7000 | 0.12 | 0.04 | 0.20 | 0.6 | 0.2 | 0.3 | 28 |
| Example 3 | (3) | (A3) + (B1) | 60000 | 8500 | 7.1 | 11000 | 0.05 | 0.02 | 0.11 | 0.5 | 0.2 | 0.4 | 38 |
| Example 4 | (4) | (A1) | 39000 | 4500 | 8.7 | 9800 | 0.08 | 0.02 | 0.14 | 0.6 | 0.1 | 0.3 | 33 |
| Comparative Example 1 | (1) | (A1) + (B1) | 37000 | 5000 | 7.4 | 9500 | 0.07 | 0.02 | 0.15 | 0.5 | 0.1 | 0.3 | 34 |
| Comparative Example 2 | (2) | (A2) + (B1) | 25000 | 3000 | 8.3 | 7000 | 0.12 | 0.04 | 0.20 | 0.6 | 0.2 | 0.3 | 28 |
| Comparative Example 3 | (3) | (A3) + (B1) | 60000 | 8500 | 7.1 | 11000 | 0.05 | 0.02 | 0.11 | 0.5 | 0.2 | 0.4 | 38 |
| Comparative Example 4 | (4) | (A1) | 39000 | 4500 | 8.7 | 9800 | 0.08 | 0.02 | 0.14 | 0.6 | 0.1 | 0.3 | 33 |
| Reference Example | (C1) | (C1) | 27000 | 5000 | 5.4 | 7500 | 0.90 | 0.50 | 0.30 | 3.00 | 1.67 | 0.56 | 31 |

TABLE 2

| | Image forming apparatus | | | | | |
|---|---|---|---|---|---|---|
| | | | | Martens hardness ($mN/mm^2$) | | |
| | Developer (toner) Type | Type | Surface protection layer | Surface protection layer | Photosensitive layer | Evaluation Filming |
| Example 1 | (1) | (1) | Present | 60 | 5 | A |
| Example 2 | (2) | (1) | Present | 35 | 5 | B |
| Example 3 | (3) | (1) | Present | 25 | 5 | B |
| Example 4 | (4) | (1) | Present | 80 | 5 | B |
| Comparative Example 1 | (1) | (C1) | Absent | — | 10 | D |
| Comparative Example 2 | (2) | (C1) | Absent | — | 5 | D |
| Comparative Example 3 | (3) | (C1) | Absent | — | 1 | D |
| Comparative Example 4 | (4) | (C1) | Absent | — | 19 | D |
| Reference Example | (C1) | (C1) | Absent | — | 10 | C |

The results described above indicate that, according to the image forming apparatuses of Examples each equipped with a photoreceptor having a surface protection layer, occurrence of filming in a high-temperature, high-humidity envidisclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier that includes a conductive substrate, and a photosensitive layer and a surface protection layer disposed on the conductive substrate in that order;

a charging device that charges a surface of the image carrier;

an electrostatic image forming device that forms an electrostatic image on the charged surface of the image carrier;

a developing device that includes an electrostatic image developer containing a toner for electrostatic image development, and develops the electrostatic image on the surface of the image carrier to form a toner image;

a transfer device that transfers the toner image onto a recording medium; and a cleaning unit that cleans the surface of the image carrier by a cleaning blade contacting the surface, wherein:

the toner has a binder resin containing:

(i) a crystalline resin, and (ii) an amorphous polyester resin, in which an amount of an alkylene oxide adduct of bisphenol A, if present, is not more than 5 mol %, relative to a total amount of polyhydric alcohols;

a tetrahydrofuran-soluble component of the toner has a weight average molecular weight Mw and a number average molecular weight Mn determined from gel permeation chromatography, and the Mw is in a range of from 25,000 to 60,000, and Mw/Mn is in a range of from 5 to 10; and the toner has absorbances measured by infrared absorption spectrometry, a ratio of an absorbance at a wavelength of 1500 $cm^{-1}$ to an absorbance at a wavelength of 720 $cm^{-1}$ is 0.6 or less, and a ratio of an absorbance at a wavelength of 820 $cm^{-1}$ to the absorbance at the wavelength of 720 $cm^{-1}$ is 0.4 or less.

2. The image forming apparatus according to claim 1, wherein the ratio of the absorbance at the wavelength of 1500 $cm^{-1}$ to the absorbance at the wavelength of 720 $cm^{-1}$ is 0.5 or less, and the ratio of the absorbance at the wavelength of 820 $cm^{-1}$ to the absorbance at the wavelength of 720 $cm^{-1}$ is 0.3 or less.

3. The image forming apparatus according to claim 1, wherein the ratio of the absorbance at the wavelength of 1500 $cm^{-1}$ to the absorbance at the wavelength of 720 $cm^{-1}$ is 0.2 or more, and the ratio of the absorbance at the wavelength of 820 $cm^{-1}$ to the absorbance at the wavelength of 720 $cm^{-1}$ is 0.05 or more.

4. The image forming apparatus according to claim 1, wherein a ratio of the absorbance at the wavelength of 820 $cm^{-1}$ to the absorbance at the wavelength of 1500 $cm^{-1}$ is 0.5 or less.

5. The image forming apparatus according to claim 1, wherein a ratio of the absorbance at the wavelength of 820 $cm^{-1}$ to the absorbance at the wavelength of 1500 $cm^{-1}$ is 0.4 or less.

6. The image forming apparatus according to claim 1, wherein the tetrahydrofuran-soluble component of the toner has a peak molecular weight ranging from 7,000 to 11,000.

7. The image forming apparatus according to claim 1, wherein the tetrahydrofuran-soluble component of the toner has a peak molecular weight ranging from 8,000 to 11,000.

8. The image forming apparatus according to claim 1, wherein the toner contains 28 mass % or more and 38 mass % or less of a toluene-insoluble component.

9. The image forming apparatus according to claim 8, wherein the toner contains 30 mass % or more and 35 mass % or less of the toluene-insoluble component.

10. The image forming apparatus according to claim 1, wherein an amount of the crystalline resin relative to a total amount of the toner is in a range of from 3 mass % to 20 mass %.

11. The image forming apparatus according to claim 1, wherein an amount of the crystalline resin relative to a total amount of the toner is in a range of from 5 mass % to 15 mass %.

12. The image forming apparatus according to claim 1, wherein the surface protection layer is formed of a cured product of a composition that contains a compound having at least one of an acryloyl group and a methacryloyl group.

13. The image forming apparatus according to claim 12, wherein the composition further contains a reactive group-containing charge transporting material that has a reactive group and a charge transporting skeleton.

14. The image forming apparatus according to claim 13, wherein the charge transporting skeleton in the reactive group-containing charge transporting material is a skeleton derived from a triarylamine compound.

15. The image forming apparatus according to claim 1, wherein the surface protection layer has a Martens hardness in a range of from 20 $mN/mm^2$ to 90 $mN/mm^2$.

16. The image forming apparatus according to claim 15, wherein a surface of the photosensitive layer has a Martens hardness in a range of from 1 $mN/mm^2$ to 19 $mN/mm^2$, the surface being on a side close to the surface protection layer.

* * * * *